US010420417B1

(12) United States Patent
Jones et al.

(10) Patent No.: US 10,420,417 B1
(45) **Date of Patent: *Sep. 24, 2019**

(54) LOAD COMPENSATOR FOR HEIGHT ADJUSTABLE TABLE

(71) Applicant: Steelcase Inc., Grand Rapids, MI (US)

(72) Inventors: David K. Jones, Grand Rapids, MI (US); Kurt Heidmann, Grand Rapids, MI (US); Todd Andres, Grand Rapids, MI (US)

(73) Assignee: Steelcase Inc., Grand Rapids, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/036,192

(22) Filed: Jul. 16, 2018

Related U.S. Application Data

(60) Continuation of application No. 15/075,382, filed on Mar. 21, 2016, now Pat. No. 10,051,955, which is a
(Continued)

(51) Int. Cl.
*A47B 9/02* (2006.01)
*A47B 9/12* (2006.01)
(Continued)

(52) U.S. Cl.
CPC ..... *A47B 9/02* (2013.01); *A47B 9/12* (2013.01); *A47B 9/20* (2013.01); *A47B 9/00* (2013.01)

(58) Field of Classification Search
USPC ..... 248/616, 589, 584, 125.2, 125.8, 295.11, 248/157, 161, 404, 406.1, 408;
(Continued)

(56) References Cited

U.S. PATENT DOCUMENTS 97,263 A 11/1869 Anderson
478,840 A 7/1892 Biggs et al.
(Continued)

FOREIGN PATENT DOCUMENTS

DE 217515 C 1/1910
DE 1091279 B 10/1960
(Continued)

OTHER PUBLICATIONS

The State Intellectual Property Office of the People's Republic of China, First Office Action, Application No. 200580047732.5, dated Apr. 2, 2010.

(Continued)

*Primary Examiner* — Alfred J Wujciak
(74) *Attorney, Agent, or Firm* — Quarles and Brady, LLP

(57) ABSTRACT

A table assembly comprising a telescoping leg assembly having upper and lower ends and forming an internal passageway and further including a plurality of leg members, at least a first leg member is adapted to slide telescopically with respect to at least a second of the leg members along a substantially vertical extension axis between an extended position and a retracted position, a spring that generates a variable spring force, the spring having first and second ends, aligned substantially parallel to the vertical extension axis and located within the internal passageway, a rotatable cam member supported by the leg assembly and operatively linked with the spring, the cam member and spring applying a force tending to drive the leg assembly into the extended position, a worksurface mounted to the upper end of the leg assembly and a lock adapted to prevent leg members from sliding telescopically with respect to one another when engaged.

43 Claims, 42 Drawing Sheets

Related U.S. Application Data continuation of application No. 14/592,583, filed on Jan. 8, 2015, now Pat. No. 9,591,920, which is a division of application No. 13/164,162, filed on Jun. 20, 2011, now abandoned, which is a continuation-in-part of application No. 11/305,595, filed on Dec. 16, 2005, now Pat. No. 8,091,841.

(60) Provisional application No. 60/637,031, filed on Dec. 17, 2004.

(51) Int. Cl.
*A47B 9/20* (2006.01)
*A47B 9/00* (2006.01)

(58) Field of Classification Search
USPC ..... 403/109.1–109.8; 108/147.19, 147, 108/144.1, 146, 150
See application file for complete search history.

(56) References Cited

U.S. PATENT DOCUMENTS 504,683 A 9/1893 Peartree
720,549 A 2/1903 Adler
1,938,978 A 12/1933 Rush
2,010,214 A 8/1935 Braun
2,017,012 A 10/1935 Morgan
2,019,455 A 10/1935 Lehman
2,168,209 A 8/1939 Haupt
2,178,122 A 10/1939 Ostler et al.
2,471,998 A 5/1949 Berggren
2,480,865 A 9/1949 Lofstrand
2,506,228 A 5/1950 Lofstrand, Sr.
2,657,925 A 11/1953 Crow
2,777,483 A 1/1957 Cherem
2,901,202 A 8/1959 Stava et al.
2,924,411 A 2/1960 Rouverol
2,931,685 A 4/1960 Butler
3,061,045 A 10/1962 Gunning
3,118,066 A 1/1964 Thomas et al.
3,194,187 A 7/1965 Linder et al.
3,269,035 A 8/1966 Bong
3,344,890 A 10/1967 Loef
3,543,282 A 11/1970 Sautereau
3,575,368 A 4/1971 Thomas et al.
3,640,228 A 2/1972 Busse
3,675,597 A 7/1972 Oddsen et al.
3,682,424 A 8/1972 Strumpell
3,707,930 A 1/1973 Yindra et al.
3,715,997 A 2/1973 Barth
3,738,632 A 6/1973 Mayerhofer
3,741,514 A 6/1973 Snurr
3,761,152 A 9/1973 Cory
3,799,485 A 3/1974 Wolters
3,853,297 A 12/1974 Drolet
3,854,428 A 12/1974 Fullenkamp
3,856,252 A 12/1974 Regis
3,890,907 A 6/1975 Peterson
3,895,770 A 7/1975 Yoshida et al.
3,905,311 A 9/1975 Carpentier
RE28,767 E 4/1976 Kuhlmann et al.
3,976,016 A 8/1976 Longbottom
3,989,211 A 11/1976 Gundlach
3,999,492 A 12/1976 Emrick
4,025,017 A 5/1977 Miller
4,111,389 A 9/1978 Gundlach et al.
4,195,578 A 4/1980 Benoit et al.
4,261,540 A 4/1981 Baker et al.
4,351,245 A 9/1982 Laporte
4,378,187 A 3/1983 Fullerton
4,387,468 A 6/1983 Fenne et al.
4,394,001 A 7/1983 Wisniewski
4,445,671 A 5/1984 Reuschenbach et al.
4,493,469 A 1/1985 Holobaugh
4,601,246 A 7/1986 Damico
4,605,189 A 8/1986 Bruneau
4,611,777 A 9/1986 Ireland et al.
4,613,106 A 9/1986 Tornero
4,616,218 A 10/1986 Bailey et al.
4,619,208 A 10/1986 Kurrasch
4,651,652 A 3/1987 Wyckoff
4,655,426 A 4/1987 von Dulong et al.
4,667,605 A 5/1987 Bastian
4,685,648 A 8/1987 Dobner et al.
4,728,072 A 3/1988 Mitchell
4,733,436 A 3/1988 Dochnahl
4,735,471 A 4/1988 Riggsby
4,750,701 A 6/1988 Folson et al.
4,751,884 A 6/1988 Ball
4,760,622 A 8/1988 Rohrman
4,802,198 A 1/1989 Guenther et al.
4,860,987 A 8/1989 Werner
4,914,780 A 4/1990 Rogers et al.
4,922,836 A 5/1990 Damico
4,943,020 A 7/1990 Beaucoup et al.
4,953,748 A 9/1990 Wheelock
4,964,152 A 10/1990 Kaul et al.
4,964,221 A 10/1990 Breyer et al.
5,004,203 A 4/1991 Fabius
5,031,869 A 7/1991 Strater et al.
5,088,421 A 2/1992 Beckstead
5,114,109 A 5/1992 Fitz et al.
5,129,611 A 7/1992 Grover et al.
5,273,352 A 12/1993 Saper
5,289,782 A 3/1994 Rizzi et al.
5,311,827 A 5/1994 Greene
5,400,721 A * 3/1995 Greene ..... A47B 9/02 108/147
5,401,089 A 3/1995 Inagaki et al.
5,421,481 A 6/1995 Fortmann et al.
5,613,816 A 3/1997 Cabahug
5,682,825 A 11/1997 Manner
5,706,739 A 1/1998 Shaheen et al.
5,720,369 A 2/1998 Thorn
5,733,084 A 3/1998 Fullerton
5,826,847 A 10/1998 Warner et al.
5,899,401 A 5/1999 Reimann et al.
5,941,182 A 8/1999 Greene
6,003,962 A 12/1999 Song
6,026,755 A 2/2000 Long
6,038,986 A 3/2000 Ransil et al.
6,062,148 A 5/2000 Hodge et al.
6,073,903 A 6/2000 Lindsay
6,146,523 A 11/2000 Kenley et al.
6,148,741 A 11/2000 Motta
6,220,185 B1 4/2001 Pontoppidan
6,247,772 B1 6/2001 Tuttle et al.
6,279,860 B1 8/2001 Swanger
6,289,825 B1 9/2001 Long
6,312,069 B1 11/2001 Weng
6,352,226 B1 3/2002 Gordon
6,378,829 B1 4/2002 Strater et al.
6,434,851 B1 8/2002 Nishina
6,443,075 B1 9/2002 Hahn et al.
6,546,880 B2 4/2003 Agee
6,550,597 B2 4/2003 Taniguchi
6,615,744 B1 9/2003 Eckstein et al.
6,639,788 B1 10/2003 Liao et al.
6,796,536 B1 9/2004 Sevier, IV
6,796,537 B1 9/2004 Lin
6,854,402 B2 2/2005 DuBarry et al.
7,032,870 B2 4/2006 Sweere et al.
7,044,423 B2 5/2006 Bober et al.
7,428,855 B2 9/2008 Duval
7,658,359 B2 2/2010 Jones et al.
8,091,841 B2 * 1/2012 Jones ..... A47B 9/00 248/125.2
9,038,549 B1 5/2015 Zebarjad
9,591,920 B2 * 3/2017 Jones ..... A47B 9/00
9,826,825 B1 11/2017 Jones et al.
9,913,532 B1 3/2018 Jones et al.
10,051,955 B1 * 8/2018 Jones ..... A47B 9/00
2002/0050112 A1 5/2002 Koch et al.

(56) References Cited

U.S. PATENT DOCUMENTS

| | | | |
|---|---|---|---|
| 2005/0279261 | A1 | 12/2005 | Lo |
| 2006/0145036 | A1 | 7/2006 | Jones et al. |
| 2007/0137535 | A1 | 6/2007 | Jones et al. |
| 2011/0315053 | A1 | 12/2011 | Jones et al. |
| 2015/0136000 | A1 | 5/2015 | Hotschi et al. |

FOREIGN PATENT DOCUMENTS

| | | | |
|---|---|---|---|
| DE | 1171222 | B | 5/1964 |
| DE | 1429615 | A1 | 1/1969 |
| DE | 1529723 | A1 | 1/1970 |
| DE | 1554418 | A1 | 1/1970 |
| DE | 1611809 | A1 | 1/1971 |
| DE | 2010386 | A1 | 9/1971 |
| DE | 7030726 | U | 3/1973 |
| DE | 2443649 | A1 | 3/1976 |
| DE | 2722729 | A1 | 12/1977 |
| DE | 3406669 | A1 | 8/1985 |
| DE | 3610612 | A1 | 10/1987 |
| DE | 3823042 | A1 | 1/1990 |
| DE | 10252931 | B3 | 7/2004 |
| EP | 0239956 | A2 | 10/1987 |
| EP | 0965786 | A1 | 12/1999 |
| JP | H02180204 | A | 7/1990 |
| JP | H05163880 | A | 6/1993 |
| JP | 11046886 | A | 2/1999 |
| JP | 2002128500 | A | 5/2002 |
| JP | 2003070582 | A | 3/2003 |
| JP | 2004033415 | A | 2/2004 |
| WO | 9013240 | A1 | 11/1990 |
| WO | 9303650 | A1 | 3/1993 |
| WO | 9747217 | A1 | 12/1997 |
| WO | 2005012783 | A2 | 2/2005 |

OTHER PUBLICATIONS

The State Intellectual Property Office of the People's Republic of China, Second Office Action, Application No. 200580047732.5, dated Apr. 25, 2011.

The State Intellectual Property Office of the People's Republic of China, Third Office Action, Application No. 200580047732.5, dated Feb. 27, 2012.

European Patent Office, Examination Report, Application No. 05854455.2, dated Jul. 21, 2010.

Applicant, Response to Jul. 21, 2010 Examination Report, Application No. EP 05854455.2, dated Jan. 31, 2011.

PCT Declaration of Non-Establishment of International Search Report and Written Opinion, Application No. PCT/US2005/045743, dated Apr. 10, 2006.

PCT International Preliminary Report on Patentability, Application No. PCT/US2005/045743, dated Jun. 19, 2007.

* cited by examiner

FIG. 15
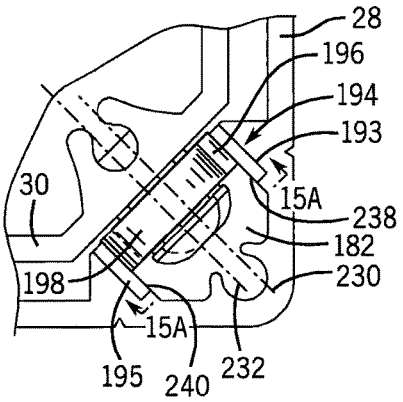
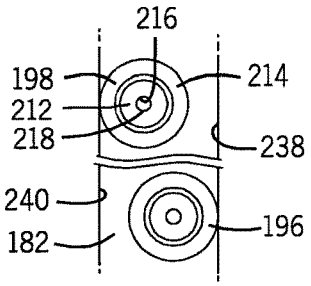
FIG. 15A
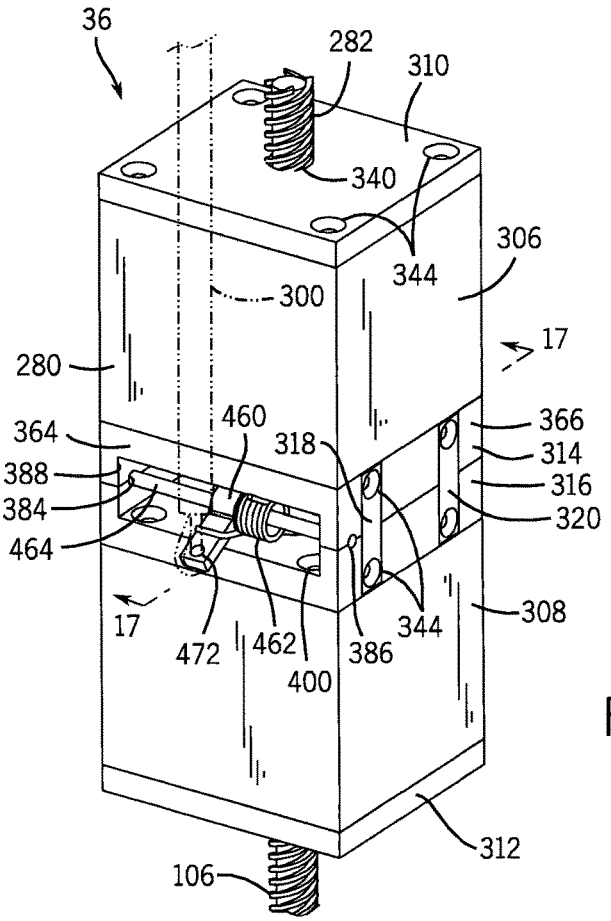
FIG. 16

FIG. 37
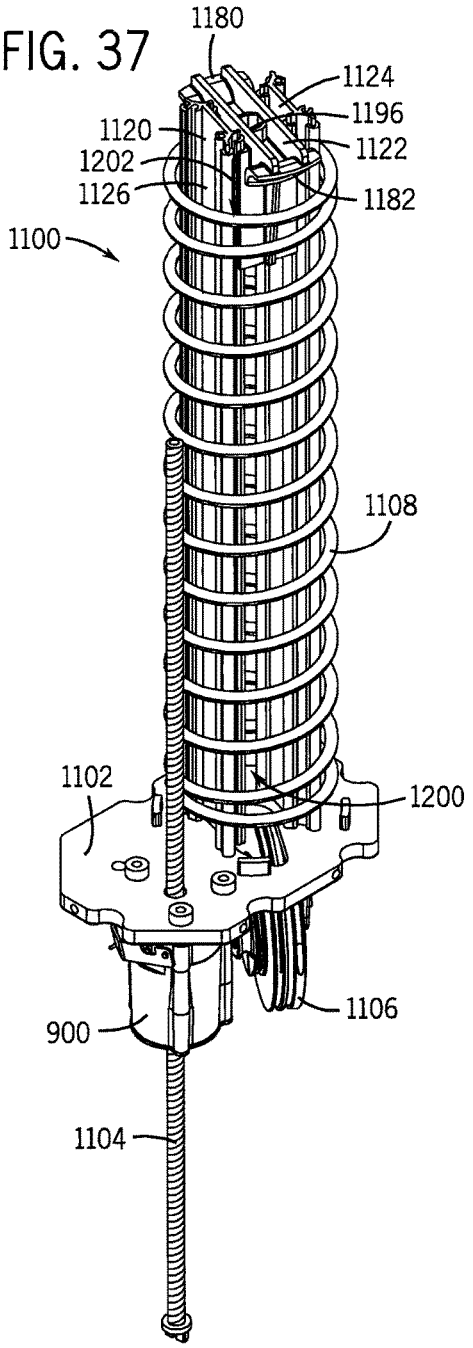
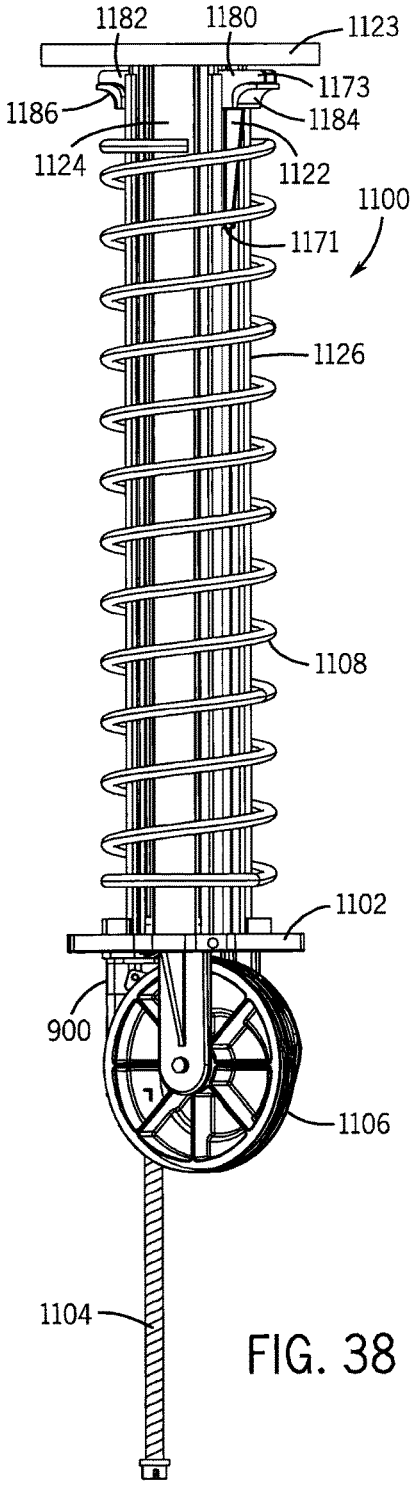
FIG. 38

LOAD COMPENSATOR FOR HEIGHT ADJUSTABLE TABLE

CROSS-REFERENCE TO RELATED APPLICATIONS

This application is a continuation of U.S. patent application Ser. No. 15/075,382 which was filed on Mar. 21, 2016, which was titled "Load Compensator For Height Adjustable Table," which was a continuation of U.S. patent application Ser. No. 14/592,583 which was filed on Jan. 8, 2015, which was titled "Load Compensator For Height Adjustable Table," which was a divisional of U.S. patent application Ser. No. 13/164,162 filed on Jun. 20, 2011, which is a continuation-in-part of U.S. Pat. No. 8,091,841 which issued on Jan. 10, 2012, which claimed priority to U.S. provisional patent application No. 60/637,031 filed on Dec. 17, 2004, each of which is hereby incorporated by reference in its entirety.

STATEMENT REGARDING FEDERALLY SPONSORED RESEARCH OR DEVELOPMENT

Not applicable.

BACKGROUND OF THE INVENTION

The inventive concepts described herein pertain to tables and, more particularly, to a vertical and adjustable support for tables or the like.

Tables are used in many different environments for many different purposes. For instance, in an office environment, tables may be used in a partition space as a desk top to support a seated person, as a monitor support, as a conferencing table for seated conferees, as a standing conferencing table, as a work station supporting surface for a standing person, etc. Where tables are used for many different applications, ideally, the tables are constructed to have task specific heights that are ergonomically correct. For instance, in the case of a desk top for use by a seated user, a surface top height should be approximately 28 to 30 inches above a supporting floor. As another instance, in the case of a desk top for use by a standing user, the surface height should be approximately 42 to 45 inches above a supporting floor. Many other surface heights are optimal for other tasks.

In order to reduce the number of tables required to support different tasks within an environment, adjustable height tables have been developed that allow a user to modify table height to provide table surfaces at task optimized heights. Thus, for instance, some exemplary adjustable tables include leg structure including a lower column mounted to a base support and an upper column that is received within an internal channel formed by the lower column and telescopes therefrom and a table top that is mounted to the top end of the lower column. Here, a locking mechanism is provided to lock the relative juxtapositions of the upper and lower columns. To adjust table top height, the locking mechanism is unlocked and the upper column is extended from the lower column until a desired height is reached after which the locking mechanism is again locked.

One particularly advantageously table configuration includes a single pedestal type support structure disposed below a table top. In addition to being aesthetically pleasing, a single pedestal structure facilitates additional design options, especially where the single pedestal structure can be off table top center (e.g., closer to a rear table top edge than to an oppositely facing front table top edge).

One problem with telescoped upper and lower columns that support a table top is that the upper column, table top and load thereon are often relatively heavy and therefore difficult for a person to raise and lower in a controlled fashion. One solution to the weight problem has been to provide a counterbalance assembly in conjunction with a height adjustable table that, as the label implies, compensates for or balances at least a portion of the combined weight of the upper column, table top and load thereon.

One exemplary single pedestal counterbalancing system is described in U.S. Pat. No. 3,675,597 (hereinafter "the '597 patent") which includes a metal roll type spring mounted near the top end of an upper column, a pulley mounted near the bottom of the upper column and a cable having a central portion supported by the pulley and first and second ends that extend up to the top end of a lower stationary column and to a free end of the spring. The spring is in a normally wound state when the upper column is in a raised position and is in an extended a loaded state when the upper column is lowered into the lower column. Thus, the spring provides a counterbalance force that tends to drive the upper column and table top mounted thereto upward.

While the solution described in the '597 patent can be employed in a single pedestal type support structure, this solution has several shortcomings. First, this solution provides no way of conveniently adjusting the counterbalance force to compensate for different table top loads. To this end, because table top loads often vary appreciably, it is advantageous to provide some type of mechanism that allows the counterbalance force to be adjusted within some anticipated range (e.g., 50 to 300 pounds). In the case of the '597 patent, counterbalance adjustment is accomplished by adding additional springs (see FIGS. 11 and 12) which is a cumbersome task at best and, in most cases, likely would be completely avoided by a table user.

Second, the '597 patent solution fails to provide a safety mechanism for arresting upper column movement when the table top is either overloaded or, given a specific counterbalance force, under loaded. Thus, for instance, if the tabletop load is much greater than the counterbalance force when a locking mechanism is unlocked, the table top and load will drop quickly and unexpectedly. Similarly, if the table top load is much smaller than the counterbalance force is on the table top when the locking mechanism is unlocked, the table top and load would rise quickly and unexpectedly. Unexpected table movement can be hazardous.

Third, the amount of counterbalance force required to aid in raising the upper column, table top and load thereon in the '597 patent, in addition to depending on the size of the load, also depends on the distribution of the load. In this regard, a considerable amount of friction results when the upper column moves with respect to the lower column as at least portions of the upper and lower columns make direct contact during movement. The amount of friction is exacerbated if the load on the table top is unevenly distributed. Thus, for instance, if the load is located proximate one edge of the table top instead of directly over the pedestal support, the upper column will be somewhat cantilevered from the lower column and greater friction will occur—thus the same load can have appreciably different effects on the required counterbalancing force required to be effective.

U.S. Pat. No. 6,443,075 (hereinafter "the '075 patent") describes a table system that includes many of the features that the '597 patent solution lacks, albeit in the context of a configuration that includes two upper columns as opposed to a single column. To this end, the '075 patent teaches two raisable columns supported by a base where a release mechanism is operable to attempt to release a locking mechanism which, when unlocked, allows a table top to be moved upward or downward along a table stroke. Here, a spring loaded cam member operates as a counterbalance mechanism.

The '075 patent also teaches a mechanism for adjusting the counterbalancing assembly so that different counterbalance forces can be dialed in to compensate for different table top loads. Thus, for instance, where it is contemplated that a computer monitor may be placed on and removed from a table top at different times, by providing an adjustable counterbalance assembly, the changing load can be effectively compensated and the force required by a person attempting to change table top height can be minimized.

The '075 patent further teaches a safety mechanism for, when the locking mechanism is unlocked, prohibiting downward table movement when the table top load is greater than some maximum load level associated with a safe rate of table top descent. Similarly, the '075 patent teaches a safety mechanism for, when the locking mechanism is unlocked, prohibiting upward table movement when the table top is under loaded to an extent greater than some minimum load level associated with a safe rate of table top ascent.

While the solution described in the '075 patent has many advantageous features, unfortunately the solution also has several shortcomings. First, while the '075 patent teaches an overload/under load safety mechanism, the safety mechanism is only partially effective. To this end, the safety mechanism taught by the '075 patent works when a table top is over or under loaded when a locking mechanism is unlocked. However, if table load changes while the locking mechanism is unlocked and the table is either moving up or down (i.e., a person places a heavy box on the table top or removes a heavy box from the top), the overload/underload protection mechanism will not activate and the table top will either rise or drop quickly and unexpectedly.

Second, the '075 patent solution is designed for raising two columns, not one, and requires space between the two columns for accommodating various components. Thus, the '075 patent solution includes components that cannot be concealed within a single telescoping type column configuration which is preferred for many applications for aesthetic as well as design and space saving reasons.

Third, the '075 patent solution does not appear to facilitate a constant upward force on the upper column and table top irrespective of the height of the table top along its stroke as is desired in many applications. Instead, the upward force appears to be variable along the table top stroke and to depend at least in part on table top height.

Fourth, the '075 patent solution requires a table user to either modify table top load or manually adjust the counterbalance force when a load and the counterbalance force are not sufficiently balanced prior to changing the table top height. Here, changing the counterbalance force can be a tedious task as the table user has to estimate the amount of unbalance when adjusting the required amount of counterbalance which, in most cases, would be an iterative process.

Fifth, assuming the counterbalance force is similar to a table load when the locking mechanism is unlocked, the '075 patent appears to allow fast table top movement. For instance, when the locking mechanism is unlocked, a table user can force the table top up or down very quickly. While fast table top movement may seem advantageous, rapid movement can cause excessive wear and even damage to assembly components. For example, if the top is forced rapidly downward toward the end of the movement stroke, the moveable column components may collide with excessive force with the stationary components. As another example, if the locking mechanism is released while the table top is rapidly descending, the locking mechanism could be damaged as movement of the moving column is halted. Similarly, if the top moves to rapidly, items such as displays, printers, etc., supported by the top could be damaged.

Thus, it would be advantageous to have a simplified counterbalancing assembly that could be mounted within a single column type support structure. It would also be advantageous to have a safety locking mechanism for use in a single column where the safety locking mechanism operates any time an overload condition or an under load condition occurs. In at least some cases it would be advantageous if the counterbalancing mechanism were adjustable. Moreover, in at least some cases it would be advantageous if the maximum up and down speed of the table top were controlled.

BRIEF SUMMARY OF THE INVENTION

Some embodiments of the invention include an assembly for adjusting the position of a first guide member, the assembly comprising a second guide member forming a channel, the first guide member positioned within the channel for sliding movement along an adjustment axis, a threaded shaft mounted at least partially within the channel for rotation about the adjustment axis, a nut threadably receiving the shaft and supported by the first guide member and a lever member supported by the first guide member and including at least a first nut engaging member, wherein the lever member restricts rotation of the nut with respect to the first guide member during at least a portion of travel of the first guide member within the channel and allows nut rotation in at least a first direction with respect to the first guide member when the first guide member is in at least a first position.

In addition, some embodiments include an assembly for adjusting the position of a first guide member, the assembly comprising a second guide member forming a channel, the first guide member positioned within the channel for sliding movement along an adjustment axis, a threaded shaft mounted at least partially within the channel for rotation about the adjustment axis, a nut threadably receiving the shaft and supported by the first guide member and a lever member supported by the first guide member, wherein the lever member restricts rotation of the nut with respect to the first guide member during at least a portion of travel of the first guide member within the channel, allows nut rotation in a first direction and restricts rotation in a second direction opposite the first direction with respect to the first guide member when the first guide member is in at least a first position along the channel and allows nut rotation in the second direction and restricts rotation in the first direction when the first guide member is in at least a second position along the channel.

Moreover, some embodiments include a support assembly, the assembly comprising a first elongated member having a length dimension parallel to a substantially vertical extension axis, a second elongated member supported by the first member for sliding motion along the extension axis between at least an extended position and a retracted position, a spring that generates a variable spring force that depends at least in part on the degree of spring loading, the spring having first and second ends where the first end is supported by and stationary with respect to the second elongated member, an equalizer assembly including a strand having first and second ends, the first end linked to the second end of the spring and a second end linked to the first member, the force equalizer assembly and spring applying a force between the first and second members tending to drive the elongated members into the extended position wherein the applied force is substantially constant irrespective of the position of the second elongated member with respect to the first elongated member, a preloader supported by at least one of the first and second elongated members and supporting at least a portion of the strand, the preloader applying a preload force via the strand to the spring when the second elongated member is in a fully extended position and an adjuster for adjusting the preload force applied by the preloader.

Furthermore, some embodiments include a force adjustment assembly for use within a telescoping subassembly that includes a first elongated member and a second elongated member that is supported by the first elongated member for sliding motion along an extension axis, the subassembly further including a force equalizer assembly that includes a strand having first and second ends that are supported by the second and first elongated members, respectively, the adjustment assembly comprising a preloader supported by at least one of the first and second elongated members and supporting at least a portion of the strand, the preloader applying a preload force via the strand when the second elongated member is in a fully extended position and an adjuster for adjusting the preload force applied by the preloader.

In addition, some embodiments include a force adjustment assembly for use within a telescoping subassembly that includes a first elongated member and a second elongated member that is supported by the first elongated member for sliding motion along an extension axis, the subassembly further including a force equalizer assembly that includes a strand having first and second ends that are supported by the second and first elongated members, respectively, the adjustment assembly comprising a preloader supported by at least one of the first and second elongated members and supporting at least a portion of the strand, the preloader applying a preload force via the strand when the second elongated member is in a fully extended position, an adjuster for adjusting the preload force applied by the preloader and a clutch between the adjuster and the preloader for, when the force between the adjuster and the preloader exceeds a threshold level, allowing the adjuster to slip with respect to the preloader.

Moreover, other embodiments include a telescoping assembly, the assembly comprising a first member having a length dimension along an extension axis, a threaded shaft linked to and stationary with respect to the first member and aligned substantially along the extension axis, a nut mounted to the threaded shaft for movement there along, the nut forming a first frusto-conically shaped engaging surface proximate one end, a locking member forming a second frusto-conically shaped engaging surface proximate the first engaging surface, the locking member moveable between a locking position with the second surface contacting the first surface and restricting rotation of the nut and an unlocking position with the second surface separated from the first surface, a second member supported by the first member for movement along the extension axis, the second member also supported by the nut for movement therewith and a biaser biasing the locking member toward the nut and biasing the second engaging surface toward the first engaging surface.

Yet other embodiments include a support assembly, the assembly comprising a first member having a length dimension parallel to a substantially vertical extension axis, a second member supported by the first member for sliding motion along the extension axis between at least an extended position and a retracted position, a spring that generates a variable spring force that depends at least in part on the degree of spring loading, the spring having first and second ends where the first end is supported by and stationary with respect to the second member, an equalizer assembly including a first end linked to the second end of the spring and a second end linked to the first member, the force equalizer assembly and spring applying a force between the first and second members tending to drive the members into the extended position wherein the applied force is substantially constant irrespective of the position of the second member with respect to the first member and a locking mechanism including at least a first locking member supported by at least one of the first and second members, the first locking member moveable between a locked position wherein the locking member substantially minimizes movement of the second member with respect to the first member and an unlocked position wherein the first locking member allows movement of the second member with respect to the first member.

Other embodiments include a telescoping assembly, the assembly comprising a first member having a length dimension along an extension axis, a second member supported by the first member for movement along the extension axis, a threaded shaft linked to and stationary with respect to the first member and aligned substantially along the extension axis, a housing forming a first stop surface and a first bearing surface, the housing linked to the second member for movement therewith, a first space located adjacent the first stop member, a nut mounted to the threaded shaft for movement there along and located within the first space adjacent the first stop surface, a locking means for restricting and allowing rotation of the nut with respect to the threaded shaft, a biaser mounted between the first bearing surface and the nut, the biaser tending to bias the nut away from the first stop surface wherein, with the locking means restricting rotation of the nut, when a force within a first range is applied to the second member along a first trajectory tending to move the first stop surface toward the nut, the first bearing surface and the nut compress the biaser so that the nut contacts the first stop surface and the first stop surface tends to separately restrict movement of the nut.

Other embodiments include a spring assembly for use in a counterbalance system, the assembly comprising a datum member, a compression spring having proximal and distal ends, the proximal end of the spring supported by the datum member, an elongated guide having proximal and distal ends and including at least a first substantially straight edge that extend between the proximal and distal ends of the guide, the proximal end of the guide supported by the datum member, the first edge extending along the length of the spring from the proximal end of the spring to the distal end of the spring wherein a space between the first edge and an adjacent portion of the spring is less than one quarter of an inch and a strand including first and second ends, the first end of the strand linked to the distal end of the spring and the second end of the strand extending toward and past the proximal end of the spring.

Other embodiments include a spring assembly for use in a counterbalance system, the assembly comprising a datum member that forms an opening, a compression spring having proximal and distal ends and including an internal surface that forms a spring passageway along the length of the spring, the proximal end of the spring supported by the datum member with the opening in the datum member at least partially aligned with the spring passageway, a guide including at least a first elongated guide member and a first separator member, the elongated guide member supported at a proximal end by the datum member and extending from the proximal end to the distal end within the spring passageway, the first separator member covering a portion of the guide member and separating the portion of the guide member from the spring and a strand including first and second strand ends, the first end linked to the distal end of the spring, the second end extending through the spring passageway and the opening in the datum member, wherein the guide member and the separator member are formed of first and second materials and the second material is a lower friction material than the first material.

Still other embodiments include a spring assembly for use in a counterbalance system, the assembly comprising a datum member that forms an opening, a compression spring having proximal and distal ends and including an internal surface that forms a spring passageway along the length of the spring, the proximal end of the spring supported by the datum member with the opening in the datum member at least partially aligned with the spring passageway, a guide supported at a proximal end by the datum member and extending from the proximal end to the distal end within the spring passageway, the guide including first and second guide members that are substantially parallel to each other and that are separated by a space to form a channel therebetween, the first guide member forming first and third extension members that extend generally away from the second guide member and first and second rails that extend generally toward the second guide member, the second guide member forming second and fourth extension members that extend generally away from the first guide member and third and fourth rails that extend generally toward the first guide member, a plunger supported by the rails for movement there along, the plunger having first and second ends, the first end linked to the distal end of the spring, separator members including separator members secured to at least portions of the first, second, third and fourth extension members and that form external surfaces, at least portions of the external surfaces proximate the internal surface of the spring, the separator members also including members positioned between the plunger and the rails to separate the plunger from the rails and a strand including first and second ends, the first end linked to the plunger and the second end extending through the spring passageway and the opening formed by the datum member.

Some additional embodiments include an extendable leg apparatus comprising a first column having a length dimension parallel to a substantially vertical extension axis, a second column supported by the first column for sliding motion along the extension axis between at least an extended position and a retracted position, at least one of the first and second columns forming an internal cavity and a counterbalance assembly including a spring guide supported substantially within the cavitya compression spring having first and second ends and forming a spring passageway, the spring positioned such that the spring guide resides at least in part in the spring passageway and with a first end supported within the cavity and an equalizer assembly including a first end linked to the second end of the spring and a second end linked to the first column, the force equalizer assembly and spring applying a force between the first and second columns tending to drive the columns into the extended position wherein the applied force is substantially constant irrespective of the position of the second column with respect to the first column.

Other embodiments include a telescoping assembly, the assembly comprising a first elongated member including an internal surface that forms a first passageway extending along an extension axis, a second elongated member including an external surface, the second member received within the first passageway for sliding movement along the extension axis, a first of the internal and external surfaces forming a first mounting surface pair including first and second co-planar and substantially flat mounting surfaces, a second of the internal and external surfaces forming a first raceway along at least a portion of the first surface length, the first raceway having first and second facing raceway surfaces adjacent the mounting surface pair and at least a first roller pair including first and second rollers mounted to the first and second mounting surfaces for rotation about first and second substantially parallel roller axis, respectively, the first and second roller axis spaced apart along the extension axis, the first roller axis closer to the first raceway surface than to the second raceway surface and the second roller axis closer to the second raceway surface than to the first raceway surface wherein the first and second rollers interact with the first and second raceway surfaces to facilitate sliding of the first elongated member with respect to the second elongated member along the extension axis.

Moreover, some embodiments include a telescoping assembly, the assembly comprising a first elongated member including an internal surface that forms a first passageway extending along an extension axis, a second elongated member including an external surface, the second member received within the first passageway for sliding movement along the extension axis, a first of the internal and external surfaces forming first, second, third and fourth mount surfaces wherein the first and third mount surfaces form less than a 30 degree angle and are non-co-planar, the second and fourth mount surfaces form less than a 30 degree angle and are non-co-planar and the first and second mount surfaces form an angle between 60 and 120 degrees, a second of the internal and external surfaces forming first, second, third and fourth raceways along at least a portion of the second surface length, the first, second, third and fourth raceways adjacent the first, second, third and fourth mount surfaces and including first and second spaced apart, third and fourth spaced apart, fifth and sixth spaced apart and seventh and eighth spaced apart raceway surfaces, respectively, first, second, third and fourth bearing pairs mounted to the first, second, third and fourth mount surfaces and including first and second, third and fourth, fifth and sixth, and seventh and eighth bearings, respectively, where the bearings of each pair are spaced apart along the extension axis, the first, third, fifth and seventh bearings supported relatively closer to the first, third, fifth and seventh raceway surfaces than to the second, fourth, sixth and eighth raceway surfaces and the second, fourth, sixth and eighth bearings supported relatively closer to the second, fourth, sixth and eighth raceway surfaces than to the first, third, fifth and seventh raceway surfaces and, wherein, the first, second, third, fourth, fifth, sixth, seventh and eighth bearings interact with the first, second, third, fourth, fifth, sixth, seventh and eighth raceway surfaces, respectively, to facilitate sliding motion of the second elongated member with respect to the first elongated member.

Other embodiments include a telescoping assembly, the assembly comprising a first elongated member including an internal surface that forms a first passageway extending along an extension axis, a second elongated member including an external surface, the second member received within the first passageway, one of the internal and external surfaces forming first and third non-coplanar mount surfaces that form less than a 30 degree angle and second and fourth non-coplanar mount surfaces that form less than a 30 degree angle where the second mount surface forms an angle between substantially 60 and 120 degrees with respect to the first mount surface, the other of the internal and external surfaces forming first, second, third and fourth raceways adjacent the first, second, third and fourth mount surfaces and first, second, third and fourth roller assemblies mounted to the first, second, third and fourth mount surfaces, respectively, each roller assembly including at least one roller mounted for rotation about an axis that is substantially perpendicular to the mounting surface to which the roller is mounted and that is substantially perpendicular to the extension axis, the first, second, third and fourth roller assemblies interacting with the first, second, third and fourth raceways to facilitate sliding motion of the first elongated member along the extension axis with respect to the second elongated member.

Some embodiments include an extendable leg apparatus comprising a first column having a length dimension parallel to a substantially vertical extension axis, a second column supported by the first column for sliding motion along the extension axis, at least one of the first and second columns forming an internal cavity, a table top supported by one of the first and second columns and a counterbalance assembly including a spring having first and second ends, the first end supported substantially within the cavity, a spiral cam pulley supported substantially within the cavity for rotation about a pulley axis, the pulley including a lateral surface spaced from the pulley axis, the lateral surface forming a helical cable channel that wraps around the pulley axis and that includes first and second channel ends so that at least a portion of the channel and the pulley axis forms channel radii perpendicular to the pulley axis, the radii increasing along at least a portion of the channel in the direction from the first channel end toward the second channel end and at least one strand having a central portion and first and second strand ends, the central portion received within at least a portion of the pulley channel with the first and second strand ends extending from a first radii portion and a second radii portion of the channel where the first portion has a radii that is smaller than the second portion, the first and second strand ends linked to the first column and the second end of the spring, respectively, wherein the strand has a cross sectional diameter and the minimum radii of the channel from which the first strand end extends is at least five times the strand diameter.

In addition, some embodiments include a support assembly, the assembly comprising a first elongated member having a length dimension parallel to a substantially vertical extension axis and forming an internal surface, a second elongated member supported by the first member for motion along the extension axis between at least an extended position and a retracted position, the second elongated member forming an external surface, a spring that generates a variable spring force that depends at least in part on the degree of spring loading, the spring having first and second ends where the first end is supported by and stationary with respect to the second elongated member, an equalizer assembly including a first end linked to the second end of the spring and a second end linked to the first member, the force equalizer assembly and spring applying a force between the first and second members tending to drive the elongated members into the extended position wherein the applied force is substantially constant irrespective of the position of the second elongated member with respect to the first elongated member and rollers positioned between the internal and external surfaces to facilitate movement of the second column along the vertical extension axis with respect to the first column wherein each roller includes an annular inner bearing race, an annular outer bearing race and bearings between the inner and outer races.

These and other objects, advantages and aspects of the invention will become apparent from the following description. In the description, reference is made to the accompanying drawings which form a part hereof, and in which there is shown a preferred embodiment of the invention. Such embodiment does not necessarily represent the full scope of the invention and reference is made therefore, to the claims herein for interpreting the scope of the invention.

BRIEF DESCRIPTION OF THE SEVERAL VIEWS OF THE DRAWINGS

The invention will hereafter be described with reference to the accompanying drawings, wherein like reference numerals denote like elements, and:

FIG. 15 is an enlarged end view of a portion of the leg assembly of FIG. 14 taken along the line 15-15;

FIG. 15*a* is a detail view taken in the direction of line 15-15 in FIG. 15.

FIG. 16 is an enlarged perspective view of the locking assembly of FIG. 3;

FIG. 37 is a perspective view of a second embodiment of a spring and spring guide subassembly mounted to a datum plate;

FIG. 38 is a side plan view of the configuration of FIG. 37;

DETAILED DESCRIPTION OF THE INVENTION

Figure 1:
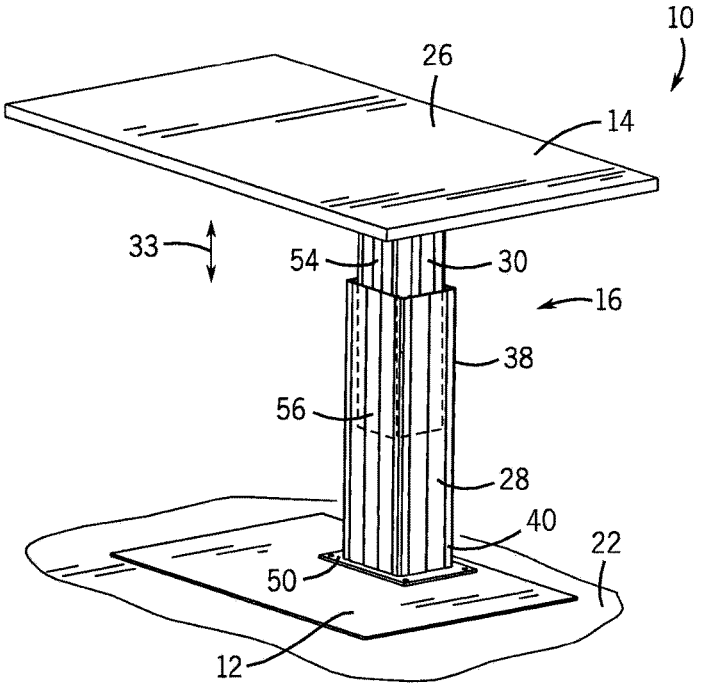
FIG. 1 is a perspective view of a table assembly according to at least some aspects of the present invention.

One or more specific embodiments of the present invention are described below. It should be appreciated that, in the development of any such actual implementation, as in any engineering or design project, numerous implementation-specific decisions must be made to achieve the developers' specific goals, such as compliance with system-related and business related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Referring now to the drawings wherein similar reference numerals correspond to similar elements throughout the several views and, more specifically, referring to FIGS. 1 and 2, at least some aspects of the present invention will be described in the context of an exemplary table assembly 10, including a base member 12, a table top or top member 14, and a leg or column assembly 16 that extends from base member 12 to an undersurface 18 of top member 14. Base member 12 is a flat planar rigid member which, in the illustrated embodiment, has a rectilinear shape. Member 12 has a flat undersurface 20 that contacts an upwardly facing floor surface 22 and a flat top surface 24.

Table top 14 is a flat, planar, rigid and, in the illustrated embodiment, rectilinear member, having a top surface 26 and bottom surface 18.

Referring to FIGS. 1 through 9 and also to FIGS. 12 through 18, exemplary leg assembly 16 includes first and second columns or elongated extension members 28 and 30, respectively, a counterbalance assembly 34 (see specifically FIG. 5), a locking assembly 36 (see specifically FIGS. 16 through 18) and roller assemblies 188, 194, 200 and 206 and related raceways 180, 182, 184 and 186 (see specifically FIGS. 12 through 15A).

Figure 14:
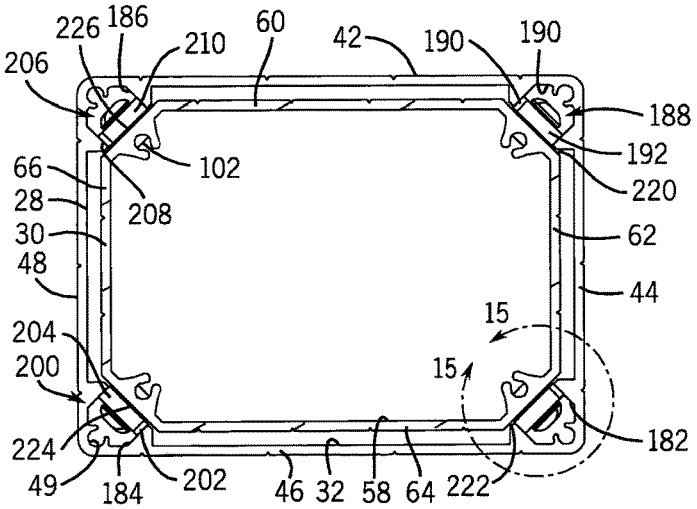
FIG. 14 is an end view of the leg assembly of FIG. 12 taken along the line 14-14 in FIG. 12.

Referring to FIGS. 1 through 3, 6 through 9 and 13 and 14, first column 28 is an elongated rigid member having a top end 38 and a bottom end 40 and that forms an internal first column passageway 32. To this end, column 28 includes first, second, third and fourth wall members 42, 44, 46 and 48, respectively. Each of the wall members 42, 44, 46 and 48 is a substantially flat rigid member. Wall members 42 and 46 are parallel and separated by the space that forms passageway 32. Similarly, wall members 44 and 48 are parallel and separated by the space that forms passageway 32. Wall members 44 and 48 are perpendicular to wall member 42 and traverse the distance between wall members 42 and 46 so that the cross section of column 28 is rectilinear as best illustrated in FIG. 14.

Figure 6:
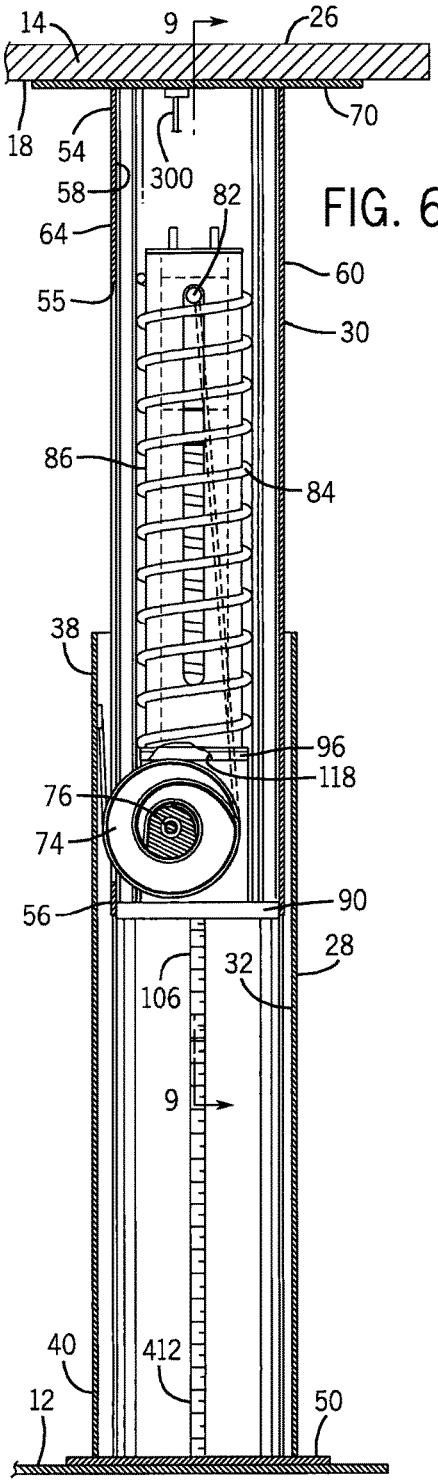
FIG. 6 is a partial cross sectional view of the assembly of FIG. 1.

Referring again to FIGS. 1 through 3 and to FIG. 6, in the illustrated embodiment, a plate 50 is rigidly mounted (e.g., may be welded) to bottom end 40 of column 28. To this end, referring to FIG. 14, four screw receiving holes, one identified by numeral 49, are formed by the internal surface of column 28, one hole in each of the four corners of the column. Although not illustrated, screws can be provided that pass through plate 50 and are received in the fastening holes 49. Other mechanical fasteners as well as welding are contemplated for mounting column 28 to plate 50. Plate 50 can be attached via bolts or the like to base member 12, thereby supporting column 28 in a substantially vertical orientation parallel to a vertical extension axis 52.

Referring once again to FIGS. 1, 2, 6 through 9, and 13 and 14, second column 30 is a rigid elongated member having a top end 54 and an oppositely directed bottom end 56 that forms a second column cavity or internal passageway 58. To this end, column 30 includes first, second, third and fourth substantially flat and elongated wall members 60, 62, 64 and 66, respectively. First and second wall members 60 and 64 are parallel and separated by the space that defines passageway 58. Similarly, wall members 62 and 66 are flat elongated members that are parallel and are separated by the space that defines passageway 58. Each of wall members 62 and 66 is generally perpendicular to wall member 60 and traverses the distance between wall members 60 and 64 such that column 30 has a rectilinear cross section as best illustrated in FIG. 14.

Column 30 is dimensioned such that column 30 is telescopically receivable within passageway 32 formed by the internal surface of column 28. Roller assemblies 188, 194, 200 and 206 and associated raceways 180, 182, 184 and 186 illustrated in FIGS. 12 through 15A minimize friction between columns 28 and 30, thereby facilitating easy sliding motion of second column 28 with respect to first column 30 along extension axis 52 as indicated by arrows 33 in FIGS. 1 and 2. Roller assemblies 188, 194, 200 and 206 and associated raceways 180, 182, 184 and 186 will be described in greater detail below.

Figure 8:
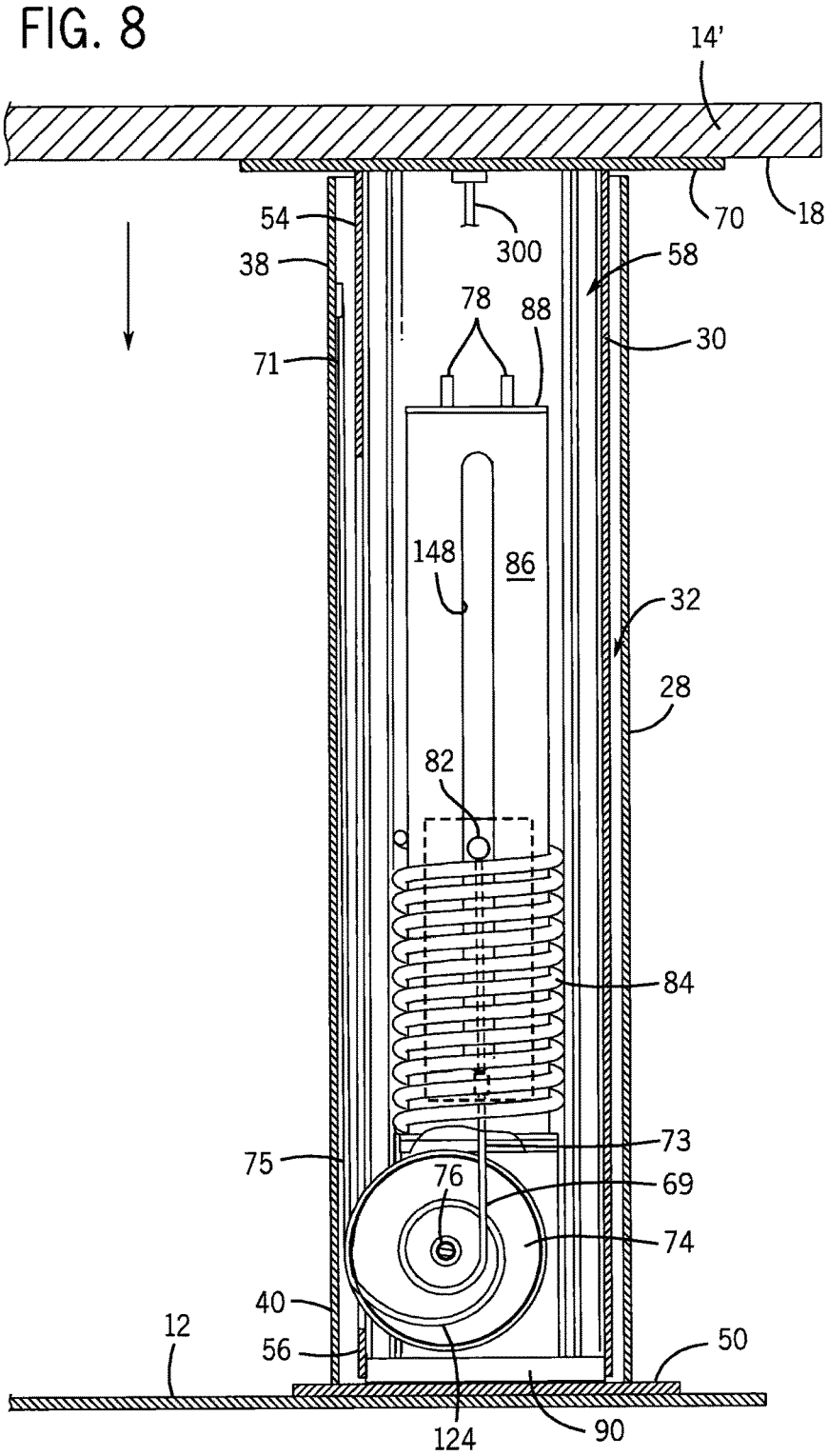
FIG. 8 is a view similar to FIG. 6, albeit illustrating the table assembly with the table top member in a lower position.

Referring now to FIGS. 6 and 8, a rectilinear plate 70 similar to the plate 50 illustrated in FIG. 1, is rigidly connected to the top end 54 of column 30. In the illustrated embodiment, the internal surface of column 30 forms four screw holes (one identified by numeral 102) for mounting plate 70 to the end of column 30. Other mechanical fastening means as well as welding are contemplated for mounting plate 70 to end 54. Although not illustrated, screws or other mechanical fastening mechanisms are used to mount the undersurface 18 of table top 14 to a top surface of plate 70. Thus, as column 30 moves up and down with respect to column 28, top member 14 likewise moves up and down. In at least some cases columns 28 and 30 may be formed of extruded aluminum or other suitably rigid and strong material.

Figure 7:
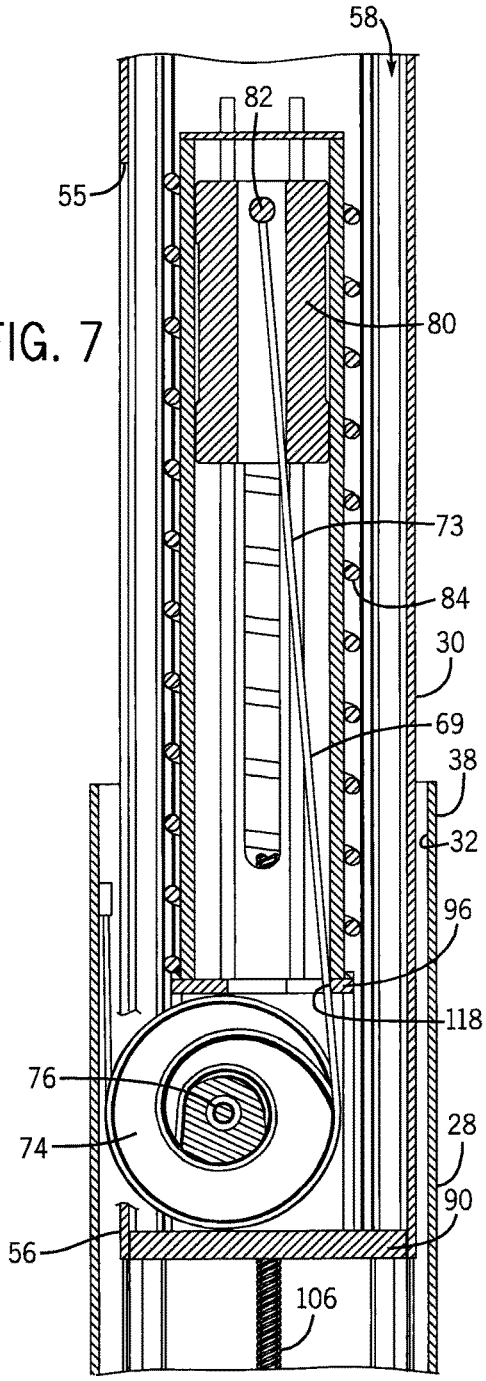
FIG. 7 is a cross sectional view of the assembly of FIG. 1.

Referring to FIGS. 6 and 7, wall 64 of column 30 forms an elongated straight opening 55 (see also 55 shown in phantom in FIG. 9) that extends along most of the length of wall 64 but that stops short of either of the ends 54 or 56. Opening 55 has a width dimension (not labeled) that is suitable for passing an end of a strand or cable 69 (see FIG. 3) to be described below.

Figure 3:
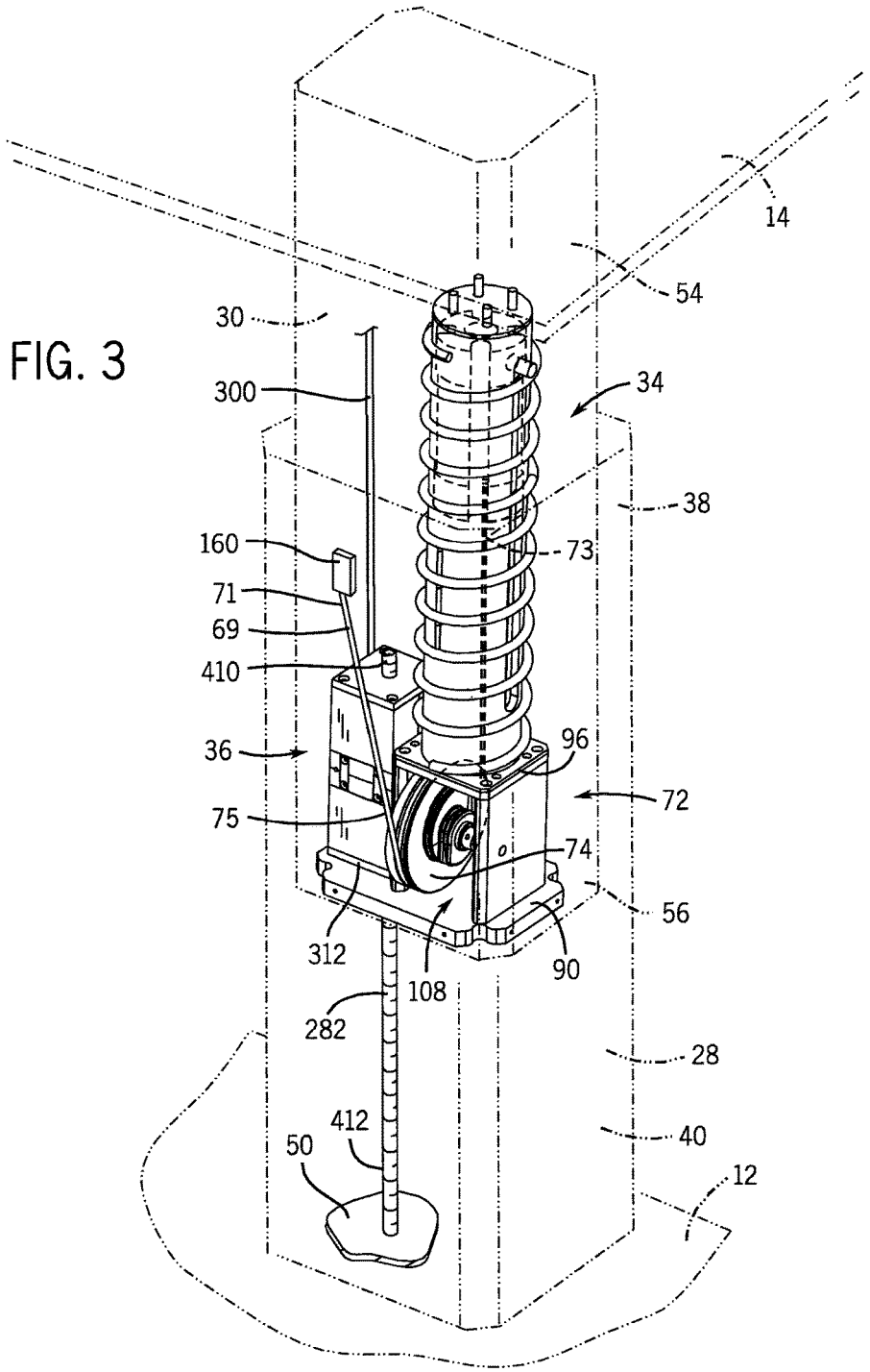
FIG. 3 is a perspective view of a counter balancing assembly and a locking assembly according to at least some aspects of the present invention.
Figure 4:
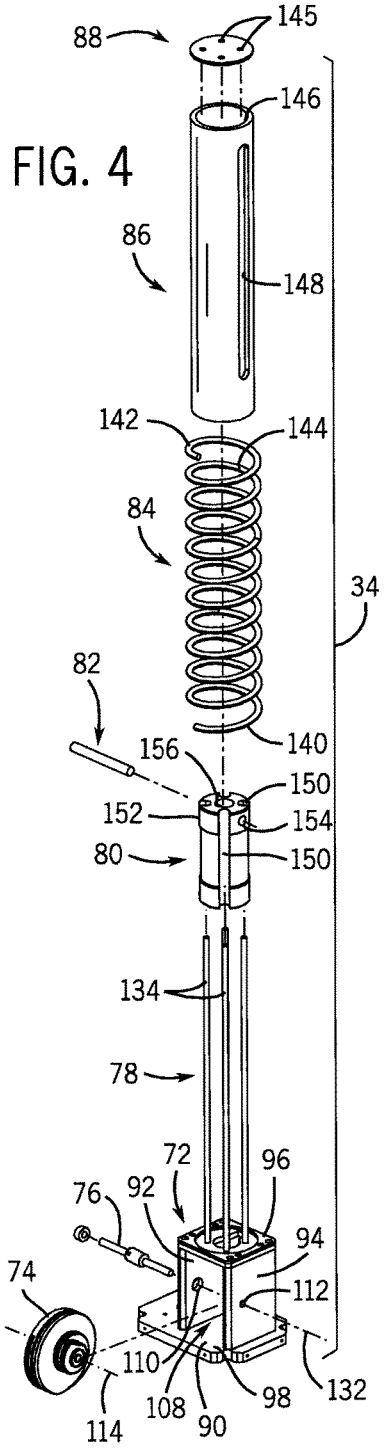
FIG. 4 is an exploded view of the counter balancing assembly of FIG. 3.
Figure 5:
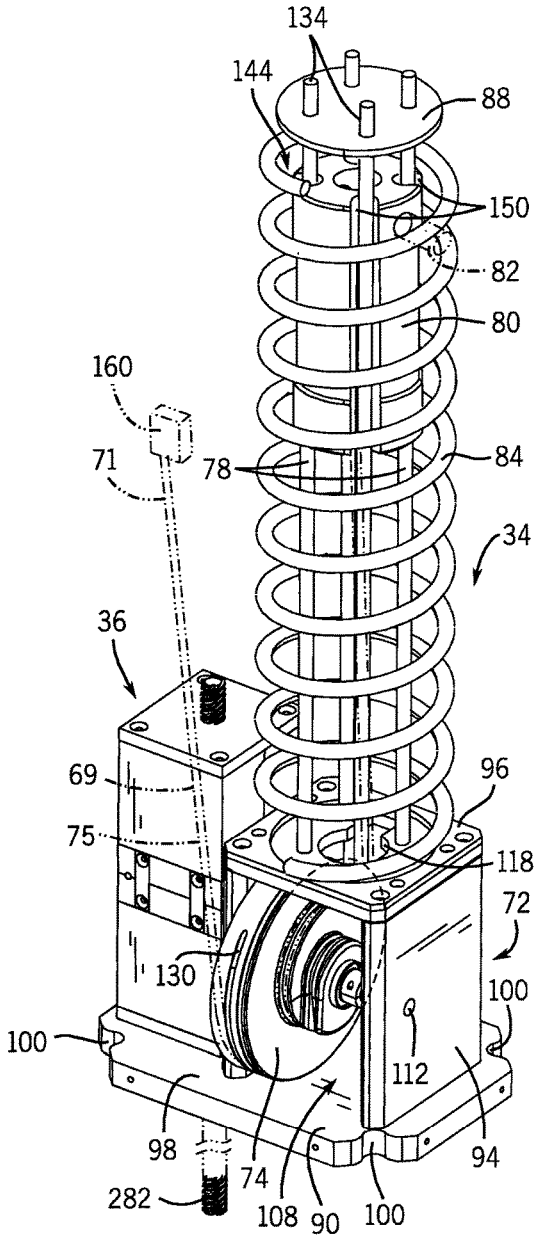
FIG. 5 is an enlarged view of the counter balancing assembly and the locking assembly of FIG. 3.
Figure 9:
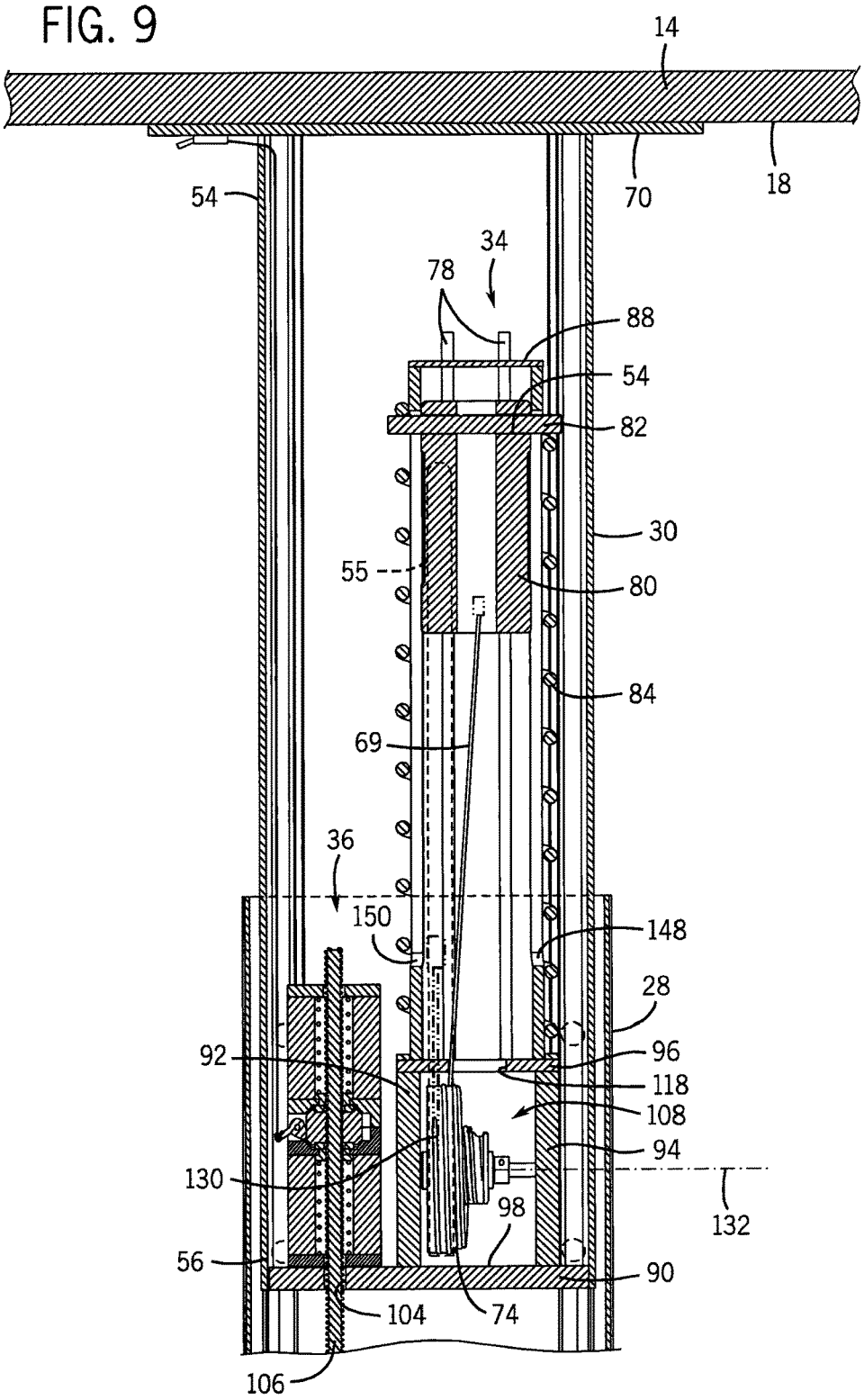
FIG. 9 is a cross sectional view taken along line 9-9 of FIG. 6.
Figure 17:
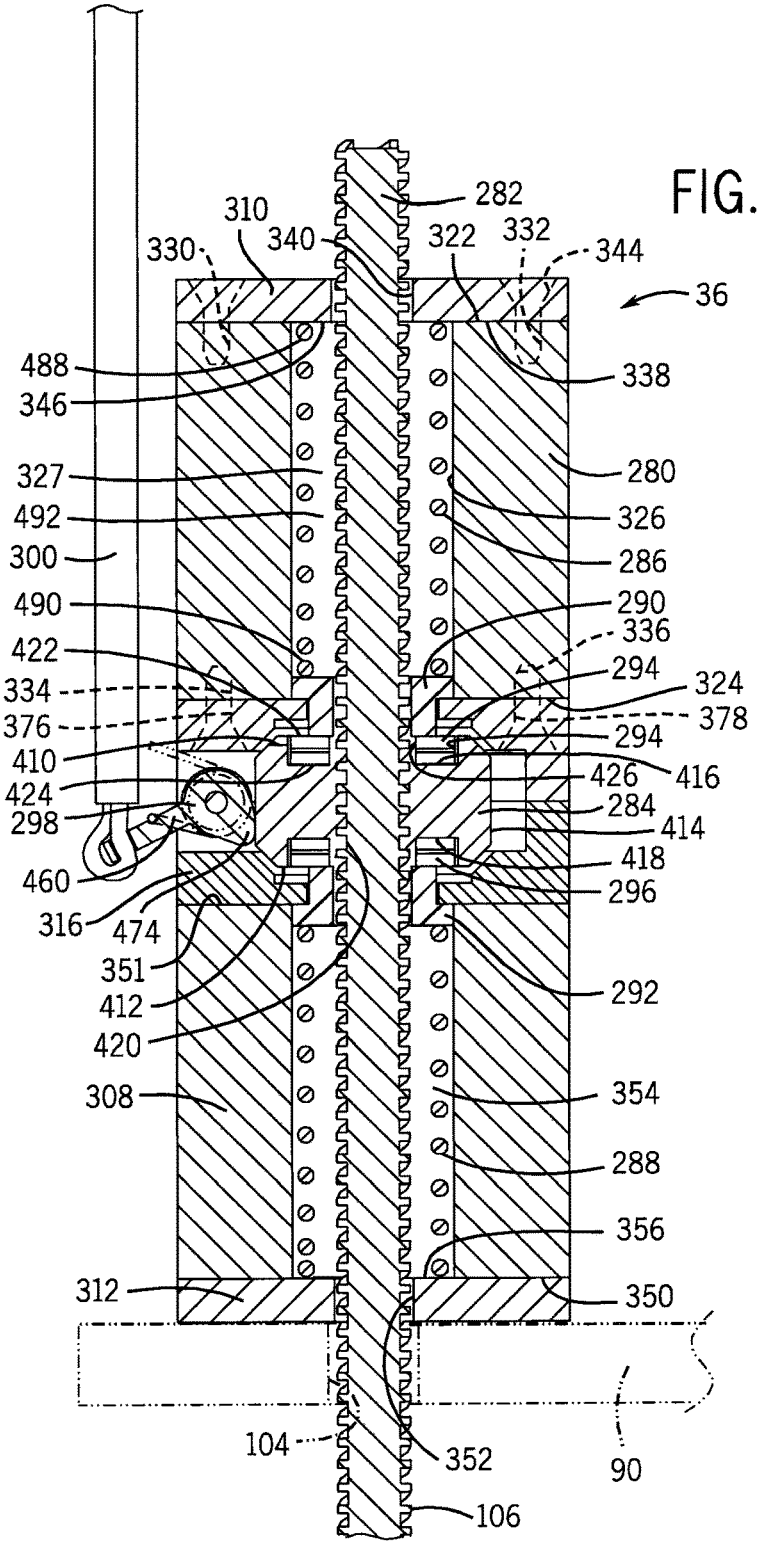
FIG. 17 is a cross sectional view taken along the line 17-17 of FIG. 16.

Referring now to FIGS. 3 through 11, exemplary counterbalance assembly 34 is, in general, mounted within passageway 58 formed by second column 30. Assembly 34 includes a housing structure 72, a snail cam pulley 74, a pulley shaft 76, four guide rods collectively identified by numeral 78, a follower or plunger 80, a plunger dowel 82, a biaser in the form of a helical spring 84, a spring guide 86, an end disk 88 and a cable or strand 69. Herein, pulley 74 and strand 69 together may be referred to as an "equalizer assembly". Housing structure 72 includes a base member 90, first and second lateral members 92 and 94 and a top member 96. Base member 90 is, in general, a rigid rectilinear member that is mounted (e.g., via welding, screws or the like) within passageway 58 proximate bottom end 56 of second column 30 and forms a generally flat and horizontal top surface 98. As best seen in FIG. 5, the corners of member 90 form recesses or channels, three of which are shown and identified collectively by numeral 100. Channels 100 are formed to accommodate the screw holes (e.g., 102, see FIG. 14) provided on the internal surface of column 30. Referring to FIGS. 9 and 17, base member 90 forms a single opening 104 to accommodate a threaded shaft 106 described below in the context of locking assembly 36.

Lateral members 92 and 94 are flat rigid members that are welded or otherwise connected to top surface 98 of base member 90 and extend perpendicular thereto. Members 92 and 94 are separated by a space 108 and each forms an opening 110 and 112, respectively, where openings 110 and 112 are aligned to accommodate pulley shaft 76. Pulley shaft 76 is mounted between lateral members 92 and 94 via reception of opposite ends in openings 110 and 112 and, in at least some cases, does not rotate after being mounted. Space 108 is aligned with opening or slot 55 formed by second column 30. In this regard, see slot 55 shown in phantom in FIG. 9 and the general alignment with space 108.

Top member 96 is a rigid and generally square member that is mounted to edges of lateral members 92 and 94 opposite base member 90 via welding, screws, or some other type of mechanical fastener. Top member 96 forms a central opening 118 as best seen in FIGS. 5 and 7.

Referring to FIGS. 4 through 11, snail cam pulley 74 is a rigid and generally disk-shaped member that forms a central opening 120 about an axis 114. A lateral surface 122 surrounds axis 114 and forms a cable channel 124 that wraps around axis 114 and includes a first channel end 128, best seen in FIGS. 10 and 11, and a second channel end 130, best seen in FIGS. 5 and 9. Radii are defined between axis 114 and different portions of channel 124. For example, first, second and third different radii are labeled R1, R2 and R3 in FIG. 11. The radii (e.g., R1 and R2) increase along at least a portion of channel 124 in a direction from the first channel end 128 toward the second channel end 130. Thus, radius R1 is closer to end 128 then is radius R2 and has a smaller dimension than radius R2 and radius R2 is closer to end 128 and has a smaller dimension than radius R3. At the second channel end 130, the channel 124 has a constant relatively large radius throughout several (e.g., 2) rotations about the lateral pulley surface as best seen in FIG. 9. A low friction bearing 121 may be provided within opening 120 formed by pulley to facilitate relatively low frication movement of pulley along and around shaft 76.

Figure 11:
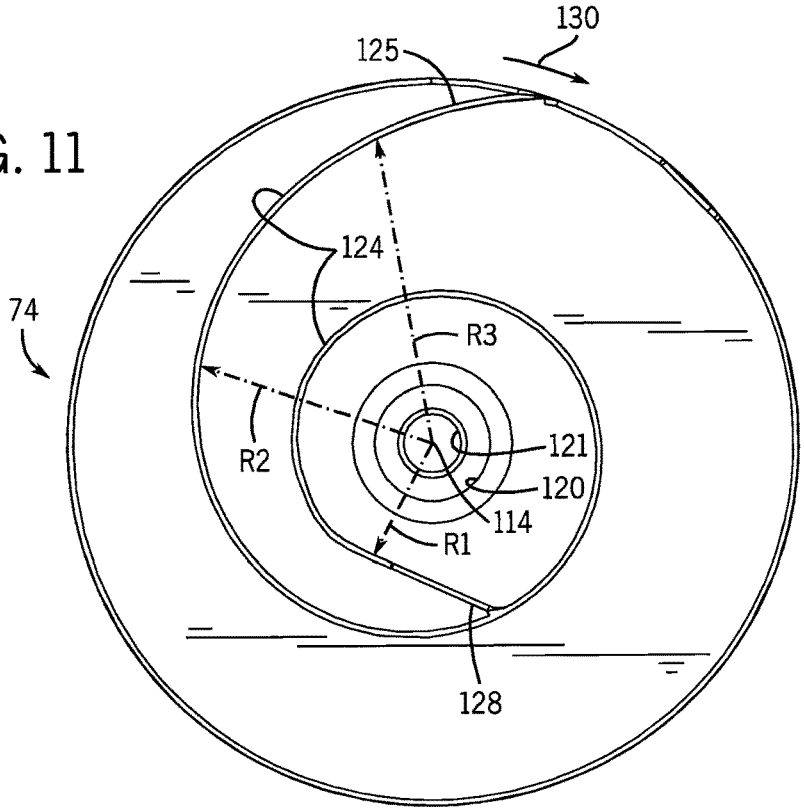
FIG. 11 is a side elevational view of the snail cam pulley of FIG. 10.

Referring to FIGS. 8 and 11, in at least some cases there is a specific relationship between a diameter (not labeled) of strand 69 and the minimum diameter R1 of pulley 74. To this end, strand 69 may be formed of woven metal or synthetic material (e.g., nylon). Where strand 69 is a woven material, as the strand is rotated about a pulley, the separate woven elements that form the strand rub against each other causing friction. This friction is problematic for several reasons. First, this fraction causes a drag on movement of column 30 with respect to column 28. Second this inter-strand friction wears on the strand and reduces the useful life of strand 69. To minimize the inter-strand friction, the radius R1 is restricted so that it does not get too small. In at least some cases radius R1 is at least 5 times the diameter of the strand. In other cases radius R1 is approximately 6-8 time the diameter of the strand. In at least some cases strand 69 is formed of ⅛ inch diameter braided steel.

Figure 10:
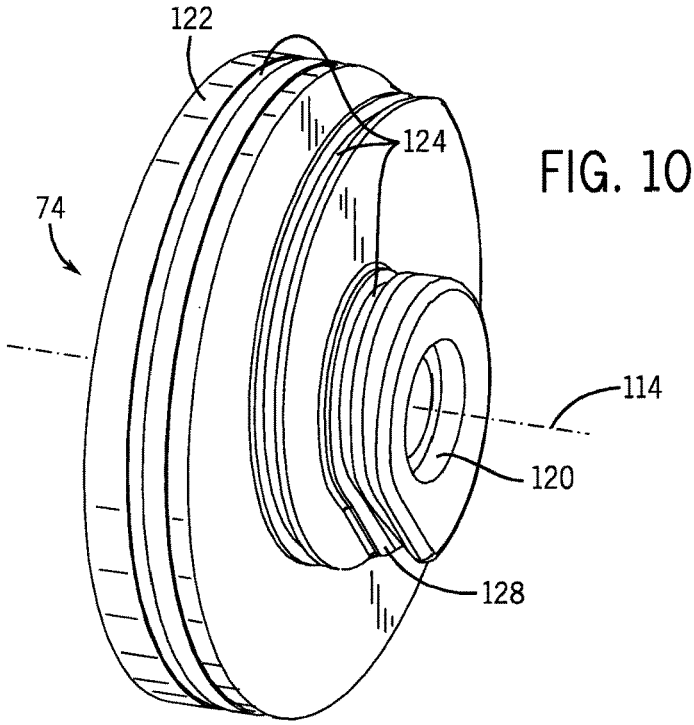
FIG. 10 is a perspective view of the snail cam pulley of FIG. 3.

Referring still to FIGS. 4 and 5, as well as to FIGS. 10 and 11, pulley 74 is mounted to shaft 76 so that, while supported thereby for rotation about a pulley axis 132 that is aligned with openings 110 and 112, pulley 74 is generally free to move along shaft 76 and along axis 132.

Referring now to FIGS. 4 through 9, rods 78 include four parallel rigid and elongated extension rods that are equispaced about opening 118 and extend upward from top member 96 to distal ends, two of which are collectively identified by numeral 134 in FIGS. 4 and 5. End disk 88 is a rigid flat circular disk that forms four holes 145 that are spaced to receive the distal ends 134 of rods 78.

Coil compression spring 84 is a generally cylindrical spring having first and second opposite ends 140 and 142, respectively, and forms a cylindrical spring passageway 144.

Spring guide 86 is a cylindrical rigid member that forms a cylindrical internal channel 146. Guide 86 also forms first and second slots 148 and 150 (see FIG. 9) in oppositely facing sides thereof. Slots 148 and 150 extend along most of the length of guide 86 but stop short of the opposite ends thereof. Guide 86 has a radial dimension (not illustrated) such that guide 86 is receivable within spring passageway 144 without contacting the coils of spring 84. Guide passageway 146 has a radial dimension such that guide 86 can be slid over rods 78.

Plunger 80 is a rigid cylindrical member having a length dimension substantially less than the length dimension of guide member 86 and, in general, having a radial dimension (not labeled) that is slightly less than the radial dimension of guide passageway 146 such that plunger 80 is receivable within passageway 146 for sliding movement therealong. In addition, an external surface of plunger 80 forms four guide channels, two of which are collectively identified by numeral 150 in FIGS. 4 and 5, that are equispaced about the circumference of plunger 80 and extend along the length dimension thereof. Each channel 150 is dimensioned to slidably receive one of rods 134. Near a top end 152, plunger 80 forms a dowel opening 154 for receiving dowel 82 in a wedged fashion, so that, once dowel 82 is placed within opening 154, the dowel 82 is rigidly retained therein. In the illustrated embodiment, plunger 80 also forms a central plunger passageway 156 (see also FIG. 9).

When assembled, pulley 74 is mounted on shaft 76 for rotation about axis 132 within space 108 and for sliding motion along axis 132 on shaft 76. Plunger 80 is received between rods 134 with a separate one of the rods 134 received in each of channels 150. Guide 86 is slid over rods 134 and plunger 80 and spring 142 is slid over guide 86 so that a first end 140 of spring 84 rests on a top surface of member 96.

As best illustrated in FIGS. 5 and 9, with plunger 80 proximate the top end of guide 86 and opening 154 aligned with slots 148 and 150, dowel 82 is placed and secured within opening 154 so that opposite ends thereof extend through slots 148 and 150 and generally contact second end 142 of spring 184. End disk 88 is rigidly connected (e.g., welding, nuts, etc.) to the distal ends 134 of rods 78.

Strand 69 is a flexible elongated member having first and second ends 71 and 73, respectively, and a central portion 75 therebetween. While strand 69 may be formed in many ways, in some embodiments, strand 69 will be formed of a flexible braided metal cable or the like.

Referring to FIGS. 3 and 5 through 9, first end 71 of strand 69 is linked or rigidly secured near the top end 38 of first column 28. In FIGS. 3 and 5, end 71 is secured to the internal surface of column 28 that forms passageway 32 via a small mechanical bracket 160. Similarly, referring to FIGS. 7 and 9, second end 73 is rigidly secured or mounted to the second end of spring 84 via dowel 82 that is connected to plunger 80. Other mechanical fasteners for linking or mounting strand ends 71 and 73 to column 28 and to the second end of spring 84 are contemplated.

The central section 75 of strand 69 wraps around the lateral surface of pulley 74 a plurality (e.g., 3) of times. In this regard, beginning at first end 71, strand 69 extends downward toward pulley 74 and through slot 55 formed by column 30, the central portion entering the relatively large and constant radii portion of channel 124 (e.g., entering a channel portion proximate second end 130). The portion of strand 69 extending from pulley 74 to second end 71 always extends from a constant radii portion of the channel in at least some inventive embodiments. The central portion wraps around pulley 74 within channel 124 and then extends upward from a relatively small radii portion thereof through opening 118 in top member 96 and through passageway 146 formed by guide 86 (and hence through passageway 144 formed by spring 84) up to the second end 73 that is secured via dowel 82 162 to plunger 80. After assembly, in at least some embodiments it is contemplated that spring 84 will be compressed to some extent at all times and hence will apply at least some upward force to second or top column 30. In this regard, referring to FIG. 6, compressed spring 69 applies an upward force to dowel 82 and hence to plunger 80 which in turn "pulls" up on pulley 74 therebelow tending to force column 30 upward. The amount of force applied via spring 84 is a function of how compressed or loaded the spring is initially when upper column 30 is in a raised position as illustrated in FIGS. 6 and 7.

Figure 2:
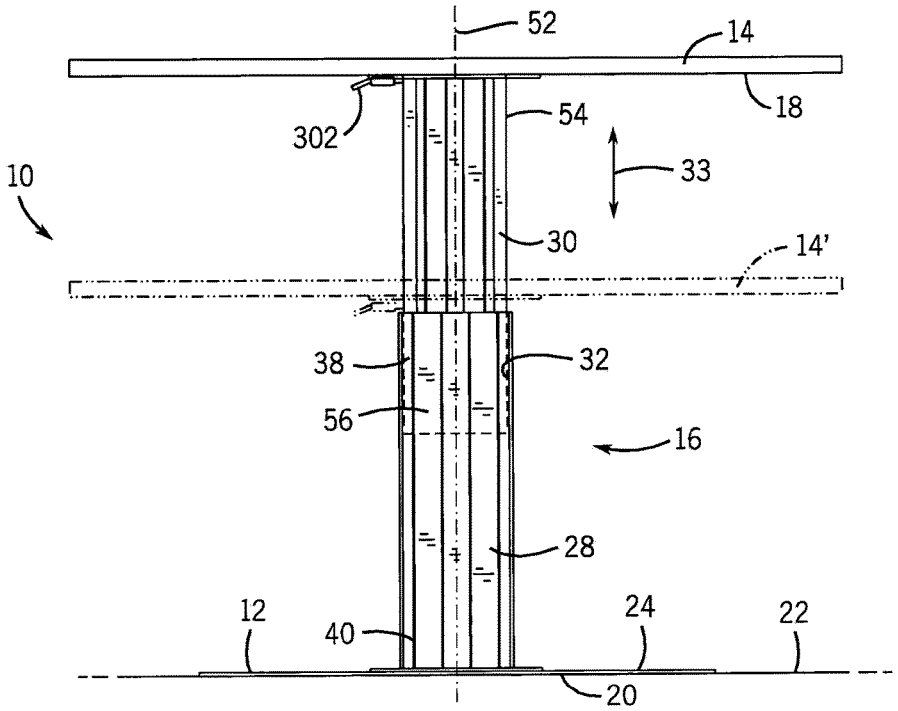
FIG. 2 is a side elevational view of the table of FIG. 1 showing the table in an extended or high position and in phantom a retracted or lower position.

In operation, referring to FIGS. 2, 3, 5 though 7, and 9, with table top 14 and column 30 lifted into a raised position, spring 84 expands and pushes dowel 82 and plunger 80 into a high position where dowel 82 is at the top ends of slots 148 and 150 as illustrated. Here, the portion of strand 69 that extends from pulley 74 to plunger 80 extends from a relatively large radii portion (e.g., see R3 in FIG. 11).

To lower table top 14, a user simply pushes down on top surface 26. When the user pushes down on top surface 26, as top 14 and column 30 move downward, spring 84 is further compressed and resists the downward movement thereby causing the top and column 30 to feel lighter than the actual weight of these components. As top 14 and column 30 are pushed downward, pulley 74 rotates clockwise as viewed in FIGS. 6, 7 and 8 so that the radius of the portion of channel 124 from which strand 69 extends upward to plunger 80 continually decreases. As pulley 74 rotates, in at least some embodiments, pulley 74 also slides along axel 76 so that the wrap and unwrap portions of channel 124 are stationary relative to spring 84 and other load bearing members and components of assembly 34. In other embodiments, pulley 74 is mounted to axel 76 for rotation about axis 110 but does not slide along axel 76. Eventually, when top member 14 is moved to a retracted or lower position as illustrated in phantom and labeled 14' in FIG. 2 and as shown in FIG. 8, the radius of the portion of channel 124 from which strand 69 extends up to second end 73 is relatively small (see R1 in FIG. 11).

As well known in the mechanical arts, helical springs like spring 84 have linear force characteristics such that the force generated by the spring increases more rapidly as the spring is compressed (i.e., the force-deflection curve is linear with the force increasing with greater deflection). Snail cam pulley 74 is provided to linearize the upward force on column 30. In this regard, the changing radius from which strand 69 extends toward second end 73 has an equalizing effect on the force applied to pulley 74 and hence to column 30. Thus, for instance, while the first and fourth inches of spring compression may result in two and eight additional units of force at the second end of spring 84, respectively, pulley 74 may convert the force of the fourth unit of compression to two units so that a single magnitude force is applied to top 14 and column 30 irrespective of the height of top 14 and column 30.

To understand how cam pulley 74 operates to maintain a constant magnitude upward force, consider a wheel mounted for rotation about a shaft where the wheel has a radius of two feet. Here, if a first force having a first magnitude is applied normal to the lateral surface of the wheel at the edge of the two foot radius (e.g., 24 inches from a rotation axis) the effect will be to turn the wheel at a first velocity. However, if a same magnitude first force is applied normal to the lateral surface of the wheel only two inches from the rotation axis, the effect will be to turn the wheel at a second velocity that is much slower than the first. In this case, the effect of the first velocity force depends on where the force is applied to the wheel. In order to turn the wheel at the first velocity by applying a force two inches from the rotation axis, a force having a second magnitude much greater than the first magnitude has to be applied. Thus, the different radii at which the forces are applied affects the end result.

Similarly, referring again to FIG. 8, when spring 84 is compressed and hence generates a large force, the applied force is reduced where strand 69 is received within channel 124 at a reduced radii and, referring to FIG. 6, when spring 84 is expanded and hence generates a relatively smaller force, the applied force is generally maintained or reduced to a lesser degree where strand 69 is received within channel 124 at a larger radii portion. Thus, by forming cam pulley 74 appropriately, the applied force magnitude is made constant.

Referring now to Table 1 included herewith, radii of an exemplary snail cam pulley suitable for use in one configuration of the type described above are listed in a third column along with corresponding cam angles in the second column. Thus, for instance, referring also to FIG. 11, at a cam angle of −19.03 degrees that is proximate channel location 125 where the radius transitions to a nearly constant value, the channel radius is 1.9041 inches. As another instance, at a cam angle of 504.86 degrees (e.g., after more than 1.4 one cam pulley rotations near radius R1 in FIG. 11), the channel radius is 0.6296 inches. Between the angles −19.03 and 504.86, the channel radius decreases from 1.9041 to 0.6296 inches.

Referring still to Table 1, and also to FIG. 6, the first, fourth and fifth table columns list work surface or table top 14 heights or positions, spring 84 force and rope force (e.g., the force at strand end 71) values corresponding to each angle and radius pair in the second and third columns for one exemplary table assembly 10. In this example, the maximum top height is 44 inches and the height adjustment range is 17.5 inches so that the lowest height is 26.5 inches. In addition, the unloaded length of spring 84 used to generate the data in the table was 17.53 inches where the spring force when top 14 is at the raised 44 inch level was 109.7 lbs. It can be seen that at the maximum raised top position (e.g., 44 inches) where cam pulley 74 is at angle −19.03 and where strand 69 enters channel 124 at a 1.9041 inch radius, the rope force at end 71 of strand 69 is 100 lbs. As table top 14 is lowered, the spring force increases. However, as the spring force increases, the cam angle (second column) is changed and hence the radius at which strand 79 enters channel 124 is reduced thereby reducing the relative effect of the increasing spring force on second strand end 71. Thus, for instance, when the top 14 is at 34.1 inches high, while the linear spring force is 246.6 lbs., the cam radius is 0.8035 inches and the resulting rope force at strand end 71 remains 100 lbs.

Other constant rope force magnitudes are contemplated and can be provided by simply preloading spring 84 to greater and lesser degrees or by providing a spring having different force characteristics.

TABLE 1

| Worksurface | CAM PROFILE | | | |
|---|---|---|---|---|
| Position | Angle | Radius | Spring Force | Rope Force |
| 44.0 | −19.03 | 1.9041 | 109.7 | 100.00 |
| 43.4 | 0.36 | 1.6936 | 121.5 | 100.00 |
| 42.8 | 19.69 | 1.5379 | 132.4 | 100.00 |
| 42.3 | 38.30 | 1.4176 | 142.7 | 100.00 |
| 41.7 | 56.57 | 1.3215 | 152.3 | 100.00 |
| 41.1 | 74.58 | 1.2424 | 161.4 | 100.00 |
| 40.5 | 92.41 | 1.1761 | 170.1 | 100.00 |
| 39.9 | 110.10 | 1.1193 | 178.3 | 100.00 |
| 39.3 | 127.67 | 1.0700 | 186.3 | 100.00 |
| 38.8 | 145.15 | 1.0268 | 193.9 | 100.00 |
| 38.2 | 162.55 | 0.9884 | 201.2 | 100.00 |
| 37.6 | 179.90 | 0.9540 | 208.3 | 100.00 |
| 37.0 | 197.20 | 0.9230 | 215.1 | 100.00 |
| 36.4 | 214.45 | 0.8948 | 221.8 | 100.00 |
| 35.8 | 231.67 | 0.8691 | 228.2 | 100.00 |
| 35.3 | 248.86 | 0.8455 | 234.5 | 100.00 |
| 34.7 | 266.02 | 0.8237 | 240.6 | 100.00 |
| 34.1 | 283.17 | 0.8035 | 246.6 | 100.00 |
| 33.5 | 300.29 | 0.7847 | 252.4 | 100.00 |
| 32.9 | 317.39 | 0.7672 | 258.1 | 100.00 |
| 32.3 | 334.49 | 0.7509 | 263.7 | 100.00 |

TABLE 1-continued

| Worksurface | CAM PROFILE | | | |
|---|---|---|---|---|
| Position | Angle | Radius | Spring Force | Rope Force |
| 31.8 | 351.56 | 0.7355 | 269.1 | 100.00 |
| 31.2 | 368.63 | 0.7320 | 274.5 | 100.00 |
| 30.6 | 385.69 | 0.7074 | 279.7 | 100.00 |
| 30.0 | 402.73 | 0.6945 | 284.9 | 100.00 |
| 29.4 | 419.77 | 0.6823 | 290.0 | 100.00 |
| 28.8 | 436.80 | 0.3707 | 294.9 | 100.00 |
| 28.3 | 453.83 | 0.6597 | 299.8 | 100.00 |
| 27.7 | 470.84 | 0.6492 | 304.6 | 100.00 |
| 27.1 | 487.86 | 0.6392 | 309.4 | 100.00 |
| 26.5 | 504.86 | 0.6296 | 314.1 | 100.00 |

Referring again to FIGS. 6 and 7, it should be appreciated that the compressive nature of spring 84 is particularly important to configuring a table height assist assembly. In this regard, in most cases a table top 14 and associated components that move therewith will weigh 25 or more pounds and therefore a relatively large counterbalancing force is required to configure an assembly where the top is easily moveable (e.g., with ±5 pounds of applied force). To provide the required counterbalancing force, a compression spring 84 is particularly advantageous. Here, not only can a compression spring provide required force but it can also provide the force in a small package. In this regard, referring to FIG. 6, spring 84 is partially compressed (e.g., made smaller) to preload which is different than an extension spring that has to be extended to preload. In addition, while an extension spring increases in size during loading, a compression spring decreases so required space to house the spring and associated components is reduced.

In addition, in the case of compression spring, additional spring guidance components can be provided to ensure that the spring does not buckle under large applied force. No such guidance sub-assemblies can be provided in the case of an extension spring to avoid deformation from excessive extension.

Referring now to FIGS. 1 and 2 and also to FIGS. 12 through 15A, to aid in movement of column 30 with respect to column 28, first through fourth roller assemblies 188, 194, 200 and 206 and first through fourth associated raceways 180, 182, 184 and 186 are provided where each of the roller assemblies includes two rollers. For example, first roller assembly 188 includes a first roller 190 and a second roller 192 (see FIG. 14). Similarly, second roller assembly 194 includes a third roller 196 and a fourth roller 198, third roller assembly 200 includes a fifth roller 202 and a sixth roller 204 and fourth roller assembly 206 includes a seventh roller 208 and an eighth roller 210. The rollers are similarly constructed and operate in a similar fashion and therefore, in the interest of simplifying this explanation, only roller 198 will be described here in detail. Referring specifically to FIG. 15A, roller 198 includes an internal or inner annular race 212, an external or outer annular race 214 and ball bearings (not illustrated) between the inner and outer races 212 and 214, respectively. Inner race 212 forms a central opening 216 for mounting to an axel 218.

Referring still to FIGS. 12 through 15, column 30 forms first through fourth mount surfaces 220, 222, 224 and 226, respectively. Mount surface 220 is formed between first and second wall members 60 and 62, is a flat external surface and forms an approximately 45° angle with each of members 60 and 62. Similarly, mount surface 222 is formed between second and third wall members 62 and 64, is a flat surface and forms an approximately 45° angle with respect to each of member 62 and 64, third mount surface 224 is formed between members 64 and 66, is a flat external surface and forms an approximately 45° angle with respect to each of members 64 and 66 and mount surface 226 is formed between members 66 and 60, is a flat external surface and forms a 45° angle with respect to each of fourth and first wall members 66 and 60, respectively. Roller posts (e.g., post 218 in FIG. 15A) are mounted to the mount surfaces 220, 222, 224 and 226, extend perpendicular thereto and also extend perpendicular to the extension axis 52. The first, second, third, fourth, fifth, sixth, seventh and eighth rollers are mounted to posts so that the external raceways 214 rotate along first through eighth roller axes, respectively. While it is the external raceways (e.g., 214) that rotate, hereinafter, unless indicated otherwise, this description will refer to the rollers as rotating in order to simplify this explanation. Third and fourth roller axes 230 and 232 corresponding to the third and fourth rollers 196 and 198, respectively, are illustrated in FIG. 15. Axes 230 and 232 are purposefully misaligned in at least some embodiments as illustrated. This misalignment will be described in more detail below.

Referring still to FIGS. 12 through 15, raceway 180 is formed between first and second wall members 42 and 44 and includes oppositely facing first and second raceway surfaces 236 and 234. First raceway surface 236 is adjacent first wall member 42 and forms an approximately 45° angle therewith. Similarly, second raceway surface 334 is adjacent second wall member 44 and forms an approximately 45° angle therewith. Second raceway 182 is formed between wall members 44 and 46 and includes third and fourth oppositely facing raceway surfaces 238 and 240, respectively. Third raceway surface 238 is proximate second wall member 44 and forms a 45° angle therewith while fourth raceway surface 240 is proximate third wall member 46 and forms a 45° angle therewith. Third raceway 184 is formed between third and fourth wall members 46 and 48, respectively, and includes fifth and sixth raceway surfaces 242 and 244, respectively. Fifth raceway surface 242 is proximate third wall member 46 and forms a 45° angle therewith while sixth raceway surface 244 is proximate fourth wall member 48 and forms a 45° angle therewith. Fourth raceway 186 is formed between fourth wall member 48 and first wall member 42 and includes seventh and eighth raceway surfaces 246 and 248 that face each other. Seventh raceway surface 246 is adjacent fourth wall member 48 and forms a 45° angle therewith while eighth raceway surface 248 is adjacent first wall member 42 and forms a 45° angle therewith.

Referring to FIG. 15, in at least some embodiments, steel or other suitably hard material tracks or surface forming structures 193 and 195 may be provided and attached within the raceways (e.g., 182) to form facing surfaces 238 and 240 to minimize wear.

Referring yet again to FIGS. 12 through 15A, as illustrated, the raceways are formed such that first, second, third and fourth raceways 180, 182, 184 and 186, respectively, are adjacent mount surfaces 220, 222, 224 and 226 when second column 30 is received within the passageway 32 formed by first column 28 and so that the first through fourth roller assemblies 188, 194, 200 and 206 are received within raceways 180, 182, 184 and 186. With the roller assemblies in raceways 180, 182, 184 and 186, the rollers that comprise the assemblies cooperate and interact with the facing surfaces of the raceways to facilitate sliding or rolling motion of second column 30 with respect to first column 28.

To reduce the amount by which second column 30 moves along trajectories other than the extending axis 52 (see again FIG. 2), it has been recognized that the rollers in each roller assembly 188, 194, 202 and 206 can be axially offset so that one of the rollers interacts with one of the facing raceway surfaces and the other of the rollers interacts with the other of the facing raceway surfaces. For example, referring once again to FIG. 15, the axis 230 around which third roller 196 rotates is relatively closer to third raceway surface 238 than it is to fourth raceway surface 240 while the axis 232 around which fourth roller 198 rotates is relatively closer to fourth raceway surface 240 than it is to third raceway surface 238. Even more specifically, while the diameters of the rollers 196 and 198 are less than the space between third and fourth raceway surfaces 238 and 240 respectively, by offsetting the axis 230 and 232 of rollers 196 and 198 by the difference between the roller diameter and the dimension between facing surfaces 238 and 240, a configuration results where one of the rollers 196 is always or substantially always in contact with one of the surfaces 238 and the other of the rollers 198 in an assembly is always or substantially always in contact with the other of the facing surfaces 240.

In particularly advantageous embodiments, the rollers in each of the roller assemblies 188, 194, 200 and 206 are offset by the same amount and in the same direction. For example, referring to the top plan view of columns 28 and 30 shown in FIG. 14, the upper roller 192 of assembly 188 is offset clockwise with respect to the associated lower roller 190 of the same assembly. Similarly, upper roller 198 in assembly 194 is offset in a clockwise direction with respect to associated lower roller 196, the upper roller 204 in assembly 200 is offset in a clockwise direction with respect to associated lower roller 202 and the upper roller 210 in assembly 206 is offset in a clockwise direction with respect to associated lower roller 208. When so offset, first roller 190 contacts first raceway surface 236, second roller 192 contacts second raceway surface 234, third roller 196 contacts third raceway surface 238, fourth roller 198 contacts fourth raceway surface 240, fifth roller 202 contacts fifth raceway surface 242, sixth roller 204 contacts sixth raceway surface 244, seventh roller 208 contacts seventh raceway surface 246 and eight roller 210 contacts eighth raceway surface 248.

Figure 12:
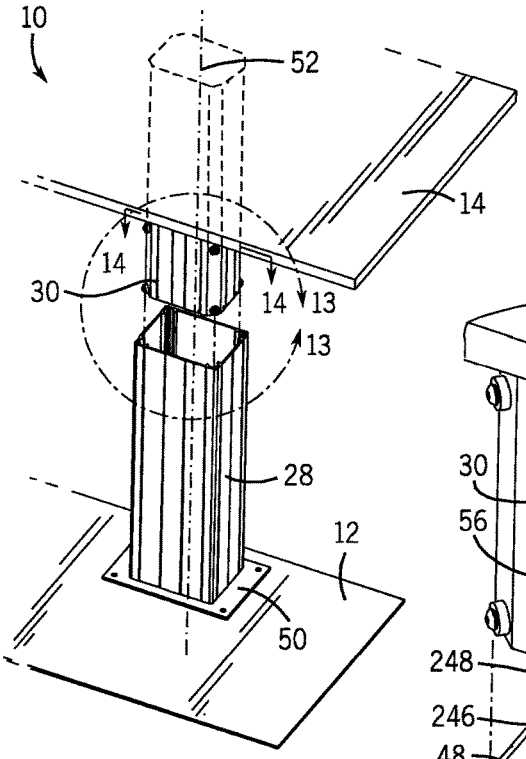
FIG. 12 is a perspective view of the assembly of FIG. 1 where a top portion of the assembly has been removed from the bottom portion.
Figure 13:
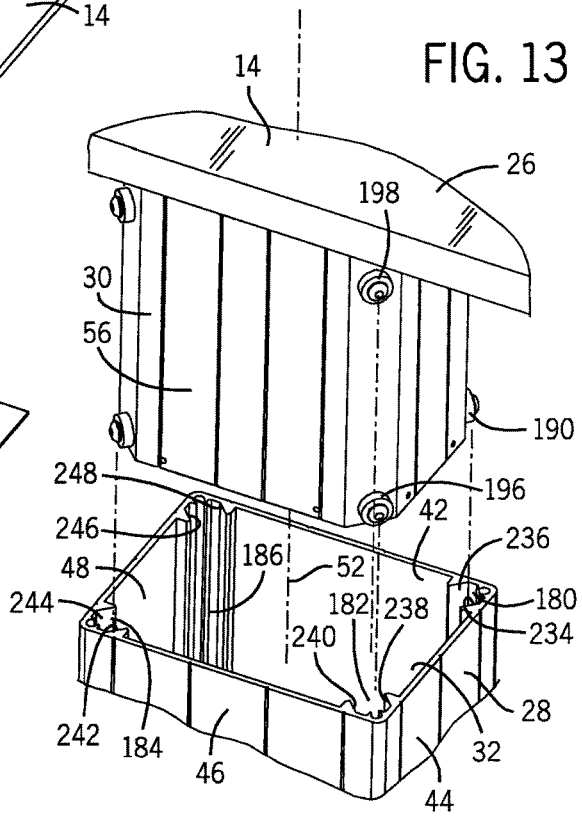
FIG. 13 is a perspective view taken along the line 13-13 of FIG. 12.

Referring still to FIGS. 12 and 14, tests have shown that where rollers are properly positioned and offset as illustrated, the rollers appreciably reduce sloppy non-axial movement of upper column 30 with respect to lower column 28 regardless of how extended column 30 is from column 28 or how table top 14 is loaded. In addition, despite minimal space between at least sections of the internal and external surfaces of column 28 and 30, the axially offset rollers can effectively eliminate contact between the internal and external surfaces despite different table loads, degrees of column extension (i.e., only the rollers themselves contact the internal surface of column 30), and load distributions on table top 14 thereby ensuring an extremely smooth telescoping motion when column 30 moves with respect to column 28.

Referring once again to FIGS. 1, 2, 3, 5 and 9 and also to FIGS. 16 through 20, brake assembly 36 includes a brake housing 280, a threaded shaft or first coupler 282, a nut or second coupler 284, a first biaser or spring 286, a second biaser or spring 288, a first plunger 290, a second plunger 292, a first annular bearing ring 294, a second annular bearing ring 296, a first locking mechanism 298, a sheathed activation cable 300 and an activating lever 302.

Housing 280 includes first and second cube members 306 and 308, respectively, a first bearing member 310, a second bearing member 312, a first stop member 314, a second stop member 316 and four brackets, two of which are illustrated and identified by numeral 318 and 320 (see FIG. 16).

As the label implies, cube member 306 has a cubic external shape and includes first and second oppositely facing surfaces 322 and 324. Member 306 forms a central opening 326 that passes from first surface 322 all the way through to second surface 324. In addition, first surface 322 forms four threaded holes, two of which are illustrated in phantom in FIG. 17 and labeled 330 and 332, a separate hole proximate each of the four corners formed by surface 322, for receiving distal ends of screws. Similarly, second surface 324 forms four threaded holes for receiving the ends of screws, two of the threaded holes shown in phantom in FIG. 17 and labeled 334 and 336. Opening 326 forms a first cube passage way 327.

Second cube member 308 is similar in design and in operation to cube member 306. For this reason and, in the interest of simplifying this explanation, details of cube member 308 will not be described here and the previous description of cube member 306 should be referred to for specifics regarding cube member 308. Here, it should suffice to say that cube member 308 forms a passageway 354 that extends between oppositely facing first and second surfaces 350 and 351, respectively.

Referring once again to FIGS. 16 and 17, bearing member 310 is a rigid flat member that forms a surface 338 that has the same shape and dimensions as first surface 322 formed by cube member 306. Bearing member 310 forms a central circular opening 340 and four holes, two of which are identified collectively by numeral 344 in FIG. 16. Holes 344 are formed so that, when surface 338 of member 310 is placed on first surface 322 of cube member 306, holes 344 align with the threaded holes (e.g., 330, 332, etc.) formed in first surface of cube member 306. With first bearing member 310 aligned on surface 322 so that holes 344 are aligned with holes 330, 332, etc., central opening 340 is aligned with passageway 327. In FIG. 17, it can be seen that passageway 327 has a larger diameter than holes 340 and therefore, a portion 346 of surface 338 is exposed within passageway 327. Portion 346 is referred to hereinafter as a first bearing surface.

Second bearing member 312 has the same design and, in general, operates in the same fashion as does first bearing member 310. For this reason and, in the interest of simplifying this explanation, second bearing member 312 will not be described here in detail. Here, it should suffice to say that bearing member 312 abuts similarly shaped and dimensioned surface 350 of second cube member 308 such that a central opening 352 formed by bearing member 312 is aligned with passageway 354 formed by second cube member 308 and that the diameter of opening 352 is smaller than the diameter of passageway 354 so that a second bearing surface 356 is exposed within passageway 354 about opening 352.

Figure 18:
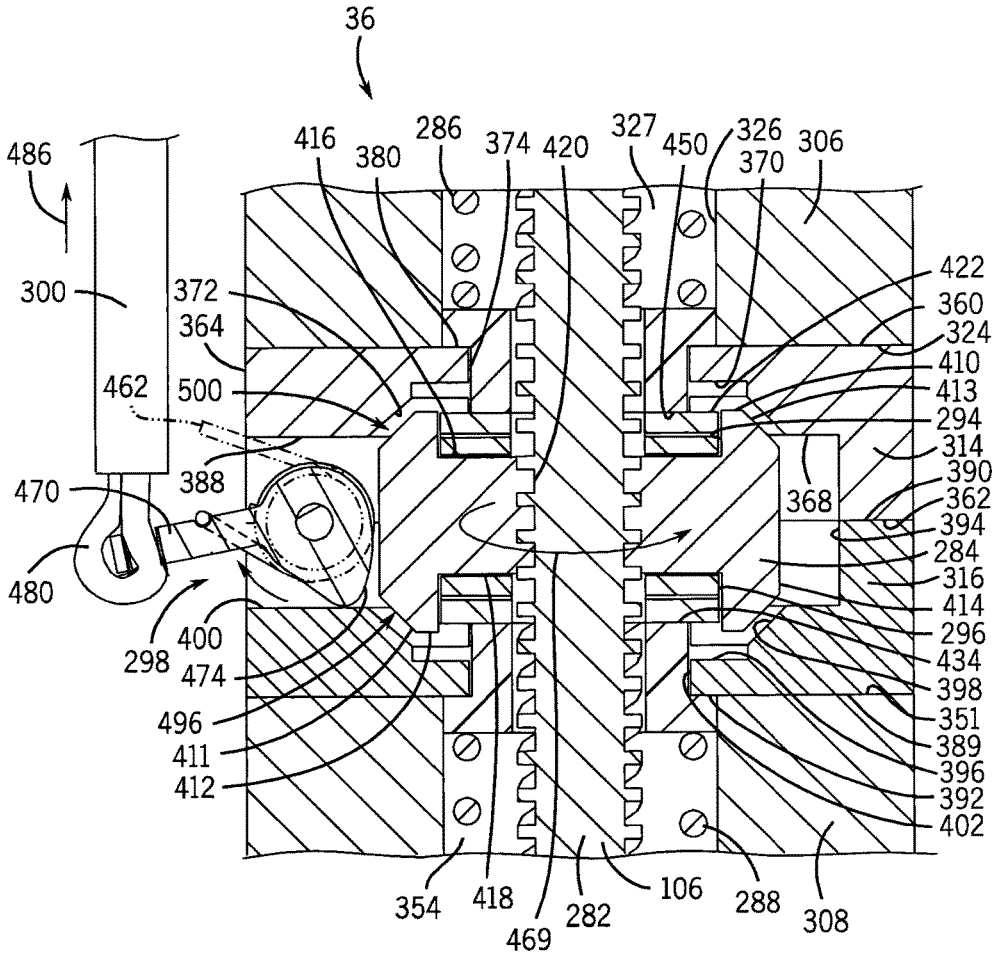
FIG. 18 is an enlarged view of a portion of the cross sectional view of FIG. 17, albeit where a primary locking mechanism has been disengaged.

Referring now to FIG. 18, first stop member 314 is a rigid member that has a square shape in top plan view (not illustrated) and a rectangular shape in both side and end elevational views where the square shape in top plan view is similar to, and has the same dimensions as, the second surface 324 of first cube member 306. In this regard, first stop member 314 includes first and second oppositely facing square surfaces 360 and 362 as well as four lateral surfaces that traverse the distance between surfaces 360 and 362. In FIG. 16, two of the four lateral surfaces are identified by numerals 364 and 366.

Referring still to FIG. 18, stop member 314 forms a first tier recess 368 in second square surface 362 and that opens or forms an opening 388 through lateral side surface 364. In addition, stop member 314 forms a second tier recess 370 within first tiered recess 368 where second tier recess 370 includes a chamfered frusto-conical surface 372 also referred to hereinafter as a first stop surface 372. Stop member 314 also forms a central opening 374 that passes through second tier recess 370 as well as four screw holes, two of which are shown in phantom in FIG. 17 and labeled 376 and 378 that extend from within the first tiered recess 368 through to surface 360. The screw holes (e.g., 376, 378, etc.) are formed so that they align with threaded openings (e.g., 334, 336) formed in second surface 324 of first cube member 306 when surface 360 abuts surface 324. Opening 374 is positioned with respect to the screw holes 376, 378, etc., such that, when the screw holes 376, 378, etc., are aligned with threaded holes 334, 336, etc., opening 374 is aligned with passageway 327. The diameter of opening 374 is less than the diameter of passageway 327 such that, when opening 374 is aligned with passageway 327, a portion of surface 360 adjacent opening 374 is exposed within passageway 327. The exposed portion of surface 360 within passageway 327 is referred to hereinafter as a first limiting surface 380.

Although not illustrated, referring once again to FIG. 16, first stop member 314 also forms recesses in oppositely facing lateral surfaces like surface 366 for receiving portions of brackets 318 and 320 and forms threaded holes that align with screw holes formed by brackets 318 and 320 such that the brackets 318 and 320 can be mounted thereto and, in general, be flush with the lateral surfaces (e.g., surface 366, etc.). Moreover, surface 362 (see FIG. 18) of first stop member 314 forms first and second semi-cylindrical recesses 384 and 386 (see FIG. 16) on opposite sides of opening 388 through lateral surface 364 where the semi-cylindrical recesses 384 and 386 are axially aligned.

Referring still to FIGS. 16 and 18, second stop member 316 is configured in a fashion similar to the configuration described above with respect to first stop member 314. For this reason, in the interest of simplifying this explanation, second stop member 316 will not be described here in detail. Here, it should suffice to say that second stop member 316 includes first and second oppositely facing surfaces 389 and 390, a second limiting surface 392, a first tier recess 394, a second tier recess 396 that forms a second chamfered frusto-conical stop surface 398, an opening 400 into first tier recess 394 through one lateral surface and a central opening 402 that opens from second tier recess 396 to surface 388.

Referring now to FIGS. 3, 5 and 17, after housing 280 is assembled, the housing 280 is supported by base member 90 such that opening 352, passageway 354, opening 402, opening 374, passageway 327 and opening 340 are all aligned with opening 104. To this end, in at least some cases, second bearing member 312 may be welded or otherwise mechanically attached to an upper surface of base member 90 adjacent counterbalance assembly 34 (see again FIGS. 5 and 9).

Referring to FIGS. 3, 6, 9 and 16 through 18, shaft 282 is an elongated rigid threaded rod-like member including a top end 410 and a bottom end 412. Bottom end 412 is rigidly connected to plate member 50 (see FIGS. 3 and 6) via welding or other mechanical means such that shaft 282 extends vertically upwardly therefrom and passes through the aligned openings 104, 352, 402, 374 and 340 as well as through passageways 354 and 327. Importantly, the thread on shaft 282 is a high lead thread meaning that one rotation of a nut thereon results in a relatively large axial travel of the nut along the shaft 282. For instance, in some cases one rotation of a nut on threaded shaft 282 may result in travel therealong of one-half of an inch or more.

Referring to FIGS. 17 and 18, nut 284 includes first and second oppositely facing surfaces 410 and 412 and a round lateral surface 414 (i.e., the cross-section of nut 284 is round) that traverses the distance between end surfaces 410 and 412. Between end surface 410 and lateral surface 414, nut 284 forms a chamfered frusto-conical surface 413 that is the mirror opposite of first stop surface 372. Similarly, between end surface 412 and lateral surface 414 nut 284 forms a chamfered frusto-conical surface 411 that is the mirror opposite of second stop surface 398. End surface 410 forms a central and cylindrical recess 416. Similarly, end surface 412 forms a central and cylindrical recess 418. Nut 284 forms a central threaded hole 420 that extends between recesses 416 and 418. The threaded hole 420 has a thread that matches the high lead thread of shaft 282.

Figure 19:
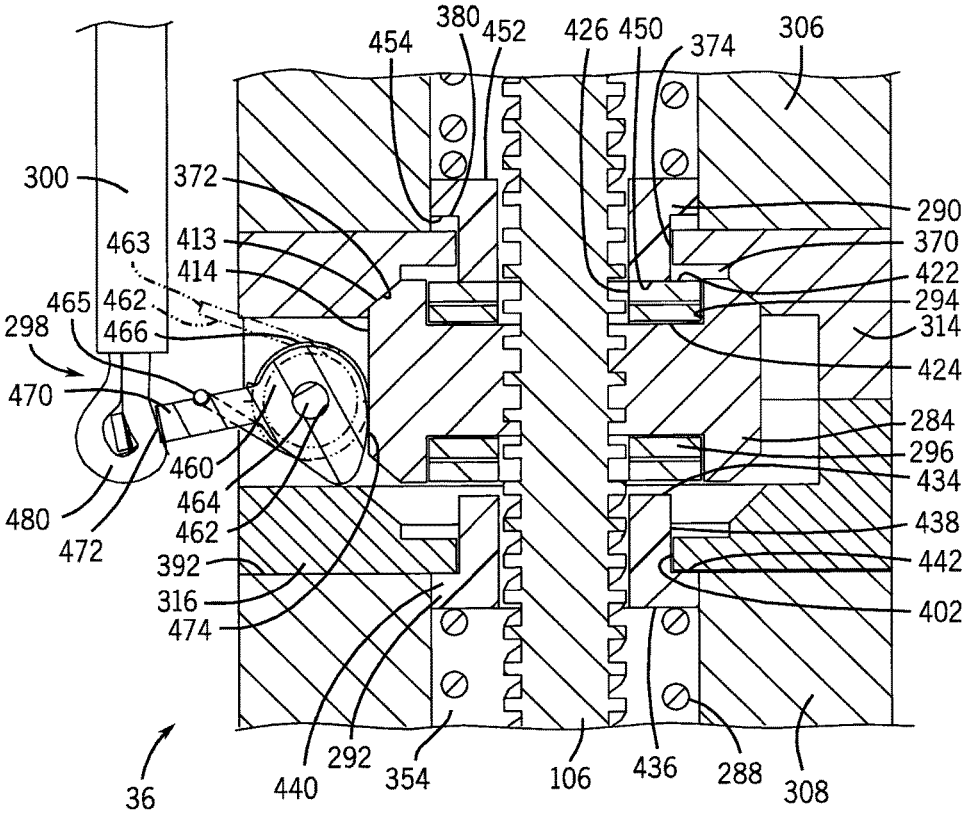
FIG. 19 is similar to FIG. 18, albeit where both the primary and a secondary locking mechanism are engaged when an overload condition occurs.

Referring to FIG. 19, first annular bearing ring 294 has first and second oppositely facing surfaces 422 and 424, a lateral cylindrical surface (not labeled) that traverses the distance between surfaces 422 and 424 and forms a central cylindrical opening 426. Referring also to FIG. 18, the dimension between oppositely facing surface 422 and 424 is similar to or slightly less than the depth of recess 416 formed by nut 284 and the diameter of the external surface of ring 294 is slightly less than the diameter of recess 416 such that first bearing ring 294 is receivable within recess 416 with opening 426 aligned with threaded hole 420. Bearing ring 294 can have any of several configurations including a needle type bearing ring, a ball bearing ring, etc.

Second bearing ring 296 has a construction similar to that described above with respect to first bearing ring 294 and therefore, in the interest of simplifying this explanation, bearing ring 296 will not be described here in detail. Here, it should suffice to say that bearing ring 296 is shaped and dimensioned to be receivable within recess 418 formed by nut 284.

Referring again to FIG. 19, second plunger 292 is a rigid cylindrical member including oppositely facing first and second end surfaces 434 and 436 and a lateral surface 438 that extends generally between end surface 434 and 436. A flange 440 extends radially outwardly from lateral surface 438 and is flush with second end surface 436 and forms a third limiting surface 442 that faces in the same direction as end surface 434.

Referring still to FIG. 19, the diameter formed by lateral surface 438 is slightly less than the diameter dimension of opening 402 formed by second stop member 316 while the diameter dimension formed by flange 440 is greater than the diameter dimension of opening 402 and slightly less than the diameter dimension of passageway 354. When so dimensioned, plunger 292 slides within passageway 354, first end 434 can extend through opening 402 but limiting surface 442 contacts limiting surface 392 to restrict complete movement of plunger 292 through opening 402.

First plunger 290 has a construction that is similar to the construction of plunger 292 described above and therefore, in the interest of simplifying this explanation, details of plunger 290 are not described here. Here, it should suffice to say that plunger 290 includes first and second oppositely facing surfaces 450 and 452 and a fourth limiting surface 454 where first plunger 290 has diameter dimensions such that first end 450 can extend through opening 374 formed by first stop member 314 with first end 450 extending into recess 370 and where fourth limiting surface 454 limits the extent to which plunger 290 can extend through opening 374 by contacting limiting surface 380.

Referring to FIG. 19, first locking mechanism 298 includes a lever member 460, a spring 462 and shaft 464.

Lever member 460 includes a cylindrical body member 466 that forms a cylindrical central opening 462 and an arm extension 470 that extends from body member 466 in one direction. Arm member 470 forms an opening 472 at a distal end. A body member 466 forms a cam surface 474 that extends from opening 462 and forms an approximately 90° angle with respect to arm member 470.

Referring still to FIG. 19, axel 464 is sized to be received within opening 462 and also to be received and retained within semi-cylindrical recesses (e.g., 384, 386, etc.) of facing surfaces 362 and 390 on opposite sides of the openings 388 and 400 into recess 368 and 394. Spring 462 is an axial torsion spring including first and second ends 463 and 465, respectively.

Activation cable 300 includes a sheathed braided and somewhat flexible metal cable having a first end 480 securely attached to the distal end of arm member 470 via opening 472 and a second end attached to activating lever 302 (see again FIG. 2). Although not illustrated in detail, lever 302 may be similar to a bike brake lever where, upon movement of the lever, the first end 480 of the activation cable 300 moves. More specifically, referring to FIGS. 2, 18 and 19, herein it will be assumed that when lever 302 is deactivated, first end 480 of cable 300 is released and can be moved downward by the force of spring 462 and, when lever 302 is activated, first end 480 is pulled upward as indicated by arrow 486 in FIG. 18.

Referring yet again to FIG. 17, first spring 286 is a helical compression spring including a first end 488 and a second oppositely directed end 490 where spring 286 forms a spring passageway 492 that extends between the first and second ends 488 and 490, respectively. Spring 286 is radially dimensioned such that spring 286 is receivable with radial clearance within passageway 327 and spring passageway 492 is dimensioned such that threaded shaft 282 can pass therethrough unobstructed. Second spring 288 is similar in design and operation to first spring 286 and therefore is not described here in detail.

Referring now to FIGS. 9 and 16 through 19, to assemble locking assembly 36, first bearing member 310 is mounted to cube member surface 322 via screws that pass through openings 344 into threaded recesses (e.g., 330, 332, etc.). Similarly, second bearing member 312 is mounted to second cube surface 350. Next, first spring 286 is slid into cube member passageway 326 until first end 488 contacts bearing surface 338, the flange end of first plunger 290 is pressed against second end 490 of spring 286 thereby at least partially compressing spring 286 until the flange end of plunger 290 is within an adjacent end of cube member passageway 326. First stop member 314 is next mounted to the second surface 324 of cube member 306 via screws such that the second end of plunger 290 adjacent second end surface 450 extends into second tier recess 370.

In a similar fashion, second spring 288 is positioned within cube member passageway 354, plunger 292 is used to at least partially compress spring 288 within passageway 354 and second stop member 316 is mounted to the surface 351 of second cube member 308.

Continuing, referring to FIGS. 3 and 6, the lower end 412 of threaded shaft 282 is rigidly connected to plate 50 via welding or the like with the upper end 410 of shaft 282 extending upward and centrally through opening 104 formed by base member 90. The subassembly including second stop member 316, plunger 292, spring 288, second cube member 308 and second bearing member 312 are next aligned with the top end 410 of shaft 282 and slid down over the shaft 282 so that the shaft 282 passes through cube member passageway 354 and aligned openings formed by bearing member 312 and plunger 292 until an undersurface of second bearing member 312 rests on the top surface 98 of base member 90 (see FIG. 17). Bearing member 312 is mechanically attached (e.g., welding, other mechanical means, etc.) to top surface 98.

Bearing rings 294 and 296 are next placed within recesses 416 and 418 formed by the oppositely facing surfaces of nut 284. Nut 284 is then fed onto top end 410 of threaded shaft 282 until the surface of bearing ring 296 facing end surface 434 of plunger 292 contacts surface 434. As illustrated in FIG. 18, when bearing ring 296 contacts surface 434, a gap 496 is formed between second stop surface 398 and the facing chamfered surface 411 of nut 284.

Referring still to FIGS. 16 through 18, lever member 460 is next mounted to a central section of shaft 464 for rotation thereabout and spring 462 is placed around axel 464. Axel 464 is positioned with opposite ends resting on the semi-cylindrical recesses formed by second stop member 316 (e.g., the cylindrical recesses formed by member 316 that are similar to recesses 386 and 388 formed by member 314).

Referring again to FIGS. 16 and 17, the assembly including stop member 314, cube member 306, plunger 290, spring 286 and bearing member 310 is next aligned with top end 410 of shaft 282 and slid therealong until facing surfaces 362 and 390 of stop members 314 and 316 abut and so that openings 388 and 400 are aligned. When openings 388 and 400 are aligned, the semi-cylindrical recesses (e.g., 384, 386, etc.) formed by members 314 and 316 are also aligned and retain opposite ends of shaft 464. Referring to FIG. 19, as the subassembly including cube 306 is moved toward the subassembly including cube member 308, spring 462 is manipulated such that first end 463 contacts a long edge of opening 388 and the second end contacts a generally upward facing surface of arm member 470 with the spring compressed between the two surfaces and hence applying a downward spring force to the upper surface of arm member 470. This downward force on arm member 470 causes lever member 460 to rotate in a counter-clockwise direction as viewed in FIG. 19 and hence forces cam surface 474 to contact an adjacent lateral surface 414 of nut 284.

Referring again to FIG. 16, brackets, two identified by numerals 318 and 320, are mounted via flathead screws to each of stop members 314 and 316 to rigidly connect the top and bottom housing subassemblies and related components. Referring also to FIG. 18, when the housing subassemblies and related components are connected via brackets 318 and 320, plunger end surface 450 contacts a facing surface 422 of bearing ring 294 and a small gap 500 exists between stop surface 372 and facing surface 413 of nut 284.

First cable end 480 is next connected to the distal end arm member 470 via opening 472 as illustrated in FIGS. 16-20. The second end of cable 300 is fed through an opening (not illustrated) at top end 54 of column 30 and out of passageway 58 to lever 302 (see again FIG. 2).

Referring now to FIGS. 1, 2, 3, 9, 16, 17, 19 and 20, in operation, when activation lever 302 is disengaged, spring 462 forces lever member 460 into a locked position wherein cam surface 474 contacts an adjacent surface of nut 284 and restricts rotation of nut 284. When nut 284 is locked and cannot rotate about shaft 282, housing 280 and hence column 30 which is linked thereto via base member 90, cannot move with respect to column 28 and the table top height is effectively locked.

When lever 302 is activated and hence first end 480 of cable 300 is pulled upward as indicated by arrow 486 in FIG. 18, arm member 470 follows upward against the force of spring 462 and cam surface 474 rotates in a clockwise direction thereby releasing nut 284. Once cam surface 474 has been separated from nut 284, a table user can raise or lower table top 14 causing nut 284 to rotate around shaft 282 in an upward direction or in a downward direction (see arrow 469 in FIG. 18), respectively. Once a desired table height has been reached, the table user releases lever 302. When lever 302 is released, spring 462 forces lever arm 470 downward and hence forces cam surface 474 to rotate counter-clockwise and contact the lateral surface 414 of nut 284, again restricting nut movement on shaft 282 as illustrated in FIG. 17.

Referring now to FIGS. 1, 9, 17 and 18, when the counterbalance force applied by counterbalance assembly 34 is similar to the combined downward force of a load (e.g., a computer screen, a box of books, etc.) placed on top surface 26 of top member 14, table top 14 and column 30, nut 284 is suspended by plungers 290 and 292 and bearing rings 294 and 296 within the space formed by recesses 368 and 394 such that frusto-conical surfaces 411 and 413 of nut 284 are separated from stop surfaces 272 and 396 by gaps 500 and 496, respectively. Thus, when the combined load is similar to the counterbalance force, when lever member 460 is moved into the unlocked position as in FIG. 18, nut 284 is free to rotate about shaft 282 and the table top 14 can be raised and lowered.

However, if the combined force of the table top load, table top 14 and column 30 is substantially greater than the counterbalance force applied by assembly 34, the combined load overcomes a preload force applied by spring 286 causing housing assembly 280 to move slightly downward until first stop surface 372 contacts the facing frusto-conical surface 413 of nut 284. This overloaded condition is illustrated in FIG. 19 where surface 413 contacts stop surface 272. When surface 372 contacts surface 413, stop surface 372 acts as a second or secondary locking mechanism to stop rotation of nut 284. Thus, when the table is overloaded and surface 372 contact surface 413, even if lever 302 is activated to rotate cam surface 474 away from nut 284, nut 284 will not rotate until the overloaded condition is eliminated. Overload conditions can be eliminated by reducing the load on table top 14.

Figure 20:
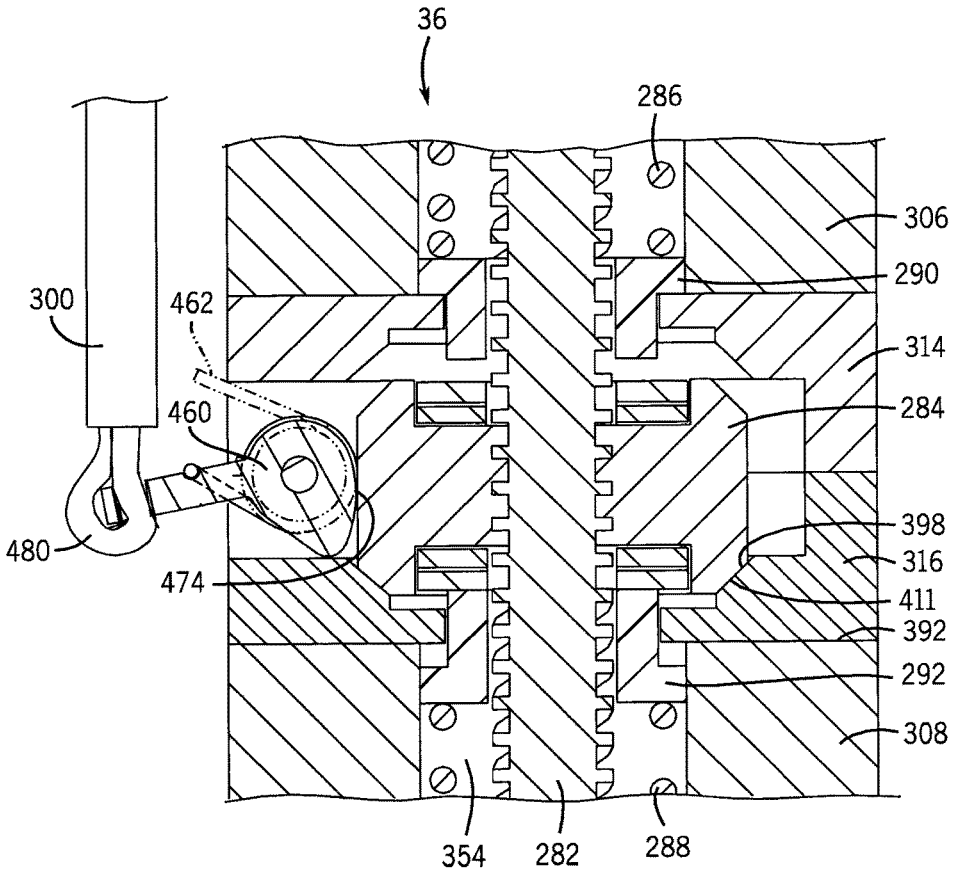
FIG. 20 is similar to FIG. 18, albeit where both the primary and a third locking mechanism are engaged when an underload condition occurs.

Similarly, referring to FIGS. 1, 2 and 20, if the combined downward force of table top 14, column 30 and any load on surface 26 is appreciably less than the counterbalance force applied by assembly 34, the counterbalance force overcomes the preload force of spring 288 such that plunger 292 is forced downward as illustrated and further into passageway 354 until second stop surface 398 contacts the facing frusto-conical surface 411 of nut 284. When second stop surface 398 contacts champford surface 411, stop surface 398 acts as a third locking mechanism to restrict nut rotation. Thus, when the table is underloaded and surface 398 contacts surface 411, even if lever 302 is activated to rotate cam surface 474 away from nut 284, nut 284 will not rotate until the underloaded condition is eliminated. Underload conditions can be eliminated by increasing the load on table top 14.

The range of acceptable unbalance between the applied counterbalance force and the table load can be preset by the characteristics of springs 286 and 288 and the degree to which those springs are preloaded. Thus, where springs 286 and 288 are substantially preloaded, the range of unbalance prior to the second and third locking mechanisms operating will be relatively large. In some cases the range of acceptable overload will be similar to the range of acceptable underload and therefore the preload force of each of springs 286 and 288 will be similar. In other cases, it is contemplated that one or the other of springs 286 or 288 may generate greater force than the other.

In addition, while the embodiment described above provides both second and third locking mechanisms for restricting table motion when overload and underload conditions occur, respectively, other configurations are contemplated that include only one or the other of the second and third locking mechanisms. For instance, in some cases, only an overload restricting mechanism may be provided.

Figure 21:
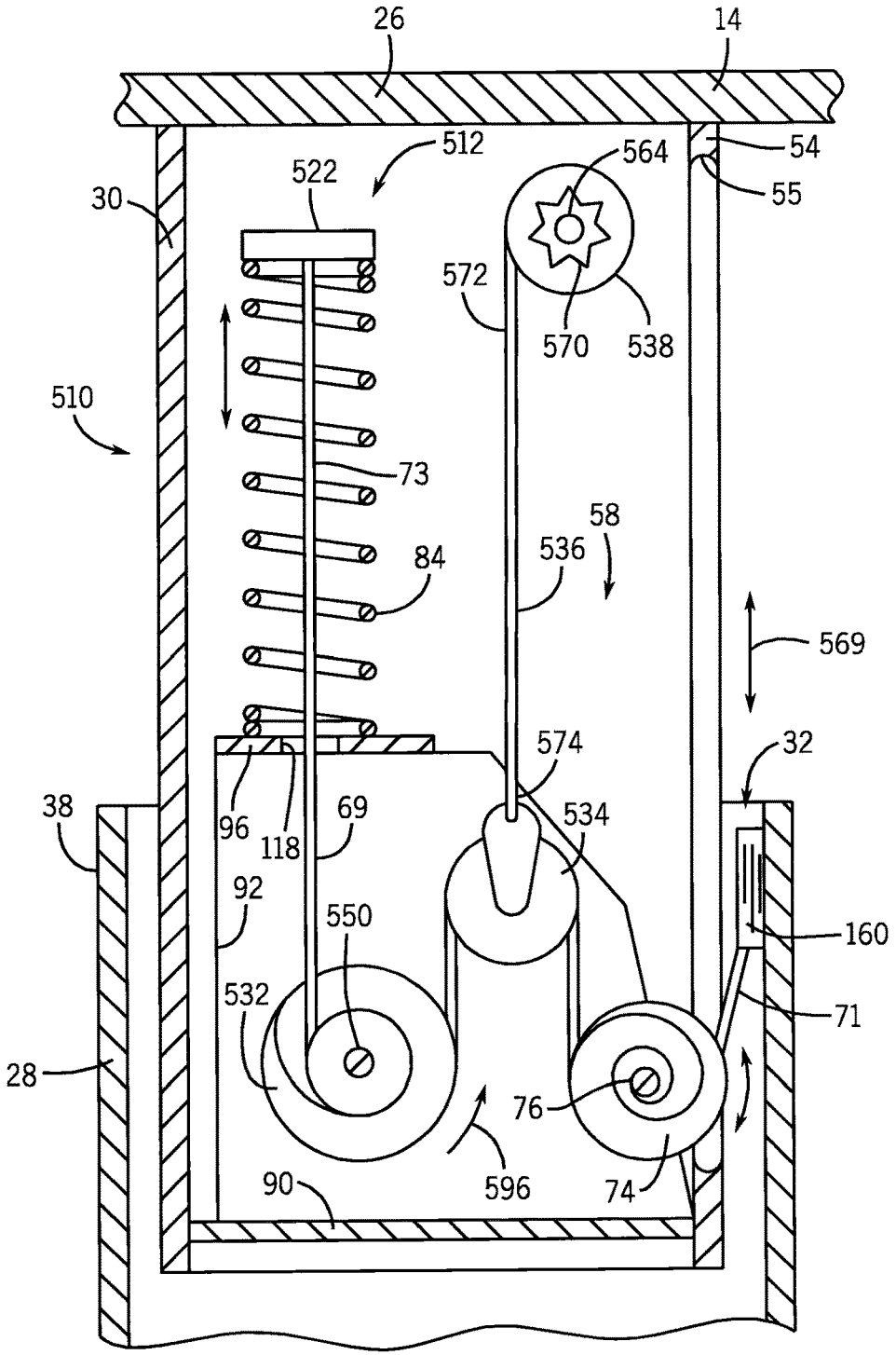
FIG. 21 is a schematic illustration of an exemplary adjustable counterbalance assembly with the assembly set to apply a first magnitude counterbalance force.

Referring now to FIG. 21, an exemplary table configuration 510 is illustrated that includes an adjustable counterbalance assembly 512 mounted within a passageway 58 formed by an upper column 30 that is received with a passageway 32 formed by a lower column 28. Here, many of the components described above with respect to counterweight assembly 34 are similar and therefore are not described again in detail and, in fact, are only schematically illustrated or represented by other schematic components. For instance, referring again to FIG. 4, guide 86, cap member 88, rods 78, plunger 80 and dowel 82 described above with respect to the first counterweight assembly 34 are simply represented by an end member 522 in FIG. 21. As another instance, lateral walls 92 and 94 and shaft 76 in FIG. 4 are schematically represented by a single lateral member 92 and an end view of shaft 76 where a second lateral wall (e.g., 94) is not shown. In this embodiment, in addition to the components described above including a spring 84, a snail cam pulley 74 and a strand 69, assembly 510 includes a power law pulley 532, a conventional single radius pulley 534, an adjusting cable 536, a shaft 564, a knob 570 and a spool 538.

As in the previous counterbalance assembly, a base member 90 is mounted proximate the lower end of upper column 30 and within passageway 58. Lateral member 92 extends upward from base member 90 and a top member 96 is mounted at the top end of lateral member 92 above base member 90. Top member 96 forms an opening 118. Spring 84 and associated components (e.g., a guide, a plunger, guidance rods, etc.) are supported on a top surface of member 96 aligned with opening 118.

Figure 23:
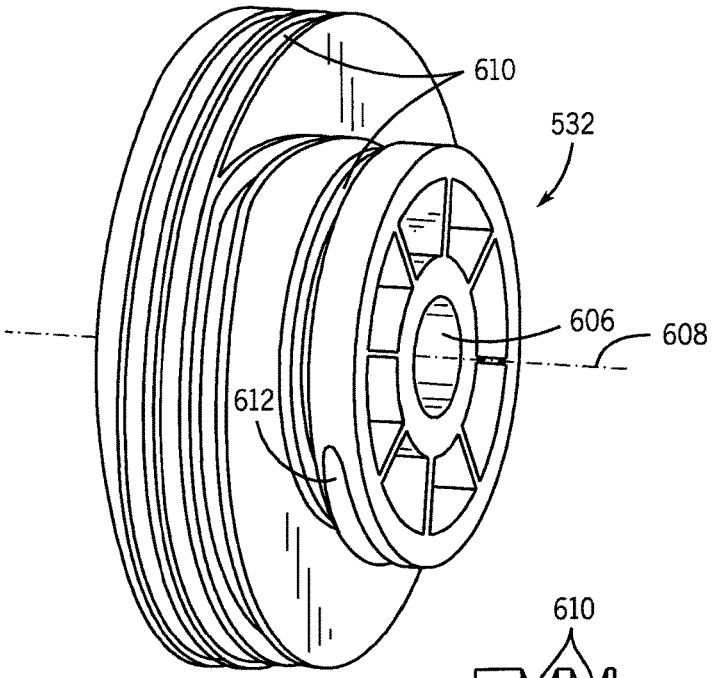
FIG. 23 is a perspective view of the exemplary power law pulley in FIG. 21.
Figure 24:
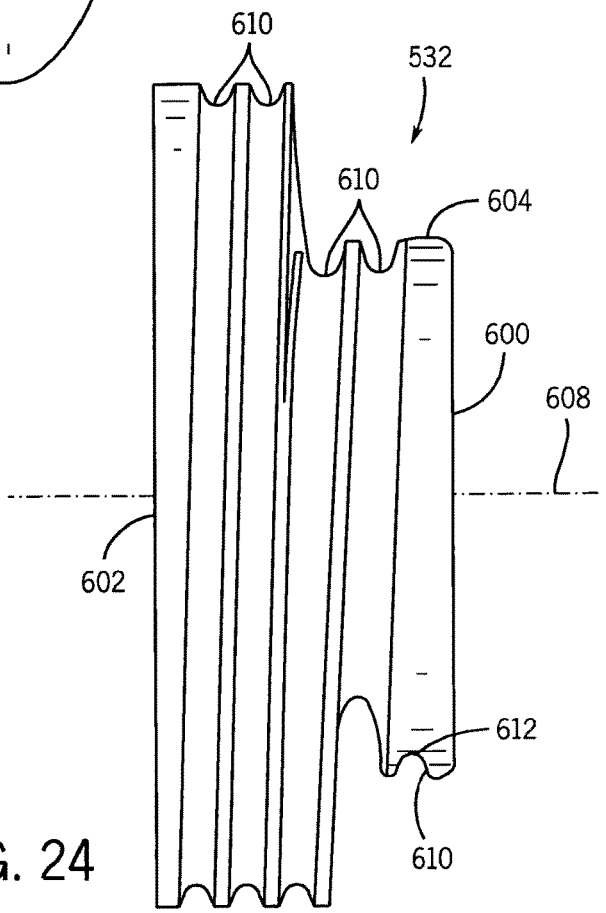
FIG. 24 is a side elevational view of the pulley of FIG. 23.

Referring to FIGS. 23 and 24, power law pulley 532 includes first and second oppositely facing surfaces 600 and 602 and a lateral surface 604 that traverses the distance therebetween. Pulley 532 forms a central cylindrical opening 606 about an axis 608. Lateral surface 604 forms a channel 610 that wraps around axis 608 several times and that includes a first end 612 and a second end (hidden in the views). The radii of channel 610 from axis 608 varies along much of the channel length. To this end, the radius at first end 612 is a medium relative radius and the radius at the second end is a large relative radius with the radius along a midsection of channel 610 being a relatively small radius. The radius is gradually reduced between first end 612 and the midsection (e.g., over 1.5 to two turns) and then is increased more rapidly (e.g., over about half a turn) between the midsection and the large radius section. The large radius section wraps around axis 610 approximately twice and is substantially of constant radius.

Referring again to FIG. 21, power law pulley 532 is mounted via a shaft 550 between the lateral walls (one shown as 92) for rotation around a generally horizontal axis perpendicular to the direction of travel of column 28 as indicated by arrow 569. Similarly, snail cam pulley 74 is mounted via shaft 76 between the lateral walls (one shown as 92) for rotation about a horizontal axis perpendicular to the direction of travel of column 28. As in the case of pulley 74 above, a ring bearing may be provided for each of pulleys 74 and 532. Pulley 74 is positioned adjacent slot 55 so that a first end 71 of strand 69 can extend therefrom and mount via a bracket 160 near the top end 38 of the internal surface of lower column 28.

Spool 538 is mounted to shaft 564 near a top end 54 of upper column 30 and generally resided within passageway 58. Shaft 564 extends through an opening (not illustrated) in column 30 and is linked to a knob 570 that resides on the outside of column 30 just below the table top undersurface. Knob 570 is shown in phantom in FIG. 21. Although not illustrated, some type of spring loaded latch or the like may be provided to lock spool 570 and knob 538 in a set position unless affirmatively deactivated. Any type of latching mechanism may be used for this purpose. Although not illustrated, in at least some embodiments, it is contemplated that a bevel gear set may be employed as part of the adjustment configuration to gain mechanical advantage.

Cable 536 includes first and second ends 572 and 574, respectively. First end 572 is linked to spool 538 so that, as spool 538 is rotated in a clockwise direction as viewed in FIG. 21, strand 536 is wound around spool 538. Similarly, when spool 538 is rotated in a counter-clockwise direction as viewed in FIG. 21, strand 536 is unwound from spool 538. The second end 574 of strand 536 is linked to a shaft associated with conventional single radius pulley 534 with pulley 534 generally hanging downward below spool 538 and between and above pulleys 74 and 532.

Strand 69 includes first and second ends 71 and 73, respectively. Starting at first end 71 that is secured via bracket 160 the top end of lower column 28, strand 69 extends downward toward a constant relatively large radii portion of the channel formed by snail cam pulley 74 and enters the channel, warps around pulley 74 several times within the channel and then exits the channel extending generally upward toward conventional single radius pulley 534. When spring 84 is in a relatively uncompressed state associated with a raised table position, strand 69 exits the pulley 74 channel from a large radius location and extends up to pulley 534. Continuing, strand 69 passes around pulley 534 and down to the relatively large constant radii portion of channel 610 formed by power law pulley 532. Strand 69 passes around the power law pulley channel approximately 1.5 times in the constant radii section and then approximately twice in the variable portion and then again extends upward, through opening 118 in member 96, through helical spring 84 and is linked to member 522 that generally resides above spring 84.

Figure 22:
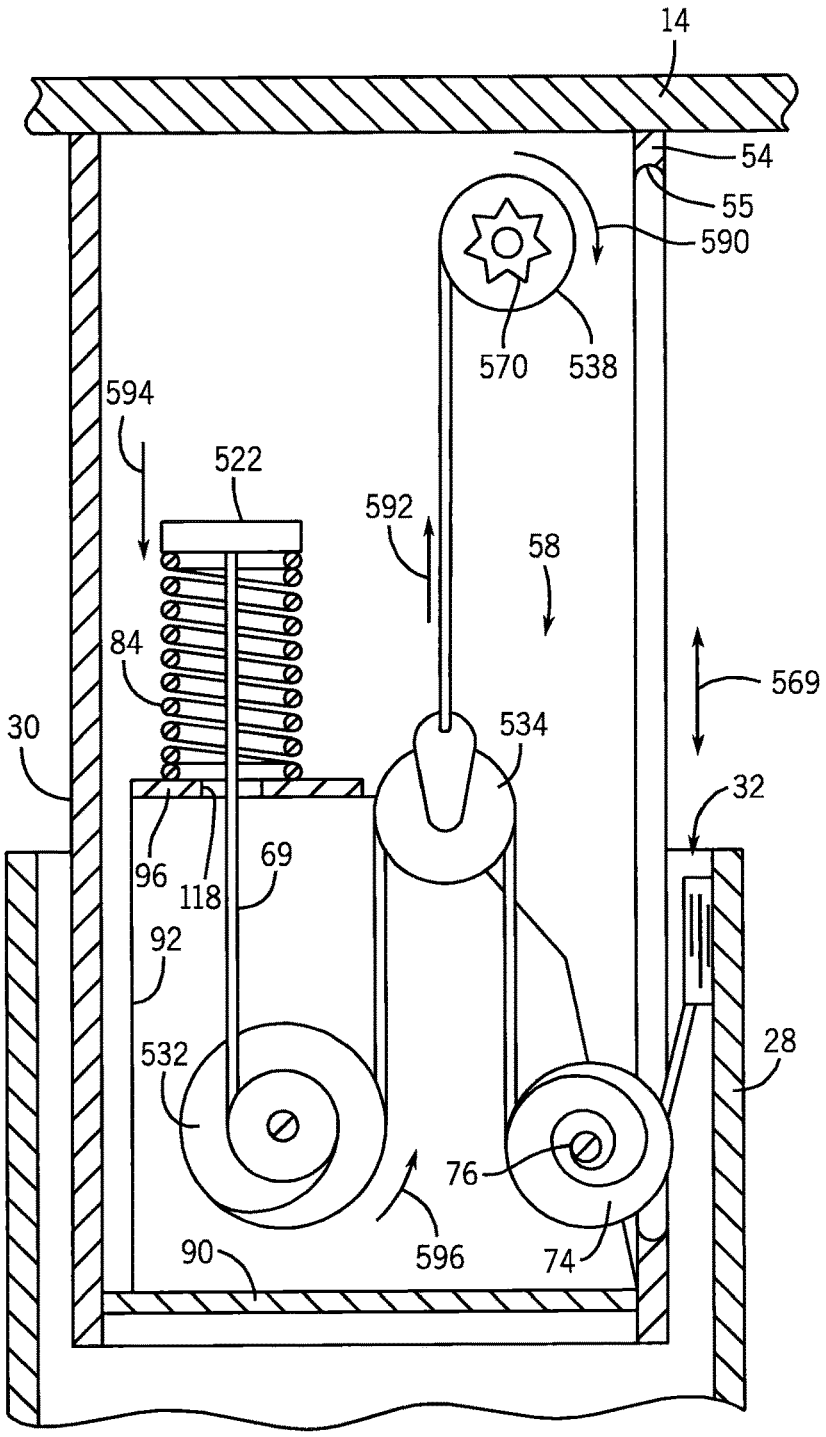
FIG. 22 is a schematic similar to FIG. 21, albeit with the assembly set to apply a second magnitude counterbalance force.

Here, referring to FIGS. 21, 23 and 24, when table top 14 is in a high or extended position and spring 84 is relatively unloaded, power law pulley 532 is positioned such that strand 69 extends down from member 522 and into the medium radii portion of pulley channel 610 proximate first end 612 and spring 84 is loaded with a specific preload force value. To increase the preload force value, referring now to FIG. 22, knob 570 is rotated in the clockwise direction as indicated by arrow 590, to pull conventional single radius pulley 534 upward as indicated by arrow 592. When pulley 534 moves upward, force is applied via strand 69 and member 522 tending to compress spring 84 as indicated by arrow 594. Thus, the preload force applied by spring 84 is increased. To reduce the preload force, knob 570 is rotated in the counterclockwise direction as viewed in FIG. 22.

Importantly, as single radius pulley 534 moves upward, pulley 532 rotates in a counterclockwise direction as indicated by arrow 596 so that the radius from which strand 69 extends upward toward spring 84 changes. More specifically, in the present example, as pulley 532 rotates, the radius from which strand 69 extends upward gradually changes from the medium radius to the small radius of the midsection of channel 610 and then changes more rapidly toward the large channel radius. Here, it has been recognized that if channel 610 (i.e., the radial variance) is designed properly, pulley 532 can be used to change the linear relationship between force and spring deflection into a power law relationship. To this end, as described above, spring force increases with increasing rate throughout its range of compression such that spring force F is equal to spring rate (k) times the deflection or compression (x). In the case of a power law relationship, we want the following equation to be true:

$$F=F_0(c)^x \qquad \text{Eq. 1}$$

where $F_0$ is the initial spring force, c is a constant and x is spring deflection.

Figure 27:
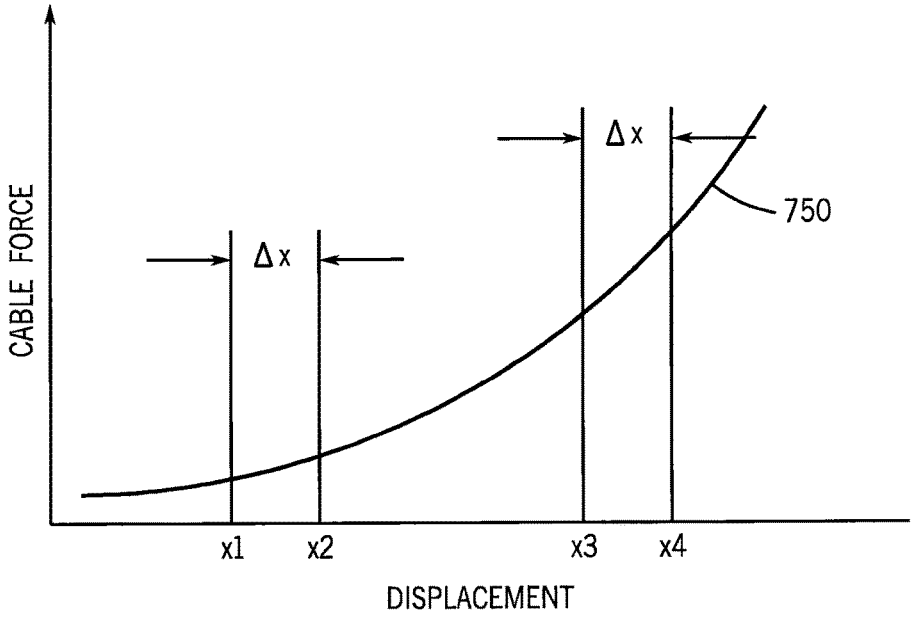
FIG. 27 is a graph showing a power law force curve.

Referring to FIG. 27, an exemplary power law curve 750 is illustrated where similar changes in spring displacement (e.g., compression) result in similar relative magnitude changes in force. For instance, as shown in FIG. 27, when displacement is changed from x1 to x2, an associated force changes from F1 to F2. Here it is assumed that F2=1.15 F1. According to the power law, when displacement is changed from x3 to x4 (see again FIG. 27) along a different section of the power law curve 750, an associated force changes from F3 to F4 where F4=1.15F3 (i.e., the relative force magnitude change is the same for similar changes in displacement).

Referring now to Table 2, data similar to the date presented in Table 1 is provided except that the data is provided for an exemplary power law pulley where an initial spring force is 50 lbs. Instead of 100 lbs. In the first column, the work surface position 0.0 corresponds to a maximum raised position and the stroke is 13.8 inches. Referring specifically to the second and third columns of Table 2, it can be seen that during top descent, the power law cam radius from which strand 69 extends up to spring 84 (see again FIG. 21) begins at 1.6043 inches, gradually drops down to 1.0469 inches at 4.1 inches of descent and then again increases to 1.5831 inches at the low table top position. Referring to the fourth and fifth columns, while the spring force in the fourth column changes linearly, the rope force in the fifth column (i.e., the force at the strand section extending up from pulley 532 to pulley 534 in FIG. 21) has a curve like the power law curve illustrated in FIG. 27.

TABLE 2

| Worksurface | CAM PROFILE | | | |
|---|---|---|---|---|
| Position | Angle | Radius | Spring Force | Rope Force |
| 0.0 | −20.78 | 1.6043 | 50.0 | 50.00 |
| 0.5 | 2.64 | 1.3819 | 59.9 | 53.32 |
| 0.9 | 24.53 | 1.2516 | 69.3 | 56.87 |
| 1.4 | 45.25 | 1.1713 | 78.3 | 60.64 |
| 1.8 | 65.14 | 1.1198 | 87.0 | 64.67 |
| 2.3 | 84.48 | 1.0865 | 95.4 | 68.97 |
| 2.8 | 103.43 | 1.0655 | 103.6 | 73.56 |
| 3.2 | 122.10 | 1.0532 | 111.7 | 78.44 |
| 3.7 | 140.56 | 1.0475 | 119.8 | 83.66 |
| 4.1 | 158.87 | 1.0469 | 127.8 | 89.22 |
| 4.6 | 177.06 | 1.0506 | 135.9 | 95.14 |
| 5.1 | 195.15 | 1.0577 | 144.0 | 101.47 |
| 5.5 | 213.18 | 1.0679 | 152.1 | 108.21 |
| 6.0 | 231.14 | 1.0807 | 160.3 | 115.40 |
| 6.4 | 249.05 | 1.0959 | 168.7 | 123.07 |
| 6.9 | 266.92 | 1.1132 | 177.1 | 131.25 |

TABLE 2-continued

| Worksurface | CAM PROFILE | | | |
|---|---|---|---|---|
| Position | Angle | Radius | Spring Force | Rope Force |
| 7.4 | 284.76 | 1.1326 | 185.7 | 139.97 |
| 7.8 | 302.57 | 1.1538 | 194.4 | 149.27 |
| 8.3 | 320.35 | 1.1769 | 203.3 | 159.19 |
| 8.7 | 338.11 | 1.2017 | 212.4 | 169.77 |
| 9.2 | 355.86 | 1.2282 | 221.7 | 181.05 |
| 9.7 | 373.59 | 1.2564 | 231.2 | 193.08 |
| 10.1 | 391.30 | 1.2861 | 240.9 | 205.91 |
| 10.6 | 409.00 | 1.3175 | 250.8 | 219.59 |
| 11.0 | 426.69 | 1.3506 | 261.0 | 234.18 |
| 11.5 | 444.37 | 1.3852 | 271.4 | 249.75 |
| 12.0 | 462.05 | 1.4214 | 282.1 | 266.34 |
| 12.4 | 479.71 | 1.4593 | 293.1 | 284.04 |
| 12.9 | 497.37 | 1.4989 | 304.3 | 302.92 |
| 13.3 | 515.02 | 1.5401 | 315.9 | 323.05 |
| 13.8 | 532.67 | 1.5831 | 327.8 | 344.51 |

Referring again to FIG. 21, the significance of the power law relationship is that pulleys 534 and 74 can be designed to convert the power law output (i.e., the force that results from Equation 1) into a flat output force regardless of the initial spring force value $F_0$ or the deflection starting point where the magnitude of the flat output force is proportional to the initial preload spring force $F_0$. More specifically, using conventional pulley 534 and a suitably designed snail cam pulley 74, the power law force caused by pulley 532 can be converted to a flat force having a magnitude that is proportional to the initial force applied by spring 84. Thus, while pulleys 534 and 532 can be used to adjust the spring applied force and hence the initial deflection point along a power law curve like curve 750 in FIG. 27, pulley 74 can be used to flatten the force at strand end 71 throughout the range of table top motion.

Referring to Table 3, a table similar to Table 1 is provided where a snail cam pulley 74 having the characteristics identified in the second and third columns was used to convert the force on the portion of strand 69 between pulleys 532 and 534 to a flat 50 lb. force (see fifth column) as table top 14 descended.

TABLE 3

| Worksurface | CAM PROFILE | | | |
|---|---|---|---|---|
| Position | Angle | Radius | Spring Force | Rope Force |
| 44.0 | −16.13 | 2.3423 | 50.0 | 50.00 |
| 43.4 | −0.29 | 2.1625 | 53.9 | 50.00 |
| 42.8 | 15.45 | 2.0078 | 57.8 | 50.00 |
| 42.3 | 31.10 | 1.8733 | 61.7 | 50.00 |
| 41.7 | 46.67 | 1.7555 | 65.7 | 50.00 |
| 41.1 | 62.18 | 1.6514 | 69.7 | 50.00 |
| 40.5 | 77.63 | 1.5587 | 73.7 | 50.00 |
| 39.9 | 93.02 | 1.4759 | 77.6 | 50.00 |
| 39.3 | 108.37 | 1.4013 | 81.6 | 50.00 |
| 38.8 | 123.68 | 1.3339 | 85.6 | 50.00 |
| 38.2 | 138.95 | 1.2826 | 59.7 | 50.00 |
| 37.6 | 154.19 | 1.2167 | 93.7 | 50.00 |
| 37.0 | 169.40 | 1.1654 | 97.7 | 50.00 |
| 36.4 | 184.58 | 1.1183 | 101.7 | 50.00 |
| 35.8 | 199.75 | 1.0749 | 105.7 | 50.00 |
| 35.3 | 214.89 | 1.0346 | 109.8 | 50.00 |
| 34.7 | 230.01 | 0.9973 | 113.8 | 50.00 |
| 34.1 | 145.12 | 0.9626 | 117.9 | 50.00 |
| 33.5 | 260.21 | 0.9302 | 121.9 | 50.00 |
| 32.9 | 275.28 | 0.8999 | 125.9 | 50.00 |
| 32.3 | 290.34 | 0.8715 | 130.0 | 50.00 |
| 31.8 | 305.39 | 0.8448 | 134.0 | 50.00 |
| 31.2 | 320.43 | 0.8197 | 138.1 | 50.00 |
| 30.6 | 335.46 | 0.7961 | 142.1 | 50.00 |

TABLE 3-continued

| Worksurface | CAM PROFILE | | | |
|---|---|---|---|---|
| Position | Angle | Radius | Spring Force | Rope Force |
| 30.0 | 350.48 | 0.7738 | 146.2 | 50.00 |
| 29.4 | 365.50 | 0.7527 | 150.2 | 50.00 |
| 28.8 | 380.50 | 0.7327 | 154.3 | 50.00 |
| 28.3 | 395.50 | 0.7138 | 158.4 | 50.00 |
| 27.7 | 410.49 | 0.6958 | 162.4 | 50.00 |
| 27.1 | 425.47 | 0.6787 | 166.5 | 50.00 |
| 26.5 | 440.45 | 0.6624 | 170.5 | 50.00 |

Similarly, referring to Table 4, a table similar to Table 3 is provided where the same snail cam pulley used to generate the data in Table 3 was used to convert a power law force between pulleys 532 and 534 to a flat force. Here, however, the initial spring force $F_0$ has been increased to 100.8 lbs. by raising pulley 534 which compresses spring 84. The resulting rope force (e.g., the force at strand 69 end 71) is a flat 100 lbs. instead of 50 lbs. as in the case of Table 3. Many other flat counterbalance forces may be selected by simply raising and lowering pulley 534 to rotate pulley 532 to different initial angles while modifying the initial spring force $F_0$ at the same time so that different initial deflection points along the power law curve (see again FIG. 27) result.

TABLE 4

| Worksurface | CAM PROFILE | | | |
|---|---|---|---|---|
| Position | Angle | Radius | Spring Force | Rope Force |
| 44.0 | −16.13 | 2.3443 | 100.8 | 100.00 |
| 43.4 | −0.29 | 2.1625 | 107.6 | 100.00 |
| 42.8 | 15.45 | 2.0078 | 115.5 | 100.00 |
| 42.3 | 31.10 | 1.8733 | 123.4 | 100.00 |
| 41.7 | 46.67 | 1.7555 | 131.3 | 100.00 |
| 41.1 | 62.18 | 1.6515 | 139.3 | 100.00 |
| 40.5 | 77.63 | 1.5587 | 147.3 | 100.00 |
| 39.9 | 93.02 | 1.4759 | 155.3 | 100.00 |
| 39.3 | 108.37 | 1.4013 | 163.3 | 100.00 |
| 38.8 | 123.68 | 1.3339 | 171.3 | 100.00 |
| 38.2 | 138.95 | 1.2726 | 179.3 | 100.00 |
| 37.6 | 154.19 | 1.2167 | 187.3 | 100.00 |
| 37.0 | 169.40 | 1.1654 | 195.4 | 100.00 |
| 36.4 | 184.58 | 1.1183 | 203.4 | 100.00 |
| 35.8 | 199.75 | 1.0749 | 211.5 | 100.00 |
| 35.3 | 214.89 | 1.0346 | 219.6 | 100.00 |
| 34.7 | 230.01 | 0.9973 | 227.6 | 100.00 |
| 34.1 | 145.12 | 0.9626 | 235.7 | 100.00 |
| 33.5 | 260.21 | 0.9302 | 243.8 | 100.00 |
| 32.9 | 275.28 | 0.8999 | 251.9 | 100.00 |
| 32.3 | 290.34 | 0.8715 | 260.0 | 100.00 |
| 31.8 | 305.39 | 0.8448 | 268.1 | 100.00 |
| 31.2 | 320.43 | 0.8197 | 276.2 | 100.00 |
| 30.6 | 335.46 | 0.7967 | 284.3 | 100.00 |
| 30.0 | 350.48 | 0.7738 | 292.4 | 100.00 |
| 29.4 | 365.50 | 0.7527 | 300.5 | 100.00 |
| 28.8 | 380.50 | 0.7327 | 308.6 | 100.00 |
| 28.3 | 395.50 | 0.7138 | 316.7 | 100.00 |
| 27.7 | 410.49 | 0.6958 | 32478 | 100.00 |
| 27.1 | 425.47 | 0.6787 | 332.9 | 100.00 |
| 26.5 | 440.45 | 0.6624 | 341.1 | 100.00 |

Here, it should be appreciated that while power law pulley 532 has a specific design as best illustrated in FIGS. 23 and 24 (e.g., medium to small to large radius channel), other power law pulley designs are contemplated and the specific design used with a counterbalance assembly will be related to several factors including characteristics of the spring used to provide the counterbalance force, the rate at which turns of the power law pulley should increase and decrease the counterbalance force, etc. For instance, in some cases, the section of the power law pulley channel from which strand 69 extends to spring 84 may only decrease from a first radius to a second radius during table lowering activity.

In at least some embodiments it is contemplated that an automatically adjusting counterbalance system may be provided so that when a table top load exceeds or is less than the force applied by a counterbalance assembly by some threshold amount, the assembly automatically adjusts the applied force to eliminate or substantially reduce the out of balance condition. For instance, where a table load exceeds the applied counterbalance force by more than 20 pounds, the automatic system may adjust the counterbalance force up in increments of ten pounds until the unbalance is within the 20 pound range and, where the table load is more than 10 pounds less than the applied counterbalance force, the automatic system may adjust the counterbalance force down in increments of 10 pounds until the unbalance is within the 20 pound range.

Figure 25:
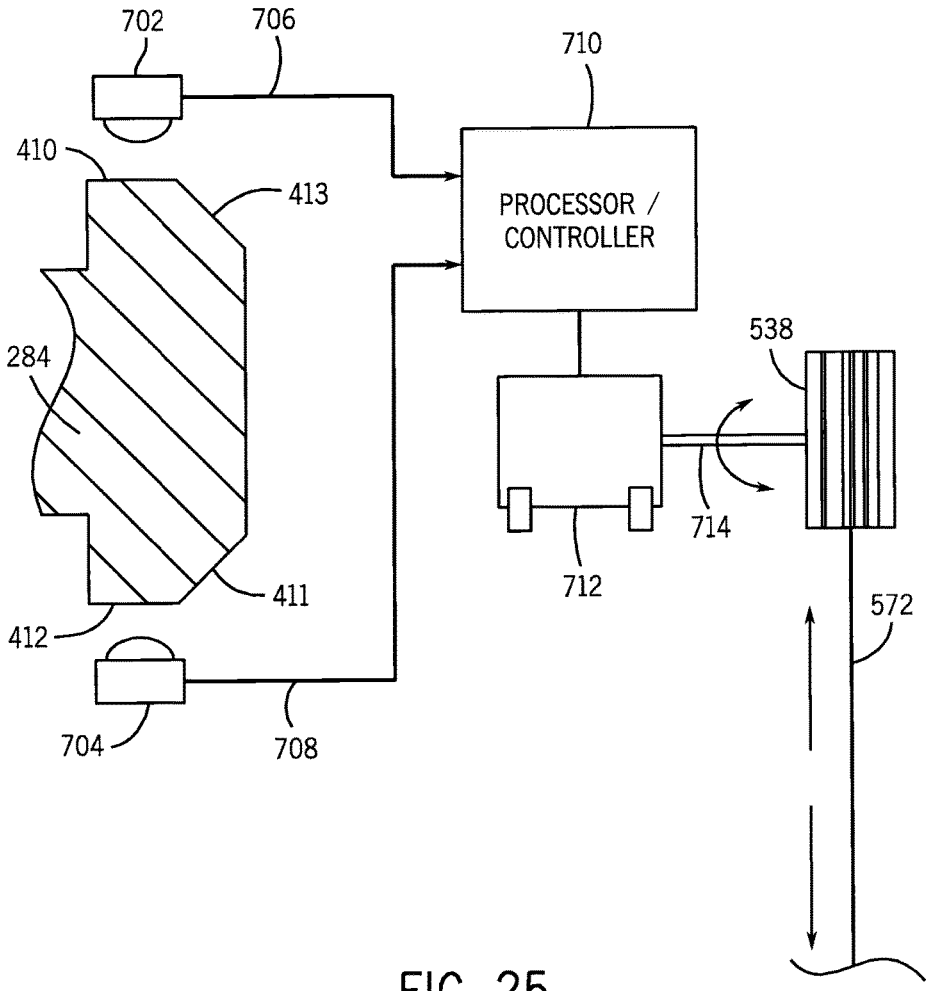
FIG. 25 is a schematic diagram of an automatically adjustable counterbalance assembly.
Figure 26:
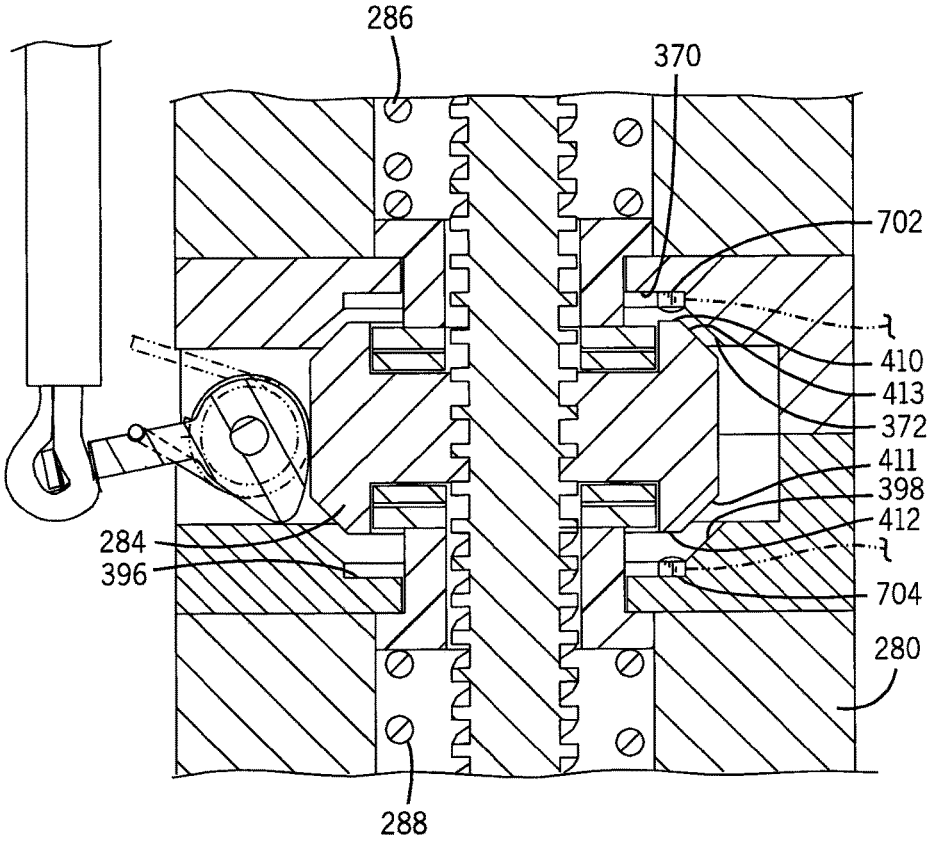
FIG. 26 is a view similar to the view of FIG. 18, albeit including two pressure sensors for use with other automatic counterbalance components illustrated in FIG. 25.

Consistent with the previous paragraph, several components of an exemplary automatically adjusting counterbalance table assembly 700 are illustrated in FIGS. 25 and 26. Here, referring also to FIGS. 16 through 22, it will be assumed that an assembly already includes locking assembly 36 and adjustable counterbalance assembly 510 with a few differences. First, referring to FIG. 26, in addition to the components described above with respect to FIGS. 16-20, two pressure type sensors 702 and 704 are positioned within second tier recesses 370 and 396, respectively, that face nut 284 end surfaces 410 and 412. When the table load exceeds the applied counterbalance force by more than a threshold amount that causes housing 280 to compress spring 286 so that nut surface 413 contacts stop surface 372, surface 410 contacts sensor 702 and causes sensor 702 to generate a signal. Similarly, when the table load is less than the applied counterbalance force by more than a threshold amount that causes housing 280 to compress spring 288 so that nut surface 411 contacts stop surface 398, surface 412 contacts sensor 704 and causes sensor 704 to generate a signal.

Referring to FIG. 25, sensors 702 and 704 are linked via wires 706 and 708 to a processor/controller 710 and provide signals thereto. Controller 710 is linked to a motor 712 having a shaft 714 that is linked to a spool 538 akin to spool 538 in FIG. 21. Controller 710 controls motor 712 to wind or unwind spool 538. When controller 710 receives a signal from sensor 702 (i.e., receives an overload signal), controller 710 causes motor 712 to wind spool 538 to take up strand 572 thereby increasing the counterbalance force applied by spring 528 (see again FIG. 21) and related components. Similarly, when controller 710 receives a signal from sensor 704 (i.e., an excessive counterbalance signal), controller 710 causes motor 712 to unwind spool 538 to let strand 572 out thereby reducing the counterbalance force applied by spring 528. The winding or unwinding continues until the unbalance is within some threshold range.

Figure 28:
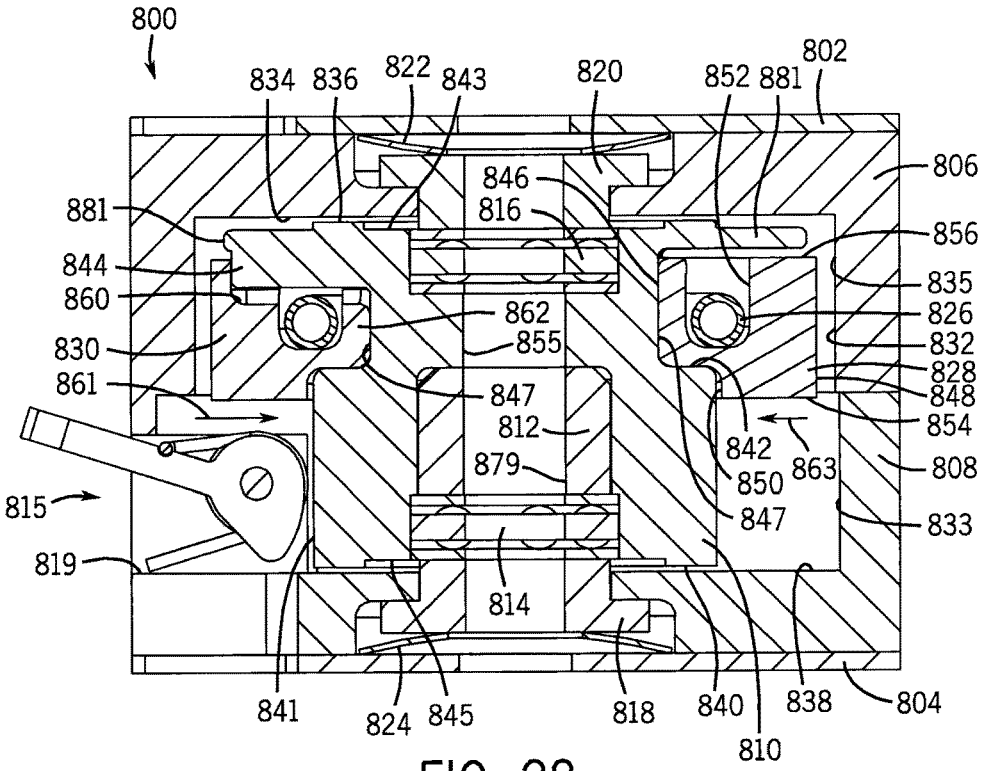
FIG. 28 is a cross-sectional view of a second locking assembly including a centrifugal force speed control mechanism according to at least some aspects of the present invention where a brake shoe is in a position that does not regulate speeds, albeit where a threaded shaft usable therewith is not illustrated.
Figure 29:
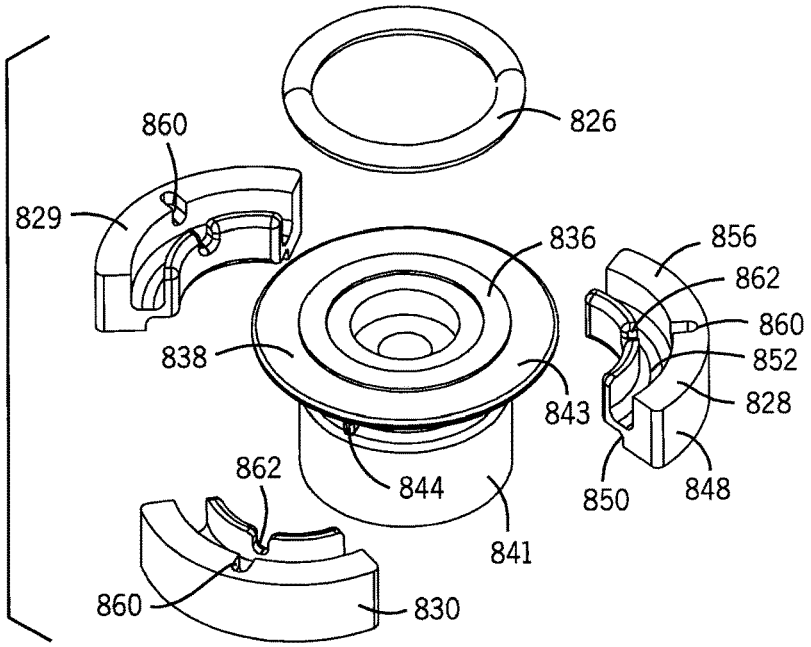
FIG. 29 is an exploded view of the clutch nut, brake shoes and the extension ring of FIG. 28.
Figure 30:
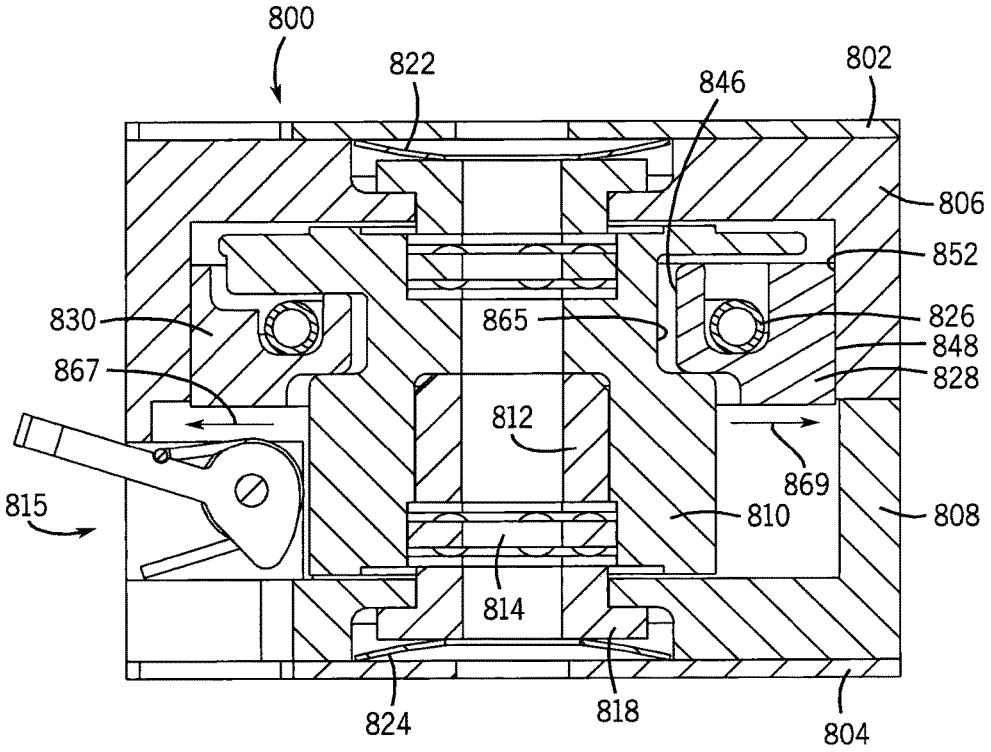
FIG. 30 is a cross-sectional view similar to the view illustrated in FIG. 28, albeit where the brake shoes are in a speed controlling position.

In at least some cases, it is contemplated that a clutch or speed governing mechanism may be provided for limiting the speed with which a table top can be raised or lowered. To this end, one exemplary locking assembly 800 that includes a speed governing or "braking" mechanism is illustrated in FIGS. 28-30. Referring specifically to FIGS. 28 and 29, assembly 800 includes a clutch nut 810, a threaded insert 812, first and second biasers or springs 822 and 824, respectively, first and second plungers 820 and 818, respectively, first and second annular bearing rings 816 and 814, respectively, a locking mechanism 815, a locking spring 817, first and second rectilinear or cube members 806 and 808, respectively, first, second and third brake shoes 828, 829 and 830, respectively, an annular extension spring 826 and first and second end bearing members 802 and 804, respectively. Many of the components that form assembly 800 are similar to or substantially identical to components described above with respect to a locking assembly illustrated in FIGS. 16-20 and therefore, in the interest of simplifying this explanation, will not be described again here in detail. To this end, bearing members 802 and 804 are substantially similar to bearing members 310 and 312 described above. Plungers 820 and 818 are similar to the first and second plungers 290 and 292, respectively, described above. Annular bearing rings 816 and 814 are similar to bearing rings 294 and 296 described above. Locking mechanism 815 is similar to locking mechanism 298 described above. Springs 822 and 824, as illustrated in FIG. 28, are disk springs instead of helical springs but nevertheless serve the same purpose and operated in a similar fashion to springs 286 and 288 described above (see FIG. 18 and associated description).

Rectilinear or cube members 806 and 808 are similar to cube members 306 and 308 described above with a few exceptions. First, referring to FIGS. 18 and 28, instead of including stop members 314 and 316 that form nut receiving recesses 368 and 284 and surfaces 380 and 392, assembly 800 includes nut receiving recesses 832 and 833 formed in facing surfaces of members 806 and 808 and oppositely facing surfaces of members 806 and 808 form recesses (not labeled) for receiving flanges that extend radially outward from plungers 820 and 818, respectively. Here, the nut receiving recesses 832 and 833 have a single depth and, when members 806 and 808 are mounted together so that the recesses face each other, surfaces 834 and 838 of recesses 832 and 833 are oppositely facing. In addition, instead of forming an opening for mounting locking mechanism 815 via stop members 314 and 316, an opening 819 is formed primarily by cube member 808 as best illustrated in FIG. 28. Recess 832 forms an annular internal braking surface 835.

Referring still to FIGS. 28 and 29, clutch nut 838 is generally a cylindrical rigid member having a cylindrical external surface 841 and first and second oppositely facing end surfaces 843 and 845. Nut 838 forms a central aperture 855 that extends from first end surface 843 through to second end surface 845. First end surface 843 also forms an annular recess (not labeled) that is concentric with aperture 855 for receiving first annular bearing ring 816. Similarly, second end surface 845 forms an annular recess (not labeled) for receiving threaded insert 812 and second annular bearing ring 814.

In addition, first end surface 843 forms an annular rib or plateau portion 836 that is concentric about aperture 855. Similarly, second end surface 845 forms a second annular rib or plateau portion 840 that is concentric about aperture 855.

Referring yet again to FIGS. 28 and 29, lateral surface 841 forms an inwardly extending annular recess or channel 842 proximate first end surface 843 and such that a flange 881 exists between first end surface 843 and recess 842. When so formed, recess 842 includes an outwardly facing cylindrical surface 847.

Referring still to FIGS. 28 and 29, flange 881 forms three ribs that extend into recess 842 at equispaced locations around the annular recess 842. To this end, one of the ribs is identified by numeral 844 in each of FIGS. 28 and 29. The other ribs are not illustrated in the figures although it should be appreciated that the other two ribs would be aligned with grooves 860 formed by brake shoes 828 and 829 that are described in greater detail below and that are illustrated in FIG. 29.

Referring yet again to FIGS. 28 and 29, each of brake shoes 828, 829 and 830 are similar in construction and operate in a similar fashion and therefore, in the interest of simplifying this explanation, only brake shoe 828 will be described here in detail. Shoe 828 is comprised of a rigid arc shaped powdered metal member having a substantially rectilinear cross-section formed between an outer surface 848, an inner surface 846 that faces in a direction opposite outer surface 848 and oppositely facing top and bottom surface 856 and 854, respectively. At the corner where bottom surface 854 and inner surface 846 meet, member 828 forms a recess 850. Top surface 854 forms a curved channel 852 that generally extends along the length of shoe 828. Here, the arc formed by external surface 848 mirrors the arc formed by the annular braking surface 835 of recess 832 while the arc formed by inner surface 846 mirrors the arc of annular outwardly facing surface 847 formed by nut 810. Thus, when external surface 848 is pressed up against surface 835 formed by cube member 806, external surface 848 makes substantially full contact therewith. Similarly, when inner surface 846 is pressed up against surface 847 formed by nut 810, inner surface 846 makes substantially complete contact therewith. The dimension between top surface 856 and recess 850 is such that the portion of brake shoe 828 that forms inner surface 846 is receivable within recess 842 formed by nut 810.

Referring still to FIGS. 28 and 29, in addition to forming channel 852, top surface 856 also forms a groove including a first section 860 on one side of channel 852 and a second aligned section 862 on the opposite side of channel 852 where the second groove section 862 opens between recess 852 and inner surface 846. The groove including sections 860 and 862 is formed such that, when inner surface 846 is pressed up against the annular surface 847 formed by nut 810, one of the ribs 844 is slidably receivable within the groove sections 862 and 860.

Referring to FIGS. 28 and 29, annular or loop shaped extension spring 826, as the label implies, is an annular spring that can flex radially inward and outward when force is applied thereto. Spring 826 is dimensioned such that the spring is receivable within channels 852 formed by the brake shoes 828, 829 and 830.

Referring still to FIGS. 28*a* and 29, in addition to the components illustrated, a threaded shaft and activation cable akin to shaft 282 and cable 300 illustrated in FIG. 18 would be provided where an end of the cable mounts to a distal end of locking mechanism 815 and where the threaded shaft extends through the central channel formed by assembly 800. Here, although not illustrated, threaded insert 812 forms a threaded aperture 879 so that insert 812 can be threadably received on the threaded shaft. The external or lateral surface of insert 812 is keyed to be received within the recess formed by nut 810 so that insert 812 and nut 810 are locked together during rotation about the shaft. When assembled, insert 812 and second bearing ring 814 are inserted within the central recess formed by second end surface 845 while first bearing ring 816 is received in the recess formed by first end surface 843 of nut 810. Brake shoes 828, 829 and 830 are aligned about recess 842 with the grooves (e.g., sections 860 and 862) aligned with ribs 844 and then extension spring 826 is stretched to be received within channels 52 formed by shoes 828, 829 and 830. When spring 826 is released, spring 826 forces shoes 828, 829 and 820 radially inward in the directions indicated by arrows 861 and 863 illustrated in FIG. 28 such that inner shoe surfaces 846 are forced against annular outwardly facing surface 847.

Next, referring to FIG. 28, the subassembly including rings 816 and 814, insert 812, nut 810, spring 826 and brake shoes 828, 829 and 830 is placed within recesses 832 and 833 formed by cube members 806 and 808, plungers 820 and 818 are positioned within recesses (not labeled) formed by oppositely facing surfaces of member 806 and 808, springs 822 and 824 are placed adjacent oppositely facing surfaces of plungers 820 and 818 and then end or bearing members 802 and 804 are attached to retain springs 822 and 824 and other assembly components as illustrated. Referring to FIGS. 17 and 28, member 804 is mounted to a plate akin to plate 90 to couple assembly 800 to upper column 30. Here, the dimensions of the components are such that, as in the case of the assembly illustrated in FIGS. 16-20, springs 822 and 824 effectively suspend nut 810 within the recesses formed by cube members 806 and 808 unless a table top associated with assembly 800 is either overloaded or underloaded. When nut 810 is suspended within the recesses, plateau portions 836 and 840 are separated from facing surfaces 834 and 838 formed by cube members 806 and 808 and hence cube members 806 and 808 do not restrict rotation of nut 810 and associated insert 812 about the threaded shaft. However, when a table associated with assembly 800 is either over or underloaded, one or the other of plateau portions 836 or 840 contacts an associated surface 834 or 838 and nut 810 rotation is halted.

Referring still to FIGS. 28 and 29, when nut 810 rotates about the threaded shaft, as the rate of rotation (and hence rate of table top movement) is increased, centrifugal force on shoes 828, 829 and 830 overcomes the force of extension spring 826 and shoes 828, 829 and 830 slide outwardly guided by ribs 844 and the groove sections 860 and 862. Eventually, if the rate of nut rotation exceeds a predetermine amount, external surfaces 848 of brake shoes 828, 829 and 830 contact the facing annular braking surface 835 formed by cube member 806 and the speed of nut rotation is controlled or restricted. When the table top associated with assembly 800 is either slowed or movement is halted, the centrifugal force on brake shoes 828, 829 and 830 is reduced or eliminated and therefore spring 826 again forces the brake shoes annularly inward so that external surfaces 848 of the brake shoes are again separated from the internal surface 832 formed by cube member 806.

In some embodiments, it is contemplated that the exemplary locking mechanism 298 described above may be replaced by a different type of locking mechanism including, among other components, a cone forming member that interacts with a modified nut member. To this end, an additional and modified assembly 900 is illustrated in FIGS. 31 through 34. Assembly 900 includes a braking mechanism that is similar to the braking mechanism described above with respect to FIGS. 28 through 30 and therefore, that mechanism is not again described here in detail. Here, it should suffice to say that the breaking mechanism is a centrifugal type braking mechanism that includes three (this number may be 2, 4, 5, etc. depending on designer preference and what works best in a specific application) brake shoes (two illustrated and identified by numerals 902 and 904 in FIGS. 33 and 34) that are biased into a non-braking position by an annular extension spring 906, where the brake shoes and annular extension spring are akin to the shoes 828, 829 and 830 and the spring 826 described above with respect to FIG. 29. Thus, as a clutch nut that includes components 910 rotates about a threaded shaft 912, shoes 902 and 904 are centrifugally forced outward to contact internal surfaces of an assembly housing 914 thereby slowing rotation of member 910 as well as movement of assembly 900 with respect to and along the length of shaft 912.

Figure 31:
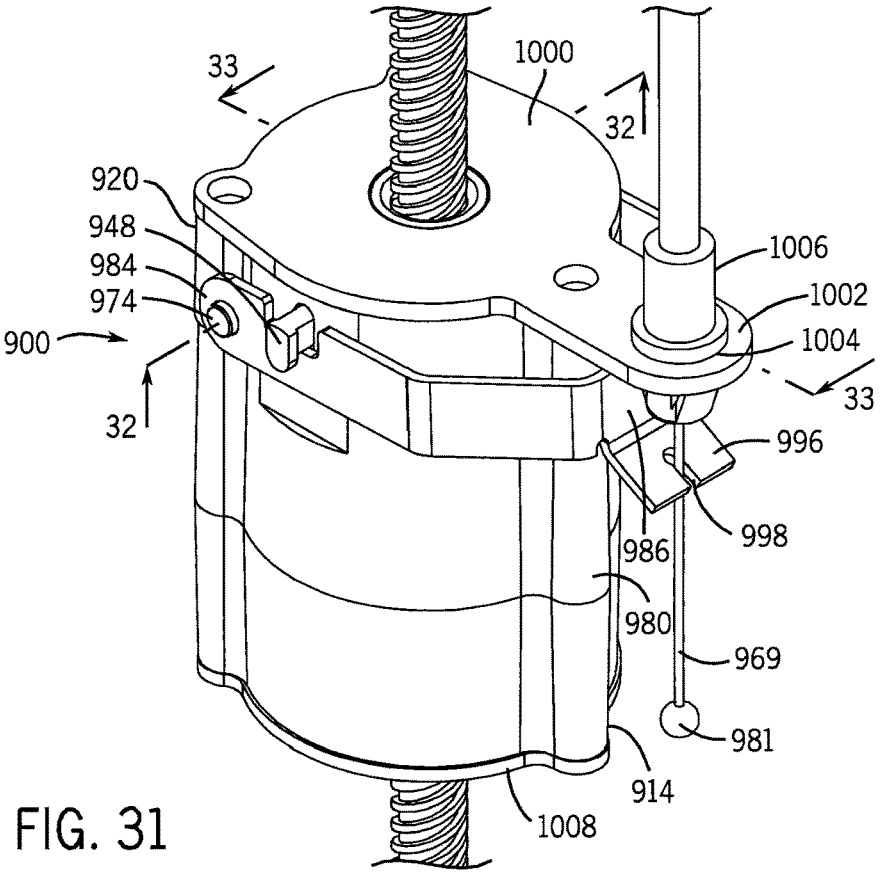
FIG. 31 is a perspective view another locking and speed governing assembly.
Figure 32:
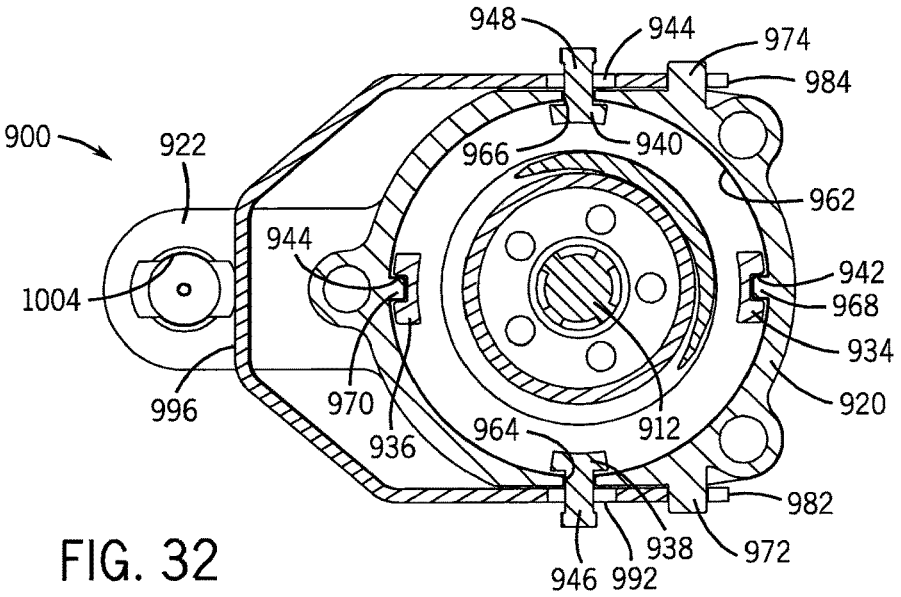
FIG. 32 is a cross-sectional view taken along the line 32-32 of FIG. 31.
Figure 33:
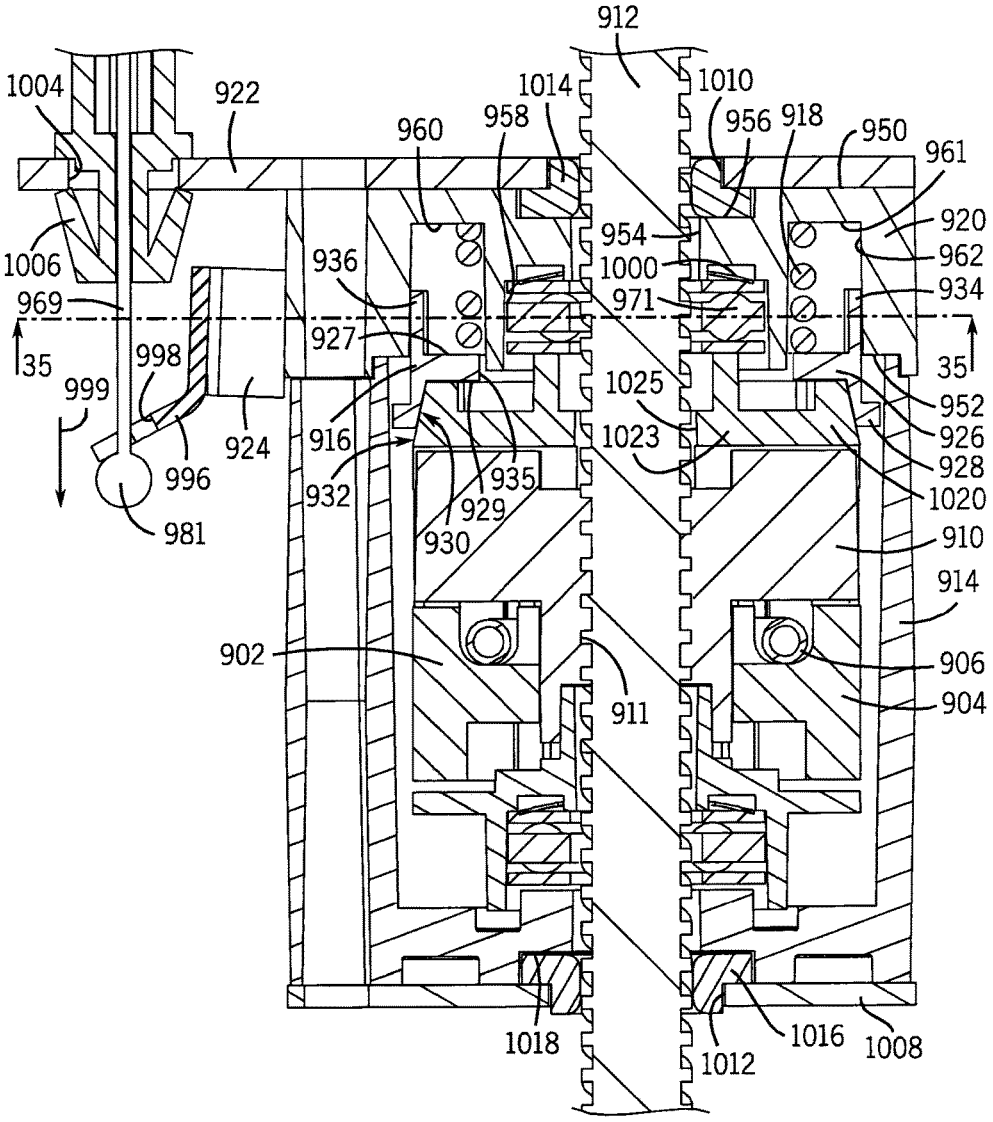
FIG. 33 is a cross-sectional view taken along the line 33-33 FIG. 31 wherein a locking sub-assembly is in a locking position.

Referring still to FIGS. 31 through 33, a significant difference between assembly 900 and assembly 800 that was described above with respect to FIGS. 28 through 30 is the locking mechanism used to lock member 910 and hence assembly 900 with respect to shaft 912. In this embodiment, assembly 900 includes a first nut member 910, a second nut member 1020, a cone member 916, a spring 918, an upper housing member 920, a lower housing assembly 914, first and second end cap members 1000 and 1008, and other components to be described hereafter.

Second nut member 1020 is securely mounted (e.g., via epoxy or mechanical fasteners) to first nut member 910 and forms an opening 1025 that is aligned with a threaded opening 911 formed by member 910 for passing shaft 912. In at least some cases, the two nut members may include complimentary keyed features so that the nut member can snap fit together to ensure sufficient torque transfer without component failure. Member 1020 forms a first frusto-conical engaging surface 932 that generally faces outward and away from member 910. An annular flange 1023 extends from member 1020 away from member 910 and circumscribes opening 1025. In at least some embodiments, member 910 that threadably mates with shaft 912 is formed of a rigid material such as Acetal (i.e., a silicon and Teflon impregnated plastic material) that is a relatively low friction material when compared to the material used to form nut member 1020. Member 1020 is, in at least some embodiments, formed of thermal plastic urethane which creates high friction when it contacts the facing surface 930 of member 916. Thus, the nut assembly including members 910 and 1020 together includes a threaded opening 911 having a surface that creates minimal friction with shaft 912 and a bearing surface 932 that creates high friction when contacting surface 930.

Referring now to FIGS. 32 and 33, locking member or cone member 916 includes a generally disk shaped member 926, an annular flange 928 and first through fourth guide extensions 934, 936, 938 and 940, respectively. As the label implies, disk shaped member 926 includes a rigid disk or washer shaped member that forms a central opening 935 for passing, among other things, shaft 912. Member 926 includes oppositely facing first and second surfaces 927 and 929, respectively. Annular flange 928 extends from second surface 929 and is generally perpendicular to a plane defined by disk shaped member 926. Annular flange 928 forms a frusto-conical internal surface also referred to herein as a second engaging surface 930. Cone member 916 and, more specifically, surface 930, are dimensioned and shaped such that surface 930 mirrors the frusto-conical external first engaging surface 932 formed by upper nut member 1020. Thus, when surface 930 contacts surface 932, essentially the entire engaging surface 930 contacts engaging surface 932. Cone member 916, like upper nut member 1020, is formed of a high-friction material (e.g., steel). Because each of members 916 and 1020 are formed of a high-friction material, when surfaces 930 and 932 contact, member 1020 is essentially locked relative to member 916.

Referring still to FIGS. 32 and 33, first through fourth guide extensions 934, 936, 938 and 940 are equispaced about the circumferential edge of disk shaped member 926 and extend from first surface 927 thereof in a direction opposite the direction in which annular flange 928 extends and generally are perpendicular to disk shaped member 926. Referring specifically to FIG. 32, each of the first and second guide extensions 934 and 936 forms a guide recess along its length. For example, first guide extension 934 forms a first guide recess 942. Similarly, second guide extension 936 forms a second guide recess 944. Third guide extension 938 forms a first lateral lift extension 946 that extends in a direction opposite fourth guide extension 940 and that is generally perpendicular to third guide extension 938. Similarly, fourth guide extension 940 includes a second lateral lift extension 948 that extends generally perpendicular to the fourth guide extension 940 and in a direction away from third guide extension 938. In this regard, see also FIG. 31 where the distal end of guide extension 948 is visible.

Referring still to FIG. 33, upper housing member 920 is a rigid and integrally formed member that, generally, includes oppositely facing first and second surface 950 and 952 and that forms a central hole or opening 954 for passing shaft 912. First surface 950 forms a recess 956 about hole 954. Second surface 952 forms an inner annular recess 958 and an outer annular recess 960. Inner annular recess 958 is formed about hole 954. Outer annular recess 960 is separated from inner annular recess 958 and includes a cylindrical interior surface 962 that is dimensioned such that the first through fourth guide extensions 934, 936, 938 and 940 are receivable generally within recess 960.

Referring to FIG. 32, cylindrical interior surface 962 forms first and second guide beads 968 and 970 on opposites sides thereof and that extend along a depth trajectory of recess 960. Beads 968 and 970 are dimensioned such that they are snugly receivable within the guide recesses or channels 942 and 944, respectively, of cone member 916. Upper housing member 920 also forms first and second guide slots 964 and 966 in opposite side portions thereof that extend along trajectories that are generally aligned with the depth of recess 960 and that open to a top edge of the housing member 920. Slots 964 and 966 are dimensioned such that the first and second lateral lift extensions 946 and 948 can extend therefrom and can slide therealong along the depth trajectory of recess 960.

Referring to FIGS. 31 and 32, upper housing member 920 also forms first and second mounting posts 972 and 974, respectively, that extend in opposite directions from an external surface and that extend, generally, perpendicular to the direction in which the first and second guide beads 968 and 970, respectively, extend. As seen in FIG. 32, posts 972 and 974 are located to one side of the first and second guide slots 964 and 966, respectively.

Referring to FIG. 33, biasing spring 918 is a helical compression spring that is dimensioned to be receivable within outer annular recess 960 formed by upper housing member 920. In this regard, when spring 918 is positioned within recess 960, one end is received on an end bearing surface 961 and the opposite end extends therefrom.

Referring to FIGS. 31 through 33, intermediate lever member 924 includes a generally U-shaped member 980 and an integrally formed cable arresting extension 996. U-shaped member 980 includes a central portion 986 and arm members that extend from opposite ends of the central portion 986 generally in the same direction to distal ends 982 and 984. Proximate the distal ends 982 and 984, member 980 forms mounting openings (not labeled) dimensioned to receive mounting posts 972 and 974. Part way along each of the arms of the U-shaped member 980, member 980 forms slots 992 and 994. The slots 992 and 994 are formed such that, when U-shaped member 980 is mounted on mounting posts 972 and 974, the slots 992 and 994 are generally aligned with the first and second guide slots 964 and 966 formed by upper housing member 920. Cable arresting extension 996 extends from central portion 986 and, in the illustrated embodiment, extends at an approximately 135° angle. Arresting extension 996 forms a central cable slot 998 that is opened to a distal edge thereof.

Referring still to FIGS. 31 through 33, top end cap 1000 is generally disk shaped, dimensioned to be received on first surface 950 of upper housing member 920 and forms a central hole 1010 for, in generally, passing shaft 910. Member 1000 includes cap extension or cable stop member 922 that is formed integral therewith, extends laterally therefrom and forms a cable hole 1004. A plastic cable guide insert 1006 is receivable within cable hole 1004.

Referring once again to FIGS. 31 through 33, to assemble the locking subassembly components described above, spring 918 is placed within outer recess 960 with the first end thereof bearing against surface 961. Cone member 926 is aligned with upper housing member 920 such that recesses 942 and 944 are aligned with beads 968 and 970. With the recesses and beads aligned, cone member 926 is placed in recess 960 with lateral lift extensions 946 and 948 received in slots 964 and 966 and distal ends thereof extend therethrough. Here, as cone member 926 is placed in recess 960, surface 927 of disk shaped member 926 contacts the second end of spring 918 and partially compresses the spring.

Next, the arms of intermediate lever member 924 can be flexed outward and mounted to mounting posts 972 and 974 with slots 992 and 994 aligned with lateral lift extensions 946 and 948, respectively. Continuing, with the components located in lower housing member 914 (i.e., the components including upper nut member 1020 and other components therebelow as illustrated in FIG. 33) assembled as illustrated in FIG. 33, a ball bearing race 971 is placed in inner annular recess 958 and upper housing member 920 can be mechanically or otherwise fastened to lower housing assembly 914 with ball bearing 971 positioned between upper housing member 920 and the distal end of flange 1023 formed by upper nut member 1020. At this point, spring 918 should bias cone member 916 toward upper nut member 1020 such that surface 930 contacts surface 932 and essentially locks the relative positions of members 1020 and 916.

Next, top end cap 1000 is mechanically or otherwise secured to first surface 950 of upper housing member 920 such that cable stop member 922 extends to one side thereof with opening 1004 generally aligned with cable slot 998 formed by cable arresting extension 996. Here, it should be appreciated that, in at least some embodiments, the same fasteners used to secure upper housing member 920 to lower housing member 914 may also be used to secure top end cap 1000 to upper housing member 920 as well as a lower cap 1008 to lower housing member 914.

Referring now to FIGS. 9 and 31, after assembly 900 has been assembled as described above, assembly 900 is mounted to a base member akin to base member 90 within an upper column akin to column 30. In this regard, assembly 900 may be mounted to a base member 90 by securing either top end cap 100 or bottom end cap 1008 to a base member 90. Next, plastic cable guide 1006 is inserted in hole 1004 and a cable 969 is fed through guide 1006. A distal end of cable 969 includes a bead 981. Adjacent bead 981, a portion of cable 969 is positioned within cable slot 998. Bead 981 is dimensioned such that, while cable 969 freely passes through slot 998, the bead 981 cannot pass through slot 998. Thus, referring to FIG. 34, as activation cable 969 is pulled upward, bead 981 contacts an undersurface of cable arresting extension 996. Although not illustrated, an opposite end of cable 996 would be secured to an activation lever or activation mechanism akin to lever 302 in FIG. 2 such that, when lever 302 is activated, bead 981 at the end of cable 969 is pulled.

Referring now to FIGS. 2, 31 and 33, when lever 302 is released, cable 969 and bead 981 move in the direction indicated by arrow 999. When bead 981 moves along trajectory 999, spring 918 expands and forces cone member 916 toward upper nut member 1020 until surface 930 contacts surface 932. When surfaces 930 and 932 contact, the high friction therebetween effectively locks the relative juxtapositions of members 916 and 1020. Referring also to FIG. 32, guide extensions 936, 938, 940 and 942 cooperate with guide beads 968 and 970 as well as guide slots 964 and 966 to restrict cone member 916 such that the cone member 916 only moves axially parallel to shaft 912 and cannot rotate thereabout. As described, housing members 920 and 914 as well as end caps 1000 and 1008 are stationary with respect to the column 30 in which they are mounted. This combined with the restricting guide extensions, guide slots and guide beads that prohibit rotation of cone member 916, mean that, when high friction surfaces 930 and 932 make contact, upper nut member 1020 is locked and cannot rotate about shaft 912.

Figure 34:
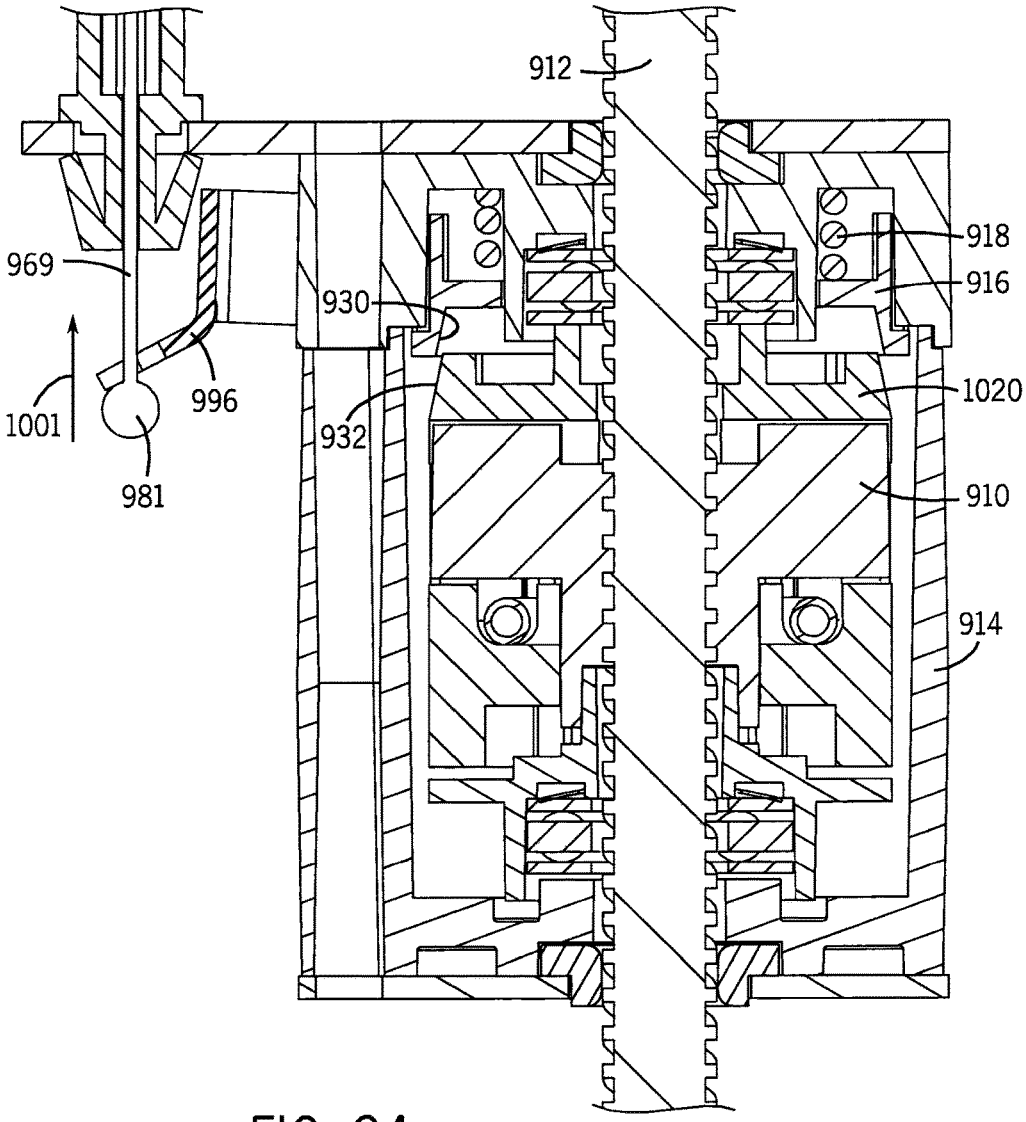
FIG. 34 is similar to FIG. 33, albeit where the locking assembly is in a released or unlocked position.

Referring to FIGS. 2, 31 and 34, when lever 302 is activated, cable 969 and bead 981 are pulled and move in the direction indicated by arrow 1001 in FIG. 34. After bead 981 contacts the undersurface of extension 996, further movement of cable 969 and bead 981 along direction 1001 causes intermediate lever member 924 to pivot upward about the mounting posts 972 and 974. When intermediate lever member 924 pivots, the edges that define slot 992 and 994 contact the lateral lift extensions 946 and 948 and force cone member 916 against the force of spring 918 until surface 930 separates from surface 932. When surfaces 930 and 932 are separated, upper nut member 1020 is no longer locked relative to cone member 916 and hence is free to rotate about shaft 912. Thus, activation of lever 302 releases the locking mechanism and allows column 30 to move either up or down with respect to column 28. When lever 302 is again released, cable 969 and bead 981 move in the direction indicated by arrow 999 in FIG. 33 and spring 918 expands once again causing cone member 916 to lock upper nut member 1020 thereby prohibiting rotation of the nut 1020, 910 about shaft 912.

Referring once again to FIG. 33, in at least some inventive embodiments, washer type inserts 1014 and 1016 are provided within annular recesses 956 and 1018 formed by the upper and lower housing members 920 and 914, respectively, that separate the housing members 920 and 914 and the end caps 1000 and 1008 from shaft 912 and help to maintain the locking and breaking assembly 900 aligned with shaft 912. Here, in at least some cases, inserts 1014 and 1016 will include urethane disk members that extend through openings 1010 and 1012 formed by cap members 1000 and 1008. The urethane members are low friction and, it has been found, are extremely resilient to wear during normal use. Inserts 1014 and 1016 may be dimensioned to contact the distal surface formed by the thread on shaft 912 to help align assembly 900 with shaft 912.

Figure 35:
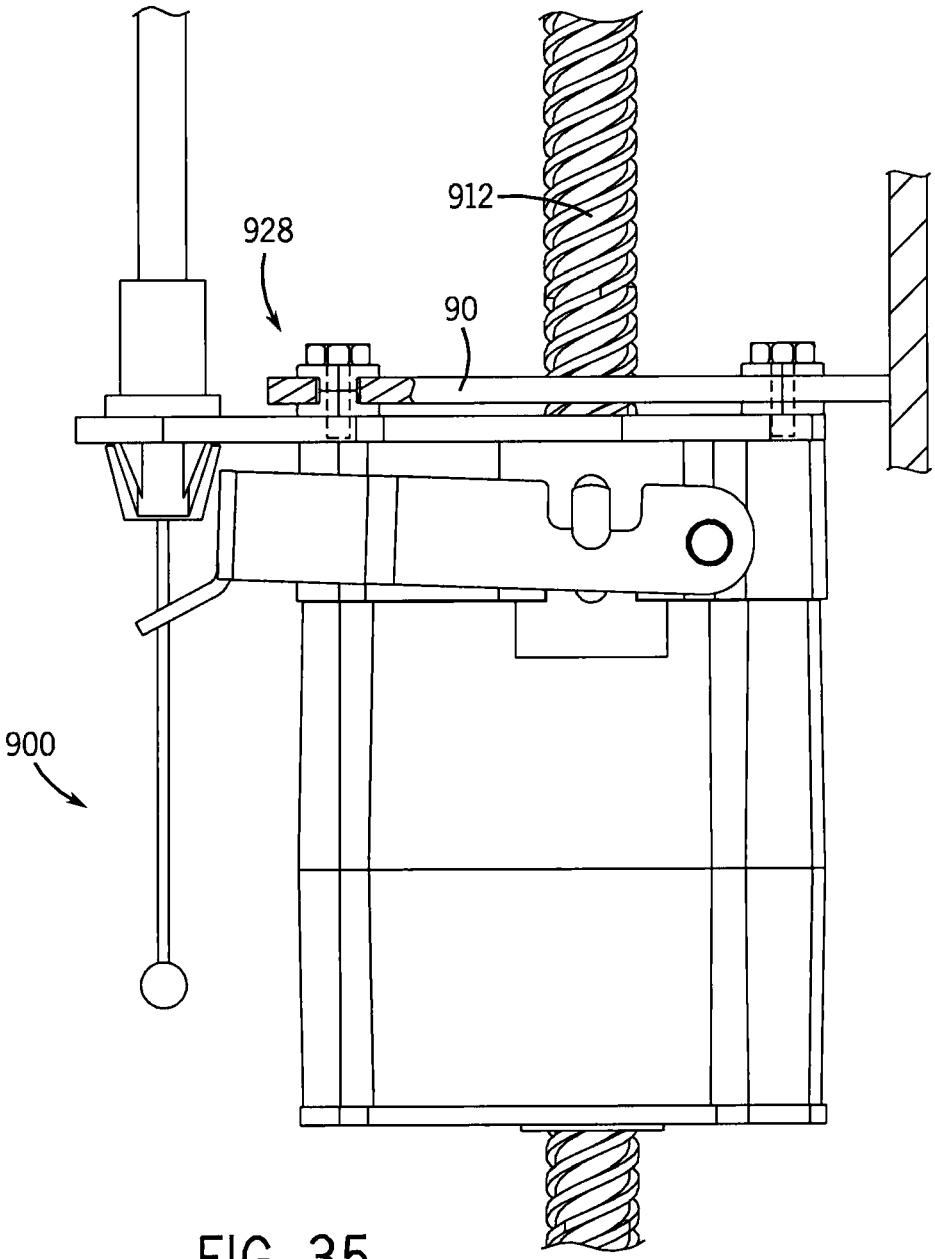
FIG. 35 is a partial cross-sectional view showing an exemplary mounting assembly for the locking assembly of FIG. 31.
Figure 36:
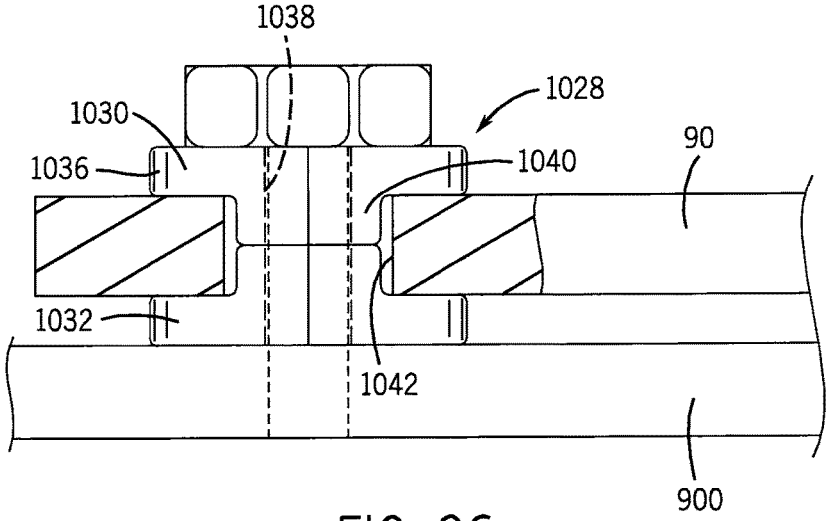
FIG. 36 is an enlarged view of a portion of the mounting sub-assembly of FIG. 35.

In at least some embodiments, it is contemplated that brake assemblies like assembly 900 described above will be mounted to base members (see, for example, member 90 in FIG. 9) via a suspension system that allows the assembly 900 to move at least slightly to accommodate nuances in the orientation of shaft 912 and movement of shaft 912 during operation. To this end, referring now to FIGS. 35 and 36, an exemplary brake assembly mounting configuration is illustrated. In the illustrated embodiment, pairs of rubber mounts are provided to insulate assembly 900 from base member 90. An exemplary rubber mount pair 1028 includes first and second similarly configured rubber mounts 1030 and 1032, respectively. Each of the rubber mounts is similarly configured and operates in a similar fashion and therefore, in the interest of simplifying this explanation, only rubber mount 1030 will be described in any detail. Mount 1030 includes a disk shaped member 1036 that forms a central opening 1038 (shown in phantom) and an axially extending flange 1040 that extends about the central opening 1038 and that is generally perpendicular to the disk shaped member 1036. As best illustrated in FIG. 36, base member 90 forms a separate aperture or hole 1042 for each mount pair (e.g., 1028). The flange 1040 of first mount 1030 is received through one side of the hole 1042 such that the disk shaped member 1036 contacts a facing surface of member 90. Similarly, the flange (not labeled) of second mount 1032 of pair 1028 is received within hole 1042 such that the disk shaped member of mount 1032 contacts the oppositely facing surface of member 90. Next, a bolt or the like is fed through the central openings (e.g., 1038) formed by the mounts 1030 and 1032 and is fastened to assembly 900. Referring still to FIGS. 35 and 36, it should be appreciated that the rubber mounts 1030 and 1032 as well as the other mount pairs completely isolate base member 90 from assembly 900.

Referring again to FIG. 9, in at least some embodiments, it is contemplated that low friction cylindrical cover members (not illustrated) may be provided to cover guide rods 78 so that friction between spring 84 and rods 78 is minimized. Similarly, although not illustrated, a low friction layer or cover member may be provided between the portions of plunger member 80 adjacent rods 78 and the rods 78 so that plunger member 80 can move along rods 78 with minimal resistance. In at least some cases, the layers or cover members may be formed of plastic.

Figure 39:
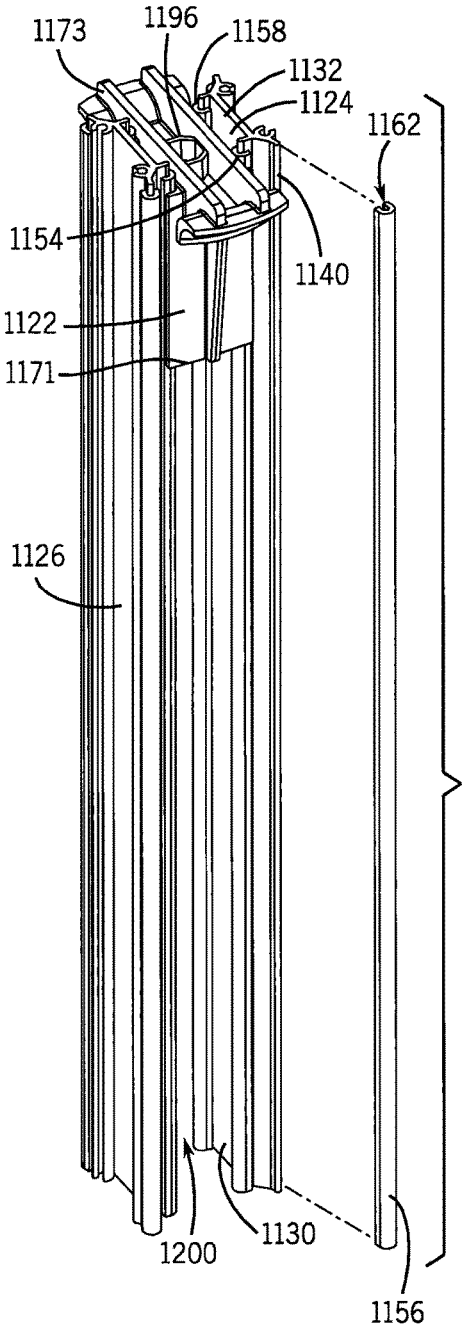
FIG. 39 is a partially exploded view of a spring guide assembly consistent with the configuration of FIG. 37.
Figure 40:
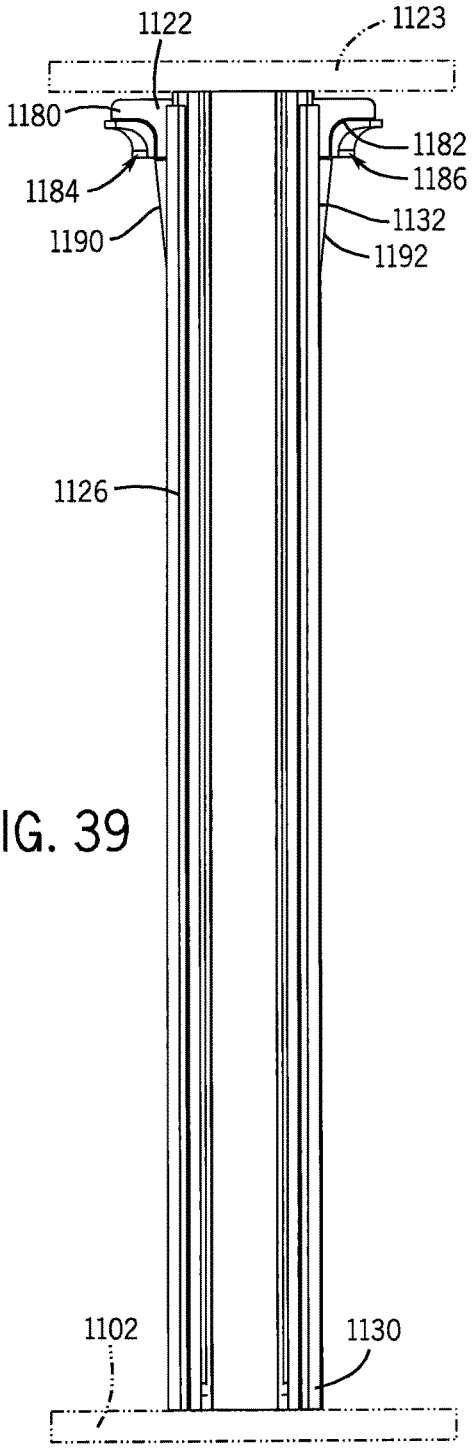
FIG. 40 is a side plan view of the guide assembly of FIG. 39.
Figure 41:
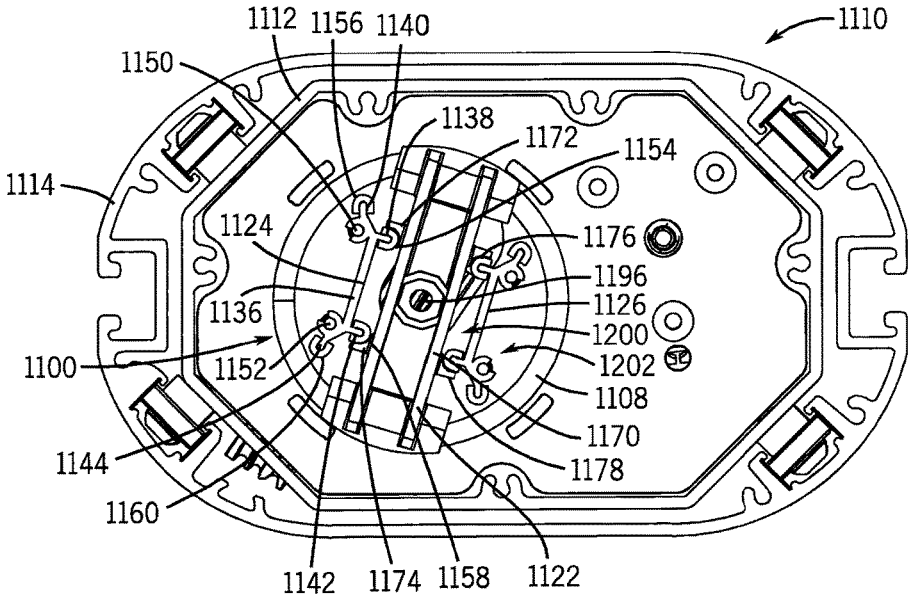
FIG. 41 is a top plan view of the guide assembly of FIG. 37 and other components mounted within an extension-like subassembly.

Referring now to FIGS. 37-41, another spring-spring guide subassembly 1100 that is similar to the assembly of FIG. 5 is illustrated. The configuration of FIGS. 37-41 includes several components that are similar to the components shown in FIG. 5 and that, in the interest of simplifying this explanation, will not be described again here in detail. To this end, a datum plate 1102 is akin to plate or base member 90 in FIG. 5 and is intended to be mounted to the inside surface of the inner/upper telescoping column or extension member 30 (see also FIG. 7). In FIG. 41, a top plan view of assembly 1100 positioned within a two column extension subassembly 1110 is shown where subassembly 1110 includes inner column 1112 and outer column 1114. In FIG. 41, datum plate 1102 is mounted to the internal surface of inner column 1112. Referring to FIGS. 5 and 37, threaded shaft 1104 is akin to shaft 282, cam pulley 1106 is akin to pulley 74, and spring 1108 is akin to spring 84. Assembly 900 has a configuration consistent with the locking assembly 900 described above with respect to FIGS. 31-36.

In addition to spring 1108, spring-spring guide subassembly 1100 includes a guide or guide subassembly 1120, a plunger or plunger member 1122 and a top plate 1123. Guide 1120 includes first and second guide members 1124 and 1126. Each of guide members 1124 and 1126 has a similar design and operates in a similar fashion and therefore, in the interest of simplifying this explanation, only member 1124 is described here in detail.

Referring specifically to FIGS. 39-41, member 1124 is an elongated rigid member that has a uniform cross section and that extends between oppositely facing proximal and distal ends 1130 and 1132, respectively. Member 1124 is, in at least some embodiments, formed via an extrusion process, although other ways of forming member 1124 are contemplated. In at least some cases member 1124 may be formed of aluminum or a rigid plastic.

Referring specifically to FIG. 41, the uniform cross section of guide member 1124 can be seen. In cross section, guide member 1124 includes a flat central shoulder member 1136 with four finger or finger-like extension members 1138, 1140, 1142 and 1144 extending therefrom. Extension members 1138 and 1140 extend from a first end of shoulder member 1136 and generally in opposite directions. In the illustrated embodiment, extension member 1138 extends perpendicular to the length of shoulder member 1136 to a distal end and member 1140 extends in a direction opposite the direction in which member 1138 extends and curves such that a distal end thereof extends along a trajectory that is slightly angled with respect to the length of shoulder member 1136. Similarly, extension members 1142 and 1144 extend from a second end of shoulder member 1136 opposite the first end and generally in opposite directions. Similar to members 1138 and 1140, extension member 1142 extends perpendicular to the length of member 1136 in the same direction as member 1138 to a distal end and member 1144 extends in a direction opposite the direction in which member 1142 extends and curves such that a distal end thereof extends along a trajectory that is slightly angled with respect to the length of shoulder member 1126. Distal ends of members 1140 and 1144 generally extend in opposite directions (e.g., an angle between trajectories of the distal ends may be between 120 and 170 degrees).

Referring still to FIG. 41, guide member 1124 also forms two connecting channels 1150 and 1152 along its length. As the label implies, connecting channels 1150 and 1152 are provided to connect ends 1130 and 1132 to other assembly components via screws.

Referring again to FIGS. 39 and 41, in addition to guide members 1124 and 1126, guide 1120 includes four cover or separator layers or members 1154, 1156, 1158 and 1160 for each of guide members 1124 and 1126 (i.e., guide 1120 includes eight separator members). As best seen in FIG. 39, exemplary separator member 1156, in at least some embodiments, is an elongated uniform U-shaped cross section channel forming member that has a length dimension (not labeled) similar to the length of guide member 1124. A channel 1162 formed by member 1156 is dimensioned to receive and friction fit on to the distal end of extension member 1140 (see FIG. 41) so that an external surface of separator member 1156 forms a substantially straight edge along the length of member 1156. Similarly, separator members 1154, 1158 and 1160 receive distal ends of extension members 1138, 1142 and 1144 via friction fits, respectively, and form external straight edges along their length dimensions. Members 1154, 1156, 1158 and 1160 are formed of rigid low friction (i.e., low friction relative to aluminum) plastic material.

Referring now to FIGS. 37-41, plunger assembly or member 1122 includes a flat rectilinear body member 1170 that has a length dimension between a strand end 1171 and a spring end 1173 that has several interesting features. First, referring specifically to FIG. 41, plunger member 1122 forms two pairs of plunger extensions, the first pair including extensions 1172 and 1174 and the second paid including extensions 1176 and 1178. Plunger extensions 1172 and 1174 extend from a first broad surface of member 1170, extend from end 1171 to end 1173, are parallel to each other and are separated by a dimension similar to the dimension defined by oppositely facing portions of extension members

1138 and 1142 (see FIG. 41). Similarly, plunger extensions 1176 and 1178 extend from a second broad surface of member 1170, extend from end 1171 to end 1173, are parallel to each other and are separated by a dimension similar to the dimension between plunger extensions 1172 and 1174.

Second, referring still to FIGS. 39 and 40, plunger member 1122 forms arm extensions 1180 and 1182 that extend in opposite directions from spring end 1173 and that form spring bearing surfaces 1184 and 1186, respectively, that face toward strand end 1171.

Third, between spring bearing surfaces 1184 and 1186 and the strand end 1171, member 1122 forms first and second ramps or ramped surfaces 1190 and 1192, respectively, that taper outward from end 1171 toward end 1173. Near surfaces 1184 and 1186 the dimension between the surfaces of ramps 1190 and 1192 is similar to the dimension formed by an internal surface of spring 1108.

Fourth, body member 1170 forms a central opening 1196 proximate end 1173 (see FIGS. 37 and 39) for securing an end of a strand (e.g., the end of strand 69 opposite end 71 in FIG. 5).

Referring to FIGS. 38 and 40, top plate 1123 is a flat rigid member. Although not illustrated, member 1123 forms holes for passing mounting screws to secure plate 1123 to distal ends of guide members 1124 and 1126 via channels 1150 and 1152 (see also FIG. 41).

Referring now to FIGS. 37-41, to assemble and mount subassembly 1100, guide members 1124 and 1126 are mounted to datum plate 1102 on a side thereof opposite cam pulley 1106 and via screws (not shown) received within ends of channels 1150 and 1152 (see FIG. 41). Here, guide members 1124 and 1126 are spaced apart so as to form a central channel 1200 with extension members 1138 and 1142 facing similarly configured extension members (not labeled) formed by guide member 1126 and forming plunger receiving rails. When so mounted, extension members 1140 and 1144 and similarly configured extension members formed by guide member 1126 extend generally away from each other so that external surfaces of separator members (e.g., 1156 and 1160) secured thereto form first through fourth straight edges along the length of guide 1120. As best seen in FIG. 41, guide members 1124 and 1126 and the separator members (e.g., 1156, 1160) are dimensioned and positioned such that, when received within a spring passageway formed by an internal surface of spring 1108, the edges formed by the separator members are very close (e.g., $1/8^{th}$ to $1/32^{nd}$) of an inch away from the adjacent spring surface at most. In addition, because of the orientations of extension members 1140, 1144, etc., the four outwardly extending extension members formed by members 1124 and 1126 are generally equispaced about the internal spring surface (e.g., may be separated by 75° to 120° and in some cases by approximately 90°).

Referring still to FIGS. 37-41, spring 1108 is placed over guide members 1124 and 1126 and is slid therealong so that members 1124 and 1126 are received within spring passageway 1202. Next, plunger member 1122 is slid into the distal end of channel 1200 strand end 1171 first with plunger extensions 1172, 1174, 1176 and 1178 receiving the rail forming facing extension members (e.g., 1138, 1142, etc.) of guide members 1124 and 1126 until spring bearing surfaces 1184 and 1186 contact an adjacent end of spring 1108. Ramp surfaces 1190 and 1192 help guide plunger member 1122 into the passageway 1202. A strand end (not illustrated) is secured to plunger member 1122 via hole 1196 and the opposite end of the strand is fed through channel 1200 and through an opening in datum plate 1102 down to cam pulley 1106. Top plate 1123 is mounted to the distal ends (e.g., 1173) of guide members 1124 and 1126 via screws received in channels 1150 and 1152 (see FIG. 41).

In operation, guide members 1124 and 1126 support and guide spring 1108 as spring 1108 is compressed so that the spring does not fold or buckle. To this end, as the spring 1108 compresses, the internal surface thereof may bear against separator members 1156, 1160, etc. but should not buckle. Importantly, separator members 1156 and 1160 minimize friction between plunger member 1122 and guide 1120. To this end, members 1156, 1160, etc., produce minimal friction when spring 1108 slides therealong because of the material used to form members 1156 and 1160.

While separator members 1154, 1156, 1158 and 1160 are shown as separate members, in at least some embodiments it is contemplated that the separator members may comprise a sprayed on or otherwise applied layer of low friction material.

Figure 42:
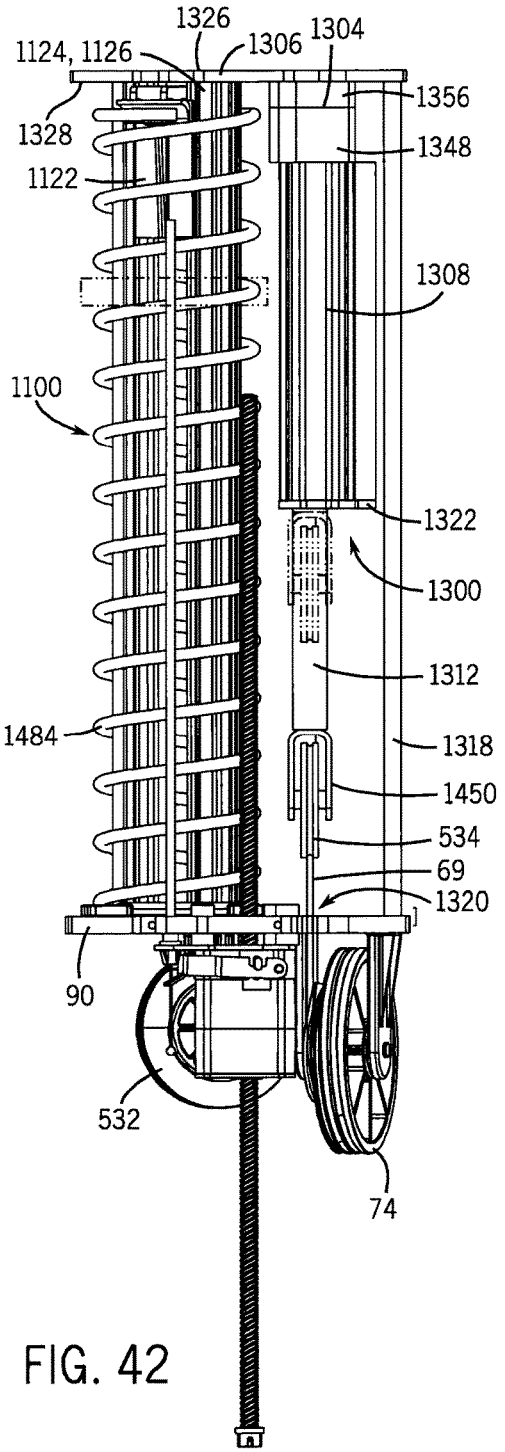
FIG. 42 is a plan view of an exemplary assembly including one embodiment of a preload force adjusting mechanism.
Figure 43:
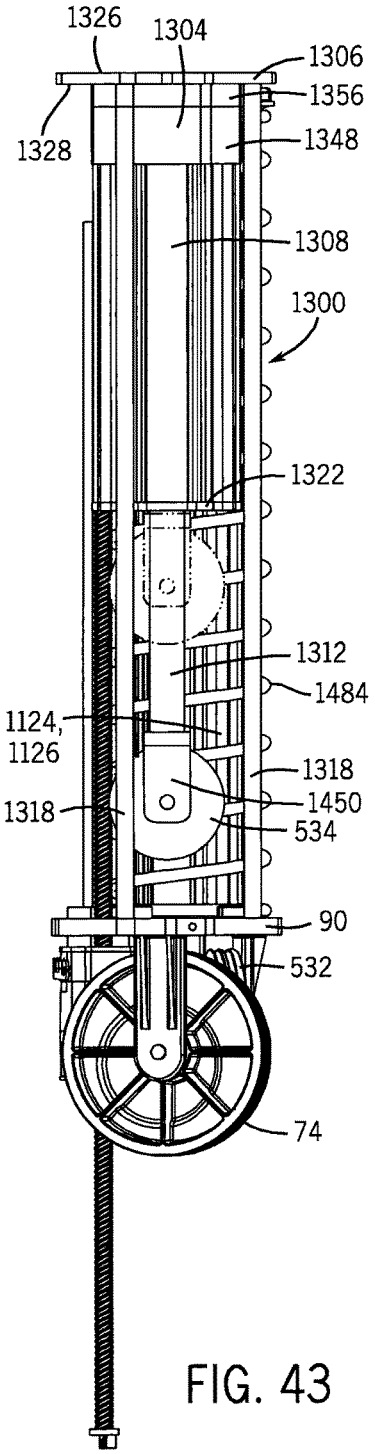
FIG. 43 is similar to FIG. 42, albeit showing a perspective view from another angle.
Figure 44:
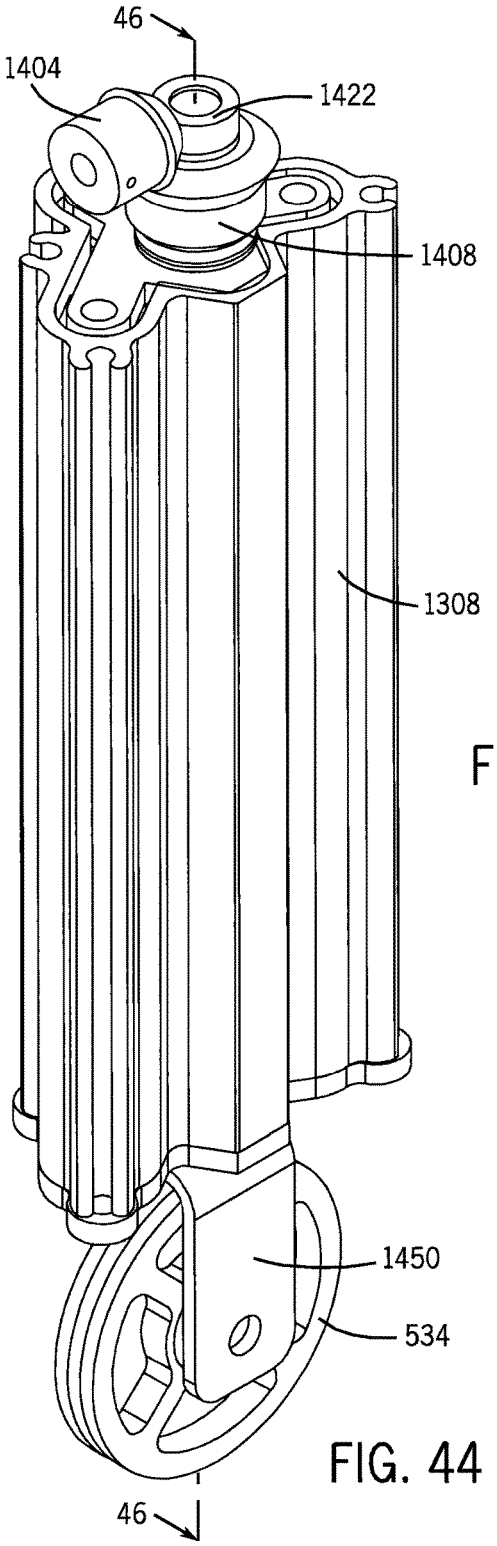
FIG. 44 is a perspective view of a portion of the preload adjustment mechanism shown in FIG. 42.

Referring now to FIGS. 42 and 43, views similar to the view of FIG. 21 are shown, albeit including an exemplary preloader/adjuster assembly 1300 for setting a preload force on a spring 1484. Referring also to FIGS. 44-48, assembly 1300 includes a gear housing 1304, a secondary datum member 1306, a guide member or guide extrusion 1308, a drive 1310, a first elongated adjustment member 1312, an adjustment pulley 534 (see again FIG. 21), an interface subassembly 1316, offsetting support rods collectively identified by numeral 1318, a stop plate 1322 and a slider assembly or structure 1460.

As seen in FIG. 42, primary datum plate 90, in this embodiment, forms, in addition to other openings to accommodate a brake assembly shaft and the strand that extends down from spring-spring guide assembly 1100, an opening 1320 to accommodate portions of strand 69 that extend down from adjustment pulley 534 to power law pulley 532 and snail cam pulley 74.

Figure 48:
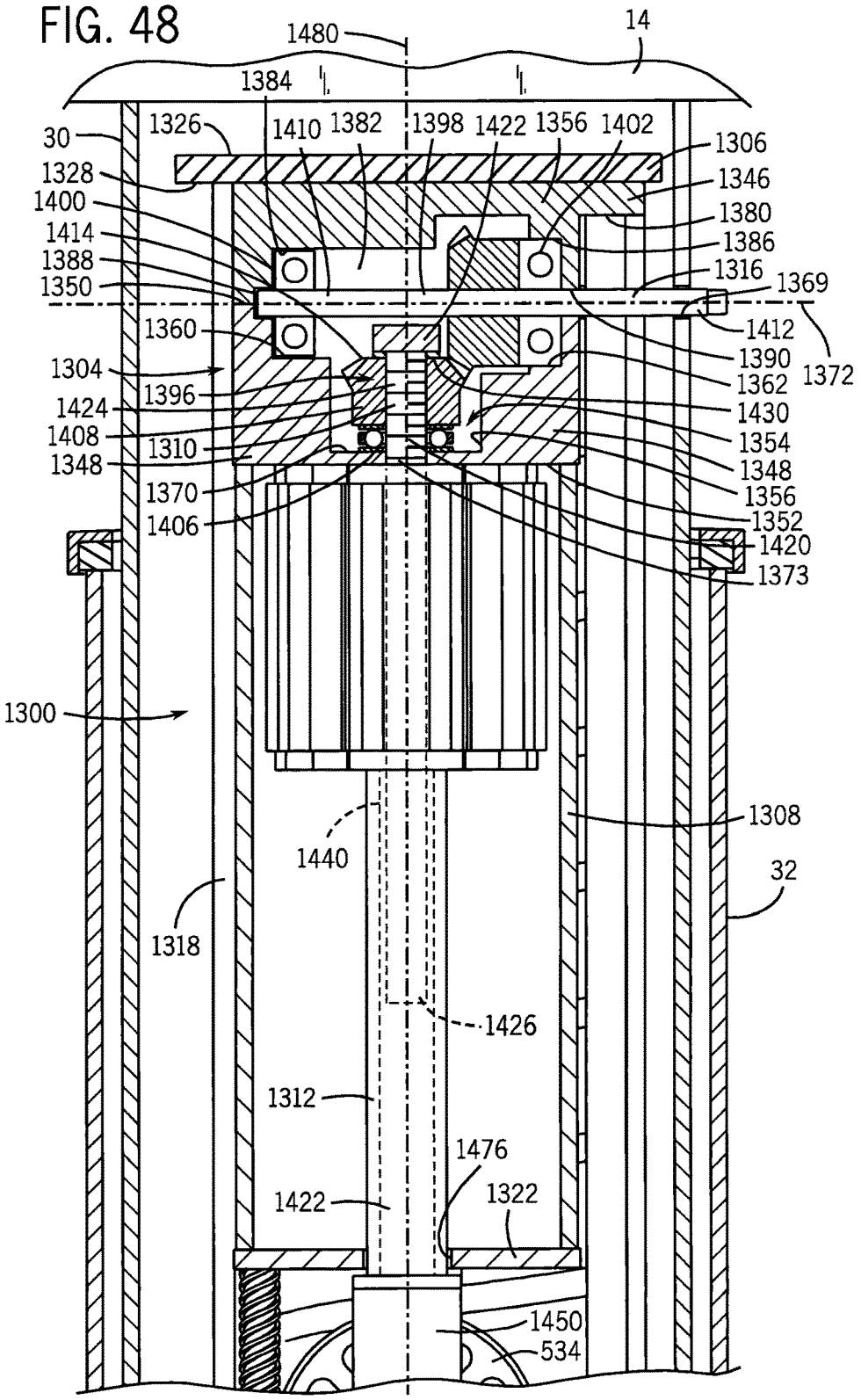
FIG. 48 is an enlarged view of a portion of the assembly of FIG. 46 including additional detail in at least one exemplary embodiment and additional table assembly components.

Referring to FIGS. 42, 43 and 48, rods 1318 are rigid elongated members that have oppositely extending first and second ends (not labeled). The rods 1318 are mounted at their first ends to primary datum plate 90 about opening 1320 and generally on an opposite side of opening 1320 from spring guide members 1124 and 1126, extend upward from plate 90, are substantially parallel to each other and to members 1124 and 1126 and have length dimensions that are substantially identical to the length dimensions of members 1124 and 1126. Secondary datum plate 1306 is mounted to the second or top ends of rods 1318 and to the top ends of spring guide members 1124 and 1126 and is generally parallel to primary datum plate 90. Secondary datum plate 1306 is a rigid flat member and has first and second oppositely facing surfaces 1326 and 1328, respectively. In addition, although not labeled, plate 1306 forms openings for passing screws to mount plate 1306 to rods 1318 and guide members 1124 and 1126 and to mount housing 1304 to plate 1306.

In this embodiment, second datum plate 1306 in FIGS. 42 and 43 takes the place of top plate 1123 in the previously described embodiment shown in FIGS. 38 and 40 to stabilize the top ends of guide members 1124 and 1126. In at least some embodiments rods 1318 will be dimensioned such that they extend within a few inches of the undersurface of a supported table top 14 so that second datum plate 1306 is only separated from the undersurface of the top member by less than one inch.

Referring to FIGS. 42-44 and 48, gear housing 1304 is generally a cube shaped assembly including first and second clam-shell type members 1356 and 1348, respectively. Second housing member 1348 includes oppositely facing top and bottom surfaces 1350 and 1352, respectively, and forms a complex cavity 1354 that is recessed into top surface 1350 (see FIG. 48 for cavity detail). Cavity 1554 includes a cylindrical portion 1356, first and second semicylindrical portions 1360 and 1362, respectively, and first and second dowel portions 1364 and 1366, respectively. Cylindrical portion 1356 is formed about an adjustment axis 1480 (see FIG. 48) that is perpendicular to first surface 1350 and is terminated by an internal bearing surface 1370. First and second semicylindrical portions 1360 and 1362 are formed in surface 1350 on opposite sides of cylindrical portion 1356 and share a common gear axis 1372. First and second dowel portions 1364 and 1366 are formed in surface 1350 on opposite sides of semicylindrical portions 1360 and 1362 about gear axis 1372. Second dowel portion 1366 opens laterally through one side surface 1376 (see FIG. 48) of housing member 1348. In addition to forming recessed cavity 1354, second housing member 1348 forms an opening 1373 (see FIG. 48) that passes centrally through internal bearing surface 1370 to bottom surface 1352.

Referring still to FIG. 48, first housing member 1346 includes top surface (not labeled) and an oppositely facing bottom surface 1380 and forms a complex cavity 1382 that is recessed into bottom surface 1380. Cavity 1382 includes first and second semicylindrical portions 1384 and 1386 and first and second dowel portions 1388 and 1390. First and second semicylindrical portions 1384 and 1386 are formed in surface 1380 so as to be adjacent first and second semicylindrical portions 1360 and 1362 of member 1348, respectively, when member 1346 is secured to member 1348 so that portions 1384 and 1360 together form a cylindrical cavity formed about gear axis 1372 and portions 1386 and 1362 together form another cylindrical cavity about gear axis 1372. First and second dowel portions 1388 and 1390 are formed on opposite sides of portions 1384 and 1386 and portion 1390 opens laterally through one side surface (not labeled) of housing member 1348. When first housing member 1346 is secured to second housing member 1348, dowel portions 1388 and 1390 are adjacent dowel portions 1364 and 1366 (see FIG. 45) so that two reduced radius dowel receiving/supporting cylindrical cavities are formed where one of the cavities formed by portions 1366 and 1390 opens through a side of the combined housing assembly.

Referring still to FIG. 48, interface subassembly 1316 includes a first adjustment coupler 1396, an interface shaft 1398, first and second support ball bearing races 1400 and 1402, respectively, and a second adjustment coupler in the form of a bevelled gear 1404. First adjustment coupler 1396 includes a ball bearing race 1406 and a second bevelled gear 1408. Gear 1408 has a first surface 1414 and an oppositely facing second surface (not labeled) where the bevelled teeth 1416 of gear 1408 are formed between a lateral gear side surface and first surface 1414. First surface 1414 is referred to herein as a first coupling surface. In at least some embodiments gears 1408 and 1404 are formed of powdered metal. Each of race 1406 and gear 1408 form central openings (not labeled) and are dimensioned to fit with clearance within cylindrical portion 1356 of cavity 1354 with race 1406 sandwiched between internal bearing surface 1370 and bevelled gear 1408 and with the first surface 1414 of gear 1408 exposed and facing out of cylindrical cavity portion 1356. When race 1406 and gear 1408 are so positioned, the central openings formed by race 1406 and gear 1408 are aligned within opening 1373 formed in second housing member 1348.

Races 1400 and 1402 are dimensioned to be received within the cavities formed by semicylindrical cavity portions 1360 and 1388 as well as 1362 and 1390, respectively. Interface shaft 1398 is an elongated rigid shaft having internal and external ends 1410 and 1412, respectively. Shaft 1398 is linked to the internal portions of races 1400 and 1402 and extends from internal end 1410 that is received in the first reduced radius dowel supporting cavity formed by cavity portions 1364 and 1388 to the external end 1412 which extends from the second reduced radius dowel supporting cavity formed by cavity portions 1366 and 1390. At external end 1412, shaft 1398 is shaped to interface with a force adjustment tool (e.g., the head of a Phillips screwdriver, a hex-shaped wrench, etc.). Gear 1404 is mounted to shaft 1398 adjacent race 1402 and between races 1400 and 1402 so that the teeth formed by gear 1404 are aligned with the bevelled tooth surface formed by gear 1408. Thus, when shaft 1398 is rotated about gear axis 1372, gear 1404 rotates which in turn rotates gear 1408.

Referring again to FIGS. 42-48, drive 1310 includes a second adjustment member 1420 and a second adjustment coupler 1422 in the form of a disk member. Adjustment member 1420 is an elongated rigid shaft that extends between first and second ends 1424 and 1426, respectively. Disk member 1422 is secured to (e.g., welded) or integrally formed with shaft 1420 at first end 1424 and forms a second coupling surface 1430 that is generally perpendicular to the length dimension of shaft 1420 and that faces in the direction that shaft 1420 extends. Shaft 1420 has a cross sectional dimension such that shaft 1420 can pass through the openings formed by race 1406, gear 1408 and second housing member 1348 (see 1373). Disk member 1422 is radially dimensioned such that member 1422 cannot pass through the openings formed by gear 1408, race 1406 and member 1348. Along its length, shaft 1420 is threaded.

Figure 46:
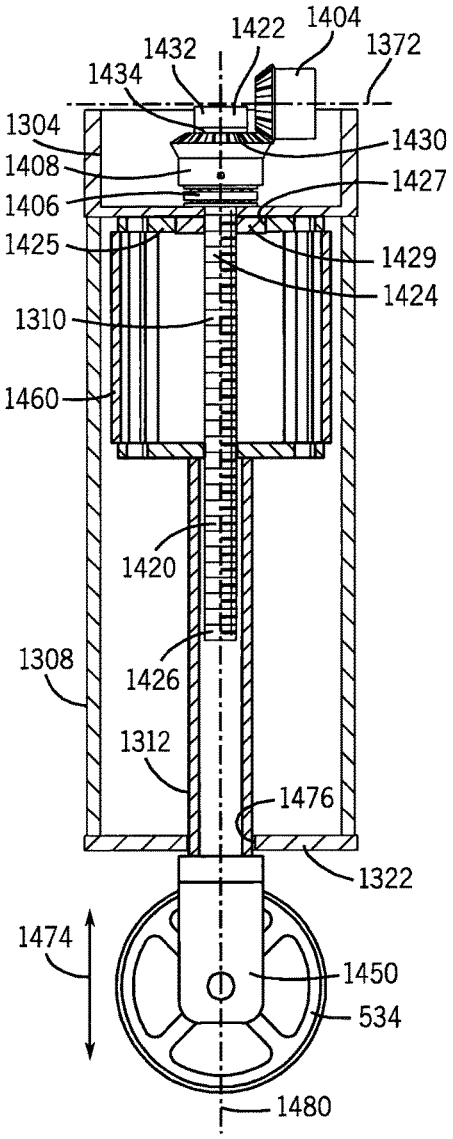
FIG. 46 is a partial cross-sectional view taken along the line 46-46 of FIG. 44.

Referring to FIG. 46, in at least some embodiments, disk member 1422 is formed of two components including a steel collar 1432 and a washer shaped bronze bushing 1434 secured (e.g., welded, adhered, etc.) thereto such that the second coupling surface 1430 has a bronze finish. Here, bronze has been selected so that when coupling surfaces 1430 and 1414 contact, a suitable coefficient of friction (e.g., 0.05 to 0.5 and in at least some cases 0.1) results as will be explained in more detail below.

Referring to FIGS. 42-48, guide member 1308 is mounted to the undersurface 1352 of housing member 1348 (e.g., via screws) so as to be aligned with opening 1372 and extends generally perpendicularly to surface 1352. In the illustrated embodiment, guide member 1308 is approximately half as long as rods 1318 so that a distal end of guide member 1308 is separated from primary datum plate 90 (see FIG. 42). Guide member 1308 forms a keyed guide passageway 1332 (see FIG. 45) that extends along the entire length of member 1308. An internal surface 1334 of passageway 1332 forms three channels 1336, 1338 and 1340 along its length that are approximately equispaced about member 1308 when member 1308 is viewed in cross section. In at least some embodiments member 1308 may be formed of aluminum. In all embodiments member 1308 is rigid.

Referring again to FIGS. 42-48, first elongated adjustment member 1312 is an elongated rigid member that extends between first and second ends 1440 and 1442, respectively. At second end 1442, a clevis 1450 mounts adjustment pulley 534 to member 1312. Member 1312 or a surrounding or attached structure that is secured to member 1312 forms an external surface that defines at least one and in some cases several laterally extending guide members configured to compliment guide channels 1336, 1338 and 1340 formed by the internal surface 1334 of guide member 1308. In the illustrated embodiment slider assembly or structure 1460 is secured to end 1440 of member 1312 and includes an external surface 1458 that forms three guide members 1452, 1454 and 1456 that compliment channels 1336, 1338 and 1340, respectively. Low friction plastic separator members 1464, 1466 and 1468 are provided that friction fit or otherwise attach over members 1452, 1454 and 1456, respectively to, as the label implies, separate surrounding structure 1460 from the channel forming surface of keyed passageway 1332 so that friction between structure 1460 and surface 1334 is minimized. With structure 1460 secured to member 1420, guide members 1452, 1454 and 1456 restrict rotation of member 1312.

Figure 47:
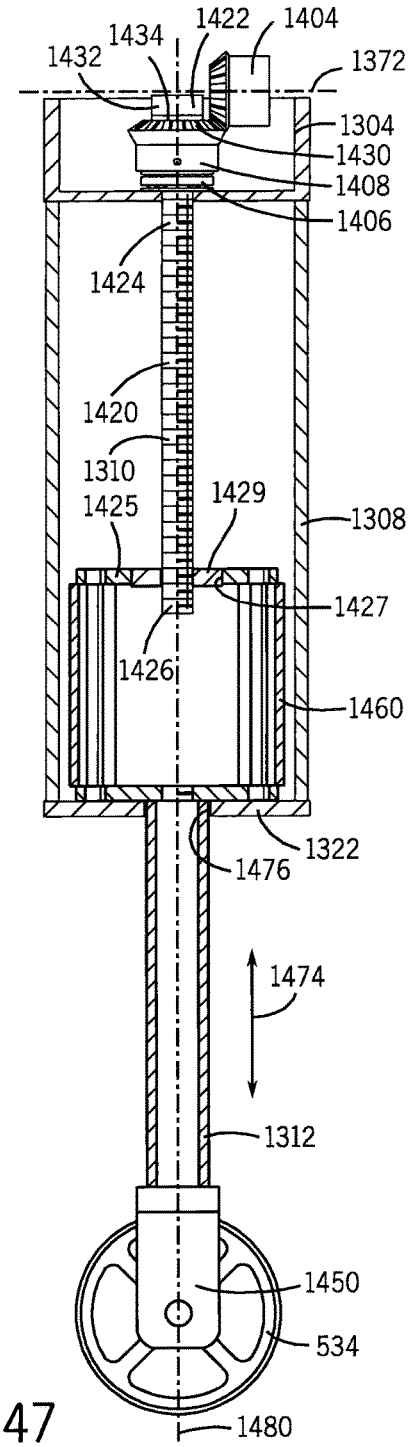
FIG. 47 is similar to FIG. 46, albeit illustrating the assembly in an extended configuration.

Referring specifically to FIGS. 46 and 47, in the illustrated embodiment, an end plate 1425 at an end of structure 1460 opposite member 1312 forms a central opening 1427 in which a nut 1429 (e.g., ½ inch) is securely received. Nut 1429 has a thread suitable for mating with threaded shaft 1420.

Stop plate 1322 is a rigid flat plate that forms a generally central opening 1476 to pass member 1420 and apertures (not labeled) for mounting plate 1322 to the distal end of guide member 1308.

Referring again to FIG. 48, column 30 forms an opening 1369 for passing distal outer end 1412 of shaft 1398.

To assemble assembly 1300, referring to FIG. 48, race 1406 and gear 1408 are positioned within cylindrical cavity portion 1356 of second housing member 1348. Bronze bushing 1434 is installed. Threaded shaft 1420 is fed through the openings formed by race 1406 and gear 1408 and opening 1373 formed by housing member 1348 so that second end 1426 of shaft 1420 extends past second surface 1352. Shaft 1398, races 1400 and 1402 and gear 1404 are assembled and positioned within other portions of cavity 1354 as illustrated with teeth of gear 1404 meshing with teeth of gear 1408 and so that external end 1412 of shaft 1398 extends out side 1376. First housing member 1346 is aligned with and secured to second housing member 1348 via screws or bolts.

Continuing, structure 1460 is fed onto end 1426 of shaft 1420 via nut 1429 with member 1312 extending away from housing 1304. Guide member 1308 is positioned so that channels 1336, 1338 and 1340 are aligned with guide members 1452, 1454 and 1456, respectively. Member 1308 is moved toward structure 1460 so that the guide members mate with the channels and is moved up against the undersurface 1352 of housing 1304. Guide member 1308 is fastened (e.g., via screws) to the undersurface 1352 to extend therefrom. Stop plate 1322 is slid onto end 1442 of member 1312 and is secured via screws to the end of guide member 1308 opposite housing 1304. Clevis/pulley 534 is secured to end 1442 of member 1312.

Next, referring again to FIGS. 42 and 43, rods 1318 are secured to datum plate 90 to extend parallel to each other and parallel to spring guide members 1124 and 1126 and perpendicular to plate 90. The subassembly including housing 1304 and components therein, guide member 1308, structure 1460, member 1312 and pulley 534 is mounted to surface 1328 of second datum plate 1306 by securing the top surface of housing member 1356 to surface 1328 via screws or otherwise.

Plate 1306 is mounted to the top ends of rods 1318 and guide members 1124 and 1126 with the assembly 1304, 1308, 1460, 1312 and 534 extending toward datum plate 90 via screws or otherwise.

Finally, strand 69 (e.g., a cable) is fed from one end that is attached to spring plunger 1122 down about power law pulley 532, up and around adjustment pulley 534, down again and around snail cam pulley 74 and then up to the outer column 32 where the other end is attached.

In operation, referring again to FIGS. 42-48, the vertical position of pulley 534 within column 30 is adjustable to adjust a preload force applied to the spring-spring guide assembly 1100 by rotating interface shaft 1398. To this end, when shaft 1398 is rotated, gear 1404 causes gear 1408 to rotate. When gear 1408 rotates, friction between coupling surfaces 1414 and 1430 causes disk 1422 and integral shaft 1420 to rotate about adjustment axis 1480. Because surrounding structure 1460 restricts rotation of member 1312, member 1312 is forced axially along axis 1480 as shaft 1420 rotates and the position of pulley 534 is changed (i.e., pulley 534 moves either upward or downward) along the trajectory indicated by arrows 1474 in FIGS. 46 and 47. In FIGS. 42 and 43, pulley 534 is illustrated in an extended position and in phantom in a retracted position. In the extended position the preload force is minimized and in the retracted position the preload force is maximized. Intermediate positions are contemplated.

When the top or bottom of structure 1460 reaches a facing surface of either housing 1348 (e.g., surface 1352) or plate 1322, a limit to member 1312 movement is reached. At the limit, member 1312 no longer moves further along axis 1480. Here, to prevent damage to assembly 1300 components, a type of clutch is formed by disk 1422 and gear 1408. To this end, when the force between coupling surfaces 1414 and 1430 is below a threshold level, friction between surfaces 1414 and 1430 causes disk 1422 to rotate with gear 1408. However, when a limit is reached and structure 1460 cannot move further, the force between surfaces 1414 and 1430 exceeds a threshold and slippage occurs. Here, it has been found that a suitable coefficient of friction (e.g., 0.05 to 0.5 and in at least some cases approximately 0.1) between surfaces 1414 and 1430 results when one of the surfaces is bronze and the other is formed via powered metal.

In at least some embodiments it is contemplated that a preloading configuration similar to the configuration described above with respect to FIGS. 42-48 may include a force level indicator subassembly to, as the label implies, indicate a current preload force level. To this end, referring to FIG. 49 and also to FIGS. 50-52, a guide member 1500 and structure 1502 that are similar to member 1308 and structure 1460 described above in FIG. 45, respectively, are illustrated. Here, the difference is that member 1500 and structure 1502 include features that facilitate preload indication.

Figure 49:
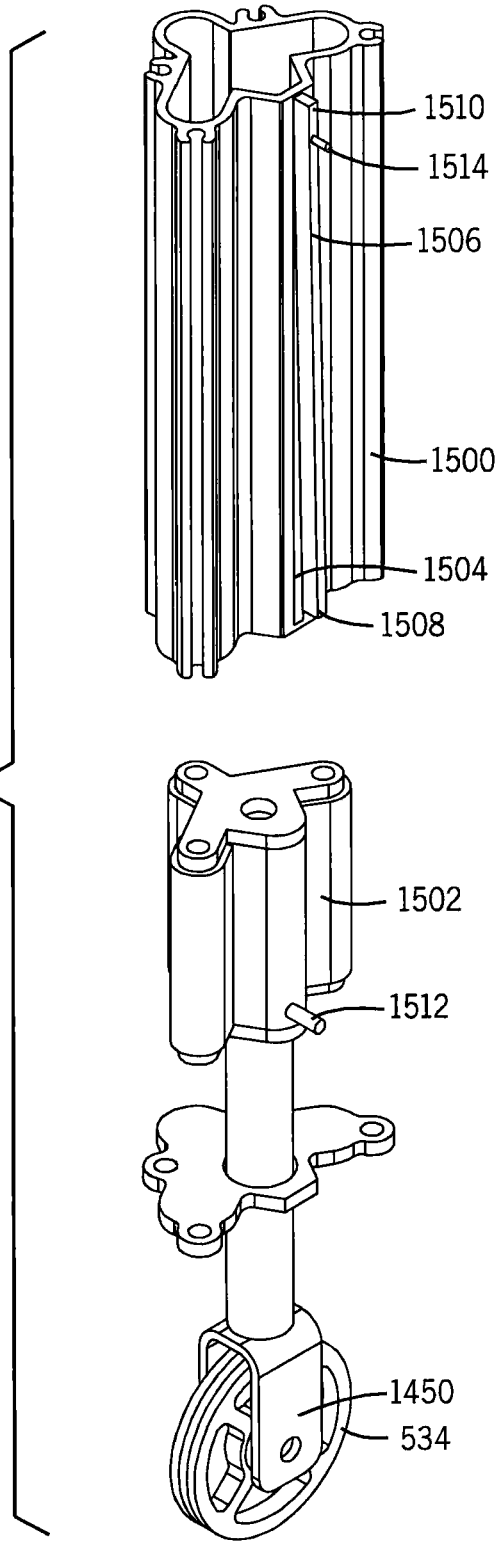
FIG. 49 is a view similar to the view FIG. 45, albeit illustrating a subset of the components shown in FIG. 45 where an indicator mechanism arm assembly is included.

In FIG. 49, guide member 1500 forms a slot 1504 (see also in phantom in FIGS. 50 and 51) along a portion of its length and includes an elongated indicator arm 1506 is mounted at a first end 1508 to the lower end of member 1500 so that arm 1506 extends generally along slot 1504 to a second end 1510 adjacent a top end of member 1500.

Figure 50:
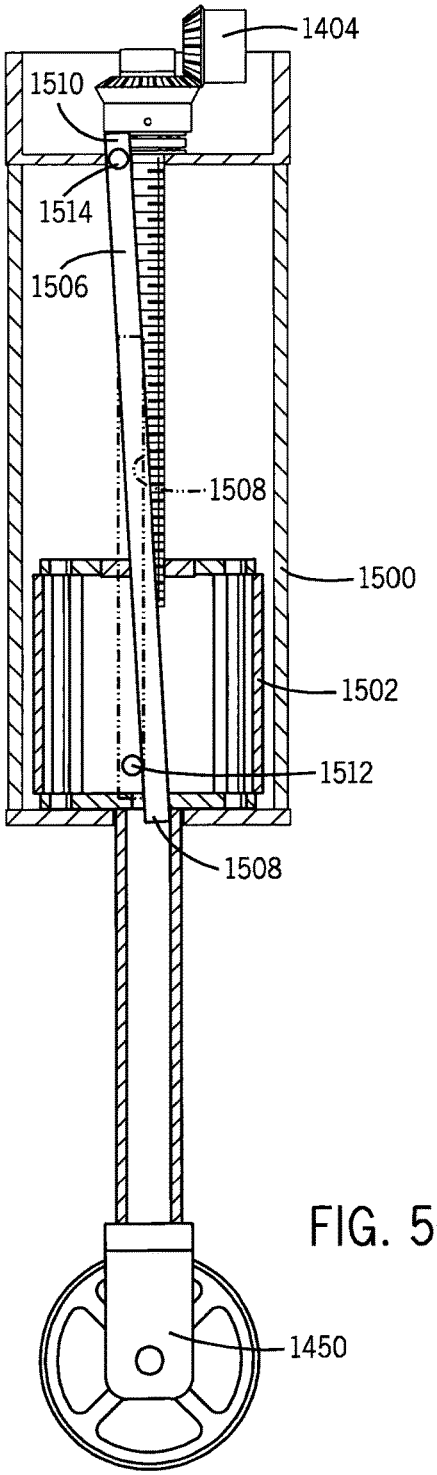
FIG. 50 is similar to FIG. 47, albeit illustrating the configuration that includes the indicator mechanism of FIG. 49 in schematic.

Arm 1506 may be a leaf spring type arm or a rigid arm that is spring biased into a normal position. When in the normal or low force position, as best seen in FIG. 50, arm 1506 is angled across slot 1504 so that ends 1508 and 1510 are on opposite sides of the slot. An indicator pin 1514 extends from second arm end 1510.

Referring to FIGS. 49 and 50, a pin 1512 extends from a bottom end of structure 1502 from a location such that, when structure 1502 is received within the channel formed by member 1500, pin 1512 is generally aligned with and extends through slot 1504.

Figure 51:
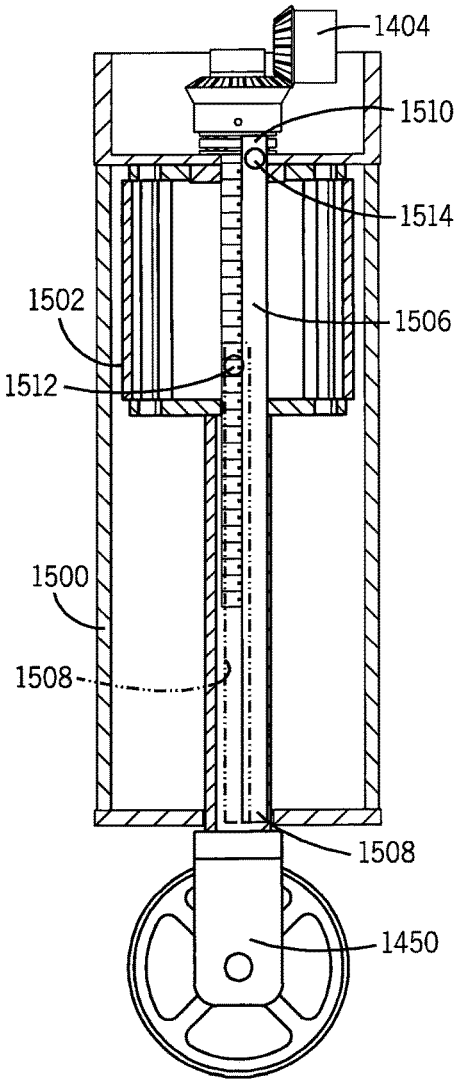
FIG. 51 is similar to the view of FIG. 46, albeit illustrating the configuration that includes the indicator mechanism of FIG. 49 in schematic.
Figure 52:
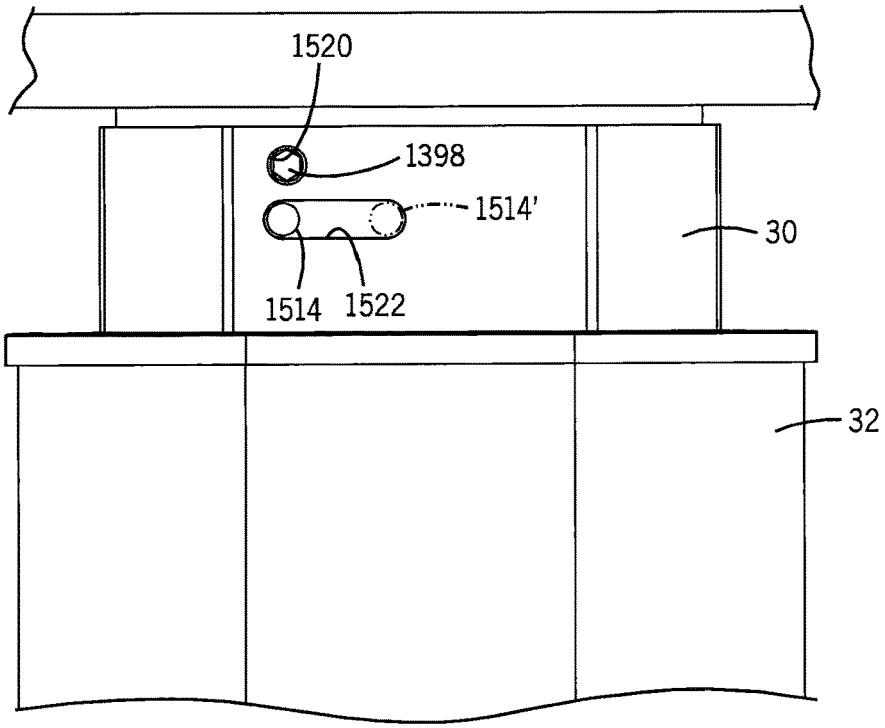
FIG. 52 is a partial view of a table assembly that includes an adjustment mechanism and an indicator mechanism consistent with the embodiments described above with respect to FIGS. 42-50.

Referring still to FIG. 49 and also to FIG. 50, when structure 1502 and hence pulley 534 are in the extended low preload force position, pin 1512 is near the low end of arm 1506 and does not appreciably affect the position of second arm end 1510. As structure 1502 is raised toward the retracted high preload force position, pin 1512 applies a force to arm 1506 forcing end 1510 to the right as illustrated in FIG. 51. Thus, the location of second arm end 1510 and associated indicator pin 1514 can be used to determine the position of structure 1502 and pulley 534 within the column structure and hence to determine the relative strength of the preload force applied to the spring assembly 1100. In FIGS. 49-51, the relative positions of arm member 1506 and slot 1508 are different showing that various locations about the structure and guide member are contemplated. In at least some embodiments arm member 1506 and slot 1508 will be located below gear 1404 so that the indicator pin 1514 extends just below the outside end 1412 of the adjustment shaft 1398 (see again FIG. 48) so that as a table user adjusts the force, the user can easily see the current force level. To this end, see FIG. 52, where a side view of a table assembly including the indicator components and preload adjustment mechanism described above is shown where openings 1520 and 1522 are provided for the distal ends of shaft 1398 and indicator pin 1514, respectively. In FIG. 52, pin 1514 is shown in the low preload force position and in phantom 1514' in the high preload force position.

Other types of clutch and indicator subassemblies are contemplated. To this end, another slider assembly or structure 1600 that includes a clutch mechanism is illustrated in FIGS. 53 through 57. In FIG. 57, assembly 1600 is shown as part of a larger adjustment assembly 1601 that, in addition to slider assembly 1600, includes a gear housing 1604 and associated components, a threaded drive shaft 1608, an extruded or otherwise formed second guide member 1602, an extension member 1612, a lower end cap 1613 and a clevis/pulley 1614. Many of the components illustrated in FIGS. 53-57 are similar to the components described above with respect to FIGS. 42-52 and therefore will not again be described here in detail. To this end, assembly 1600 is positioned within an appropriately configured guide member 1602 that is in turn mounted to the undersurface of a gear housing generally identified by label 1604. In this embodiment, like the embodiment described above with respect to FIGS. 42 through 52, bevelled gears 1605 and 1606 within housing 1604 are used to drive threaded shaft 1608 which in turn causes a nut 1610 and associated slider structure 1600, member 1612 and clevis/pulley 1614 to move upward or downward with respect to housing 1604 as indicated by arrow 1616 in FIG. 57.

Referring still to FIGS. 53-57, one primary difference between assembly 1601 and assembly 1300 (see FIGS. 42-52) described above is that, while assembly 1300 includes a slipping clutch mechanism in a gear housing (i.e., in FIGS. 42-52, shaft 1310 is not secured to gear 1404), in assembly 1601, shaft 1608 is secured to and rotates with gear 1606 and a clutching action is performed by components within assembly 1600.

Referring to FIGS. 53-57, to facilitate the clutching action as well as to perform other functions, slider assembly 1600 includes a slider shell or external structure, also referred to as a first guide member 1620, nut 1610, a lever member 1624, two biasers or springs 1626 and 1628, slider end caps 1630 and 1632, two radial bearings 1634 and 1636 and two axial or thrust bearings 1638 and 1640.

Figure 53:
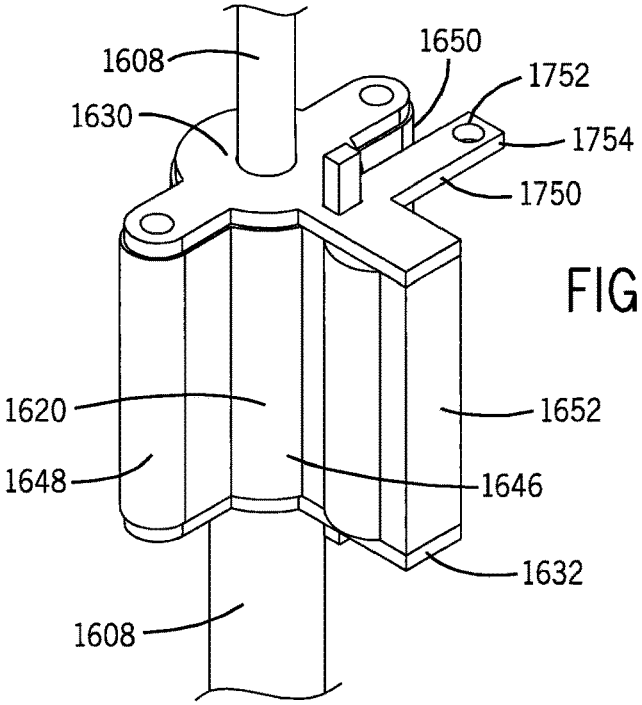
FIG. 53 is a perspective of a slider subassembly including a guide member similar to the guide or slider subassembly shown in FIG. 49.
Figure 54:
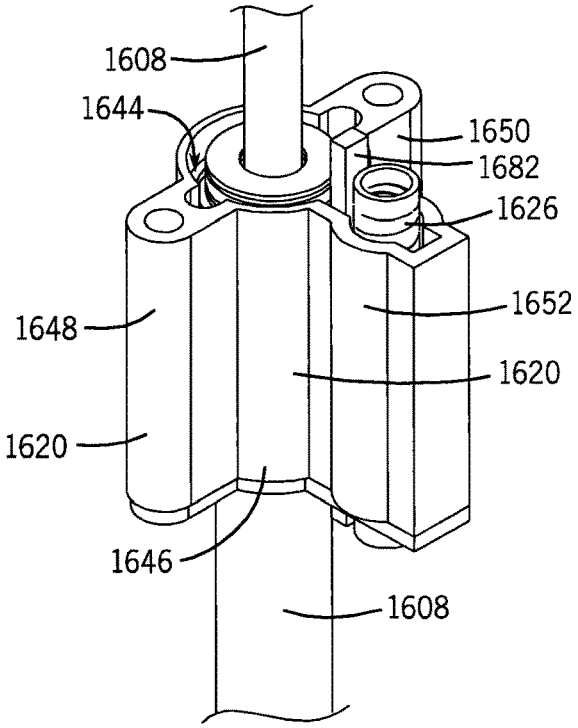
FIG. 54 is similar to FIG. 53, albeit showing the assembly with a top member removed.
Figure 55:
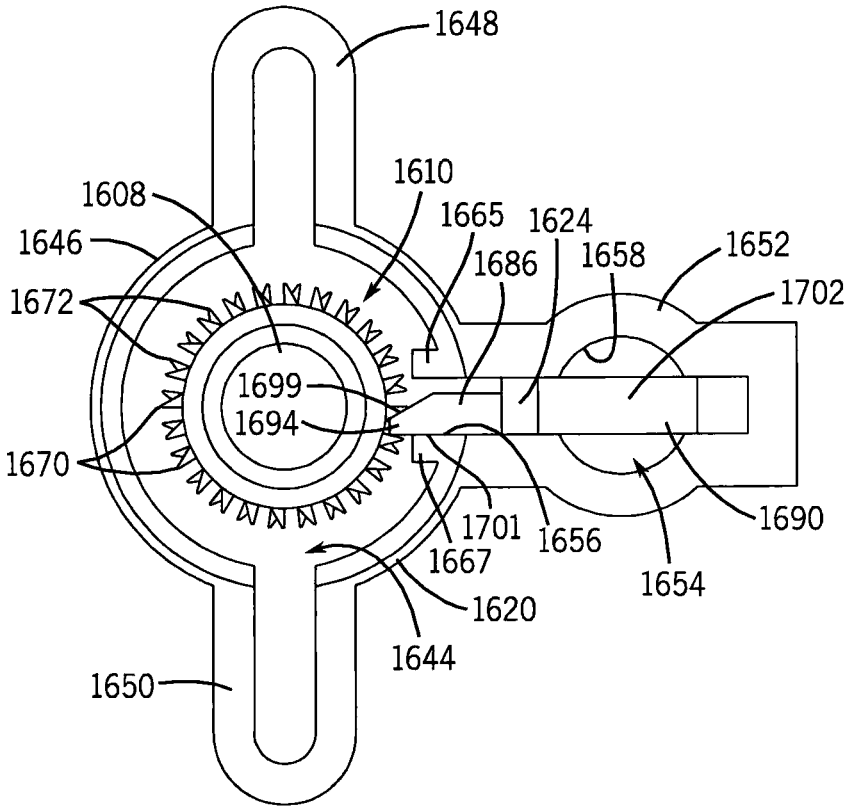
FIG. 55 is a top plan view of the slider assembly of FIG. 54, albeit with a spring and a bearing removed.

Referring specifically to FIGS. 53 through 55, first guide member 1620 is a channel 1644 forming member that has a substantially uniform cross section along its entire length. Member 1620 includes a central cylindrical portion 1646 and first and second lateral portions 1648 and 1650 that extend in opposite directions from central portion 1646 as well as a third lateral portion 1652 that extends, as the label implies, laterally from portion 1646 and that extends generally at a right angle to each of portions 1648 and 1650.

Referring specifically to FIGS. 54 and 55, central cylindrical portion 1646 forms a large cylindrical channel portion 1644. Third lateral portion 1652 forms a lateral channel 1654 along its length and is open at opposite ends. In general, in cross section or when viewed normal to an end, channel 1654 includes a narrow portion 1656 adjacent larger cylindrical channel 1644 and a small cylindrical channel portion 1658 that is separated from larger channel 1644 by narrow portion 1656. Along opposite long edges of narrow channel portion 1656 leading from large channel portion 1644 into portion 1656, two extension ribs or lips 1665 and 1667 extend into large cylindrical channel portion 1644 a short distance.

Figure 45:
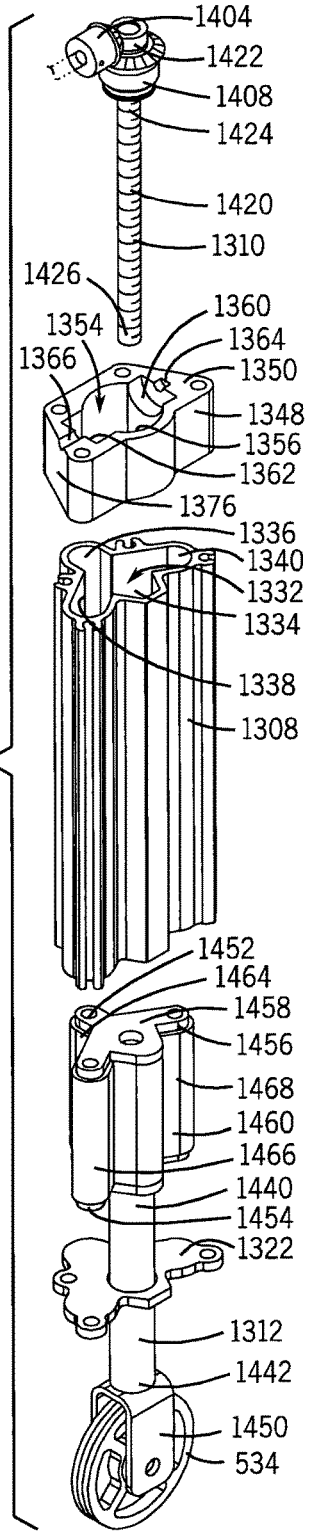
FIG. 45 is a perspective and partially exploded view of the assembly of FIG. 44, albeit including a lower housing member.

In this embodiment, first and second lateral portions 1648 and 1650 serve functions similar to portions or extensions 1452, 1454 and 1456 shown in FIG. 45 above (e.g., portions 1648 and 1650 guide and inhibit rotation of the first guide member 1600 along the length of a second guide member 1602). In at least some embodiments, although not illustrated, portions 1648 and 1650 will be covered via separator members akin to members 1464, 1466 and 1468 described above to reduce friction with the channel forming surface of guide member 1602. Also, although not illustrated, second guide member 1602 is formed to have an internal channel that compliments the cross-section of the external surface of first guide member 1620 (e.g., member 1602 includes or forms channels for receiving portions 1648 and 1650 and a channel that accommodates portion 1652).

End caps 1630 and 1632 is formed so that an edge thereof generally compliments the external surface of shell 1620 and each forms an opening 1623 and 1625, respectively, for passing shaft 1608 unimpeded. Caps 1630 and 1632 form internal spring housing surfaces 1633 and 1635 that face each other, respectively. In addition, each of caps 1630 and 1632 forms a lever passing opening 1637 and 1639, respectively, adjacent the shaft passing openings. Member 1612 is integrally attached to end cap 1632 and circumscribes shaft passing opening 1625.

Figure 56:
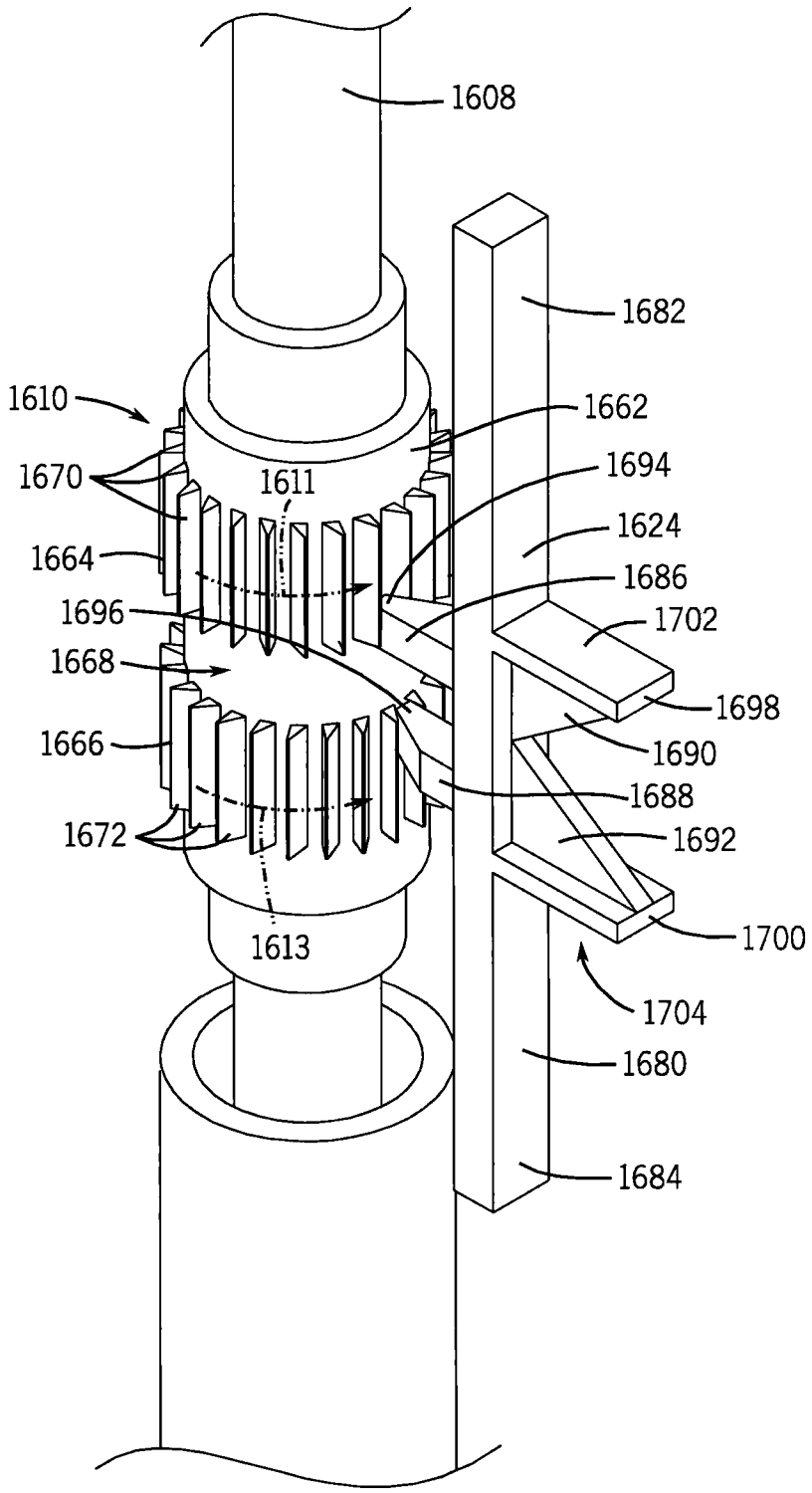
FIG. 56 is a perspective view of a nut and lever member shown in FIG. 55.
Figure 57:
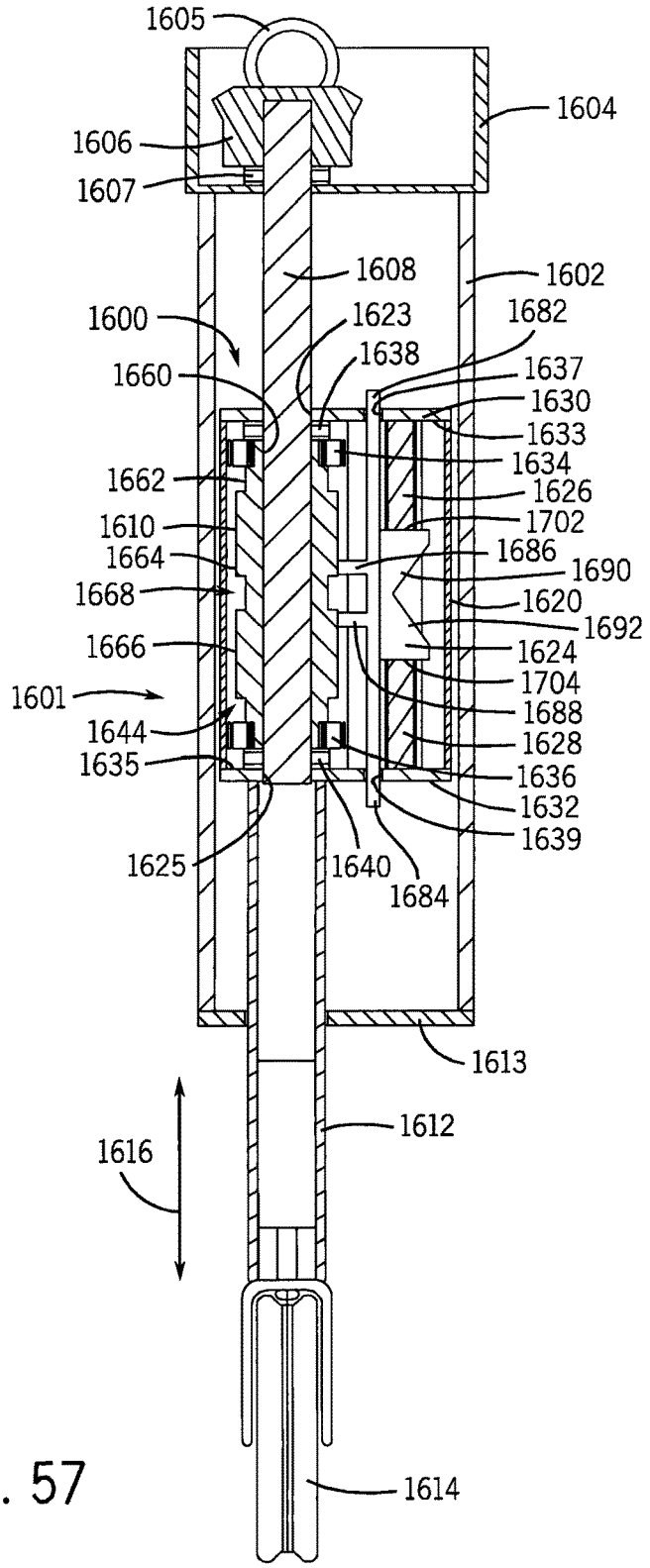
FIG. 57 is a cross-sectional view of the assembly of FIG. 53 installed in a preload force adjustment configuration where the slider assembly or guide member is in an intermediate position.

Referring now to FIGS. 55 through 57, an internal surface of nut 1610 forms a threaded aperture 1660 that extends along its length where the thread compliments the thread of shaft 1608. Nut 1610 has a complex external surface 1662 including a first toothed portion 1664 that includes a first set of teeth, a second toothed portion 1666 that includes a second set of teeth and a central recessed space or portion 1668 that is formed between toothed portions 1664 and 1666 and that extends around the entire circumference of nut 1610. In at least some embodiments recessed portion 1668 has a dimension between portions 1664 and 1666 that is approximately ½ inch although other spacings are contemplated.

As best seen in FIGS. 55 and 56, each tooth 1670 that forms part of portion 1664 slants in a first direction (e.g., counterclockwise) when viewed from an end of nut 1610 while each tooth 1672 that forms part of portion 1666 slants in a second direction (e.g., clockwise) opposite the first direction when viewed from an end of nut 1610. More specifically, each tooth 1670 generally includes a radially directed rear surface that extends radially from a central port of nut 1610 and a second slanted or ramped front surface that slants toward the rear surface adjacent a distal end of the tooth. Similarly, each tooth 1672 has a first radially directed rear surface and a second slanted or ramped front surface.

Referring to FIG. 56, when nut 1610 rotates, teeth 1670 in the first set of travel along a first circular path 1611 about an axis on which shaft 1608 is aligned and teeth 1672 in the second set travel along a second circular path 1613 about the shaft axis.

Herein, it will be assumed that shaft 1608 is rotated clockwise to move assembly 1600 down and counter-clockwise to move the assembly 1600 up. It will also be assumed that nut 1610 is to be mounted to shaft 1608 with toothed portion 1644 above portion 1666 as shown in FIGS. 56 and 57. When so mounted teeth 1670 will slope in a counter-clockwise direction when viewed from above and teeth 1672 will slope in a clockwise direction.

Referring to FIG. 57, nut 1610 is supported within shell cavity 1644 via first and second annular thrust bearings 1638 and 1640 that are sandwiched between opposite axial ends of nut 1610 and facing surfaces 1633 and 1635 of end caps 1630 and 1632, respectively, as well as first and second annular radial bearings 1634 and 1636 that are sandwiched between cylindrical radial wall portions (not labeled) at opposite ends of nut 1610 and the internal portion of guide member 1620 that forms large cylindrical channel portion 1644. When so positioned, nut 1610 is effectively suspended within channel portion 1644 and is free to rotate therein until lever member 1624 is installed.

Referring to FIGS. 55 through 57, lever member 1624 includes an elongated member 1680 that has first and second oppositely extending ends 1682 and 1684, respectively, first and second nut engaging extension members 1686 and 1688 and first and second spring bearing or engaging members 1690 and 1692, respectively. Member 1680 has a length dimension that is greater than the length (not labeled) of first guide member 1620 and end caps 1630 and 1632 combined so that, when positioned within guide member 1620, ends 1682 and 1684 extend out lever passing openings 1637 and 1639. Engaging extension members 1686 and 1688 extend at right angles and in the same direction from a central portion of member 1680, are parallel to each other, are spaced apart a dimension that is larger than the dimension between toothed portions 1664 and 1666 of nut (i.e., are spaced apart a dimension that is greater than the width of central recessed portion 1668) and include distal ends 1694 and 1696, respectively.

Hereinafter, it will be assumed that lever member 1624 will be positioned adjacent nut 1610 with end 1682 extending upward and with members 1686 and 1688 generally proximate toothed portions 1664 and 1666, respectively. In addition, as shown in FIG. 57, members 1686 and 1688 are dimensioned so that when ends 1682 and 1684 are received through openings 1637 and 1639, distal ends 1694 and 1696 are located within paths 1611 and 1613 (see also FIG. 56) that teeth 1670 and 1672 travel, during nut 1610 rotation. At distal ends 1694 and 1696, members 1686 and 1688 form ramped or sloped surfaces (one shown as 1699 in FIG. 55) that face in opposite directions. The surfaces (one shown at 1701) of member 1686 and 1688 opposite the ramped surfaces (e.g., surface 1699) are generally flat (i.e., are not sloped or ramped) and parallel to each other. When lever member 1624 is positioned adjacent nut 1610, ramped surface 1699 faces the sloped or ramped surface of an adjacent one of teeth 1670 and the surface on member 1686 opposite ramped surface 1699 faces a radially extending surface of a second adjacent tooth 1670. Similarly, when so positioned, the ramped surface (not labeled) of member 1688 and the oppositely facing flat surface face the sloped and radially extending surfaces of adjacent tooth 1672, respectively.

Spring supporting or contacting members 1690 and 1692 extend from the central portion of member 1680 in the same direction and in a direction opposite the direction in which members 1686 and 1688 extend, form distal ends 1698 and 1700 and also form oppositely facing spring engaging surfaces 1702 and 1704 that face in the directions that ends 1682 and 1684 extend, respectively.

In at least some embodiments lever member 1624 is formed of a resilient plastic material so that ends 1682 and 1684 bend or twist like a leaf spring when sufficient force is applied to distal ends 1694 and 1696. Similarly, nut 1610 may be formed of plastic.

Referring to FIGS. 54 and 57, springs 1626 and 1628 are cylindrical compression springs. In at least some cases, springs 1626 and 1628 are metallic. Springs 1626 and 1628 are dimensioned such that they are at least partially loaded when positioned within channel 1654 as illustrated in FIG. 57 between spring bearing surfaces 1634 and 1635 and engaging surfaces 1702 and 1704.

Referring again to FIGS. 53-57, to assemble assembly 1600, end plate 1632 is mounted to an end of first guide member 1620 via screws or the like. Bearings 1640, 1636, 1634 and 1638 and nut 1610 are placed within large cylindrical channel portion 1644 (see FIGS. 54 and 57), spring 1628 is slid into channel 1654 and then lever member 1624 is slid into reduced width portion 1656 with surface 1704 aligned with spring 1628 and distal ends 1694 and 1696 aligned with one of the spaces formed between teeth 1670, 1672. Eventually end 1684 extends through opening 1639. Next spring 1626 is placed in channel 1654 so that an inner end bears against surface 1702. Top cap 1630 is placed on the exposed end of guide member 1620 so that lever end 1682 extends from opening 1637 and springs 1626 and 1628 are compressed somewhat. Cap 1630 is secured to guide member 1620 via screws or the like.

Continuing, assembly 1600 is fed onto a lower end of shaft 1608 by aligning shaft 1608 with nut 1610 and rotating shaft 1608. Guide member 1602 is aligned with assembly 1600 and is mounted to housing 1604 with assembly 1600 located within the channel formed by guide member 1602. End cap 1613 is mounted to the end of guide member 1602 opposite housing 1604 and clevis/pulley 1614 is mounted to the distal end of member 1612.

Figure 58:
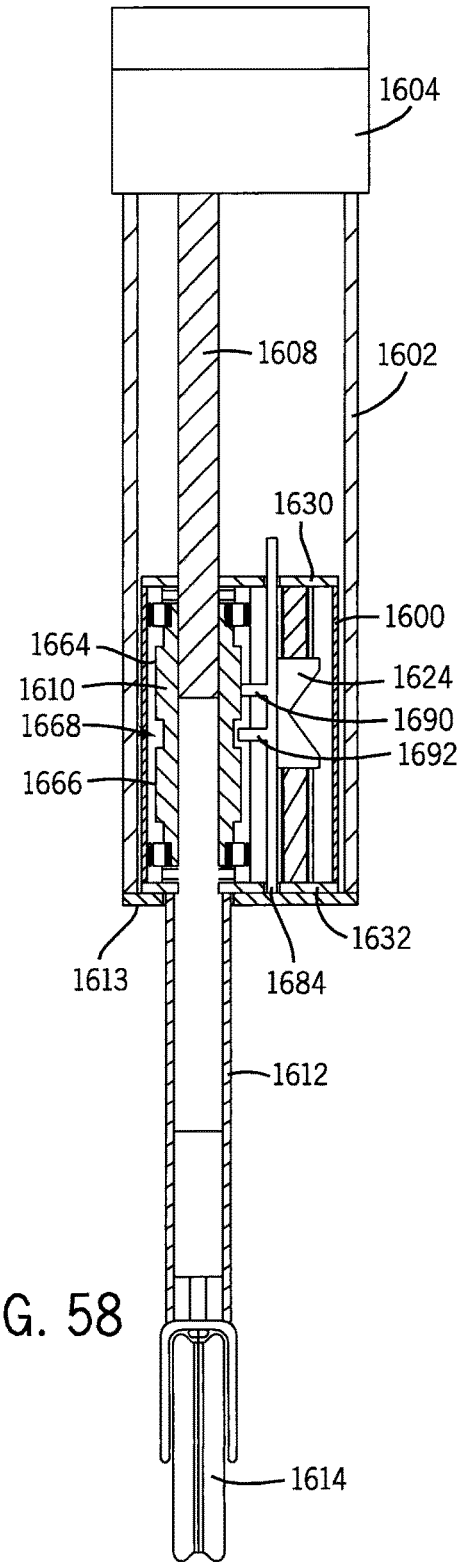
FIG. 58 is similar to FIG. 57, albeit showing the slider assembly or guide member in a minimum preload force position.
Figure 59:
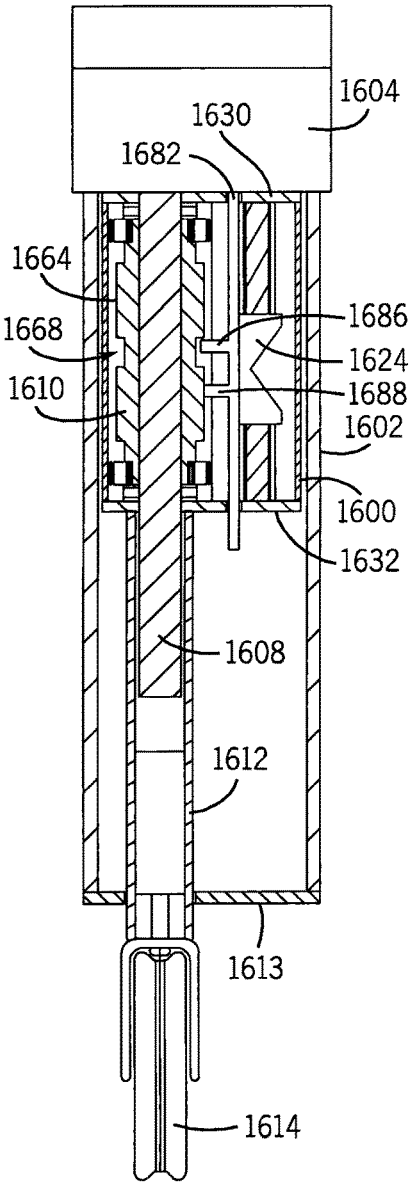
FIG. 59 is similar to FIG. 57, albeit showing the slider assembly or guide member in a maximum preload force position.

In operation, referring to FIGS. 57-59, when assembly 1600 is intermediately positioned between housing 1604 and end cap 1613 so that lever ends 1682 and 1684 do not contact either the undersurface of housing 1604 (e.g., a first bearing surface) or a top surface (e.g., a second bearing surface) of end cap 1613 (see FIG. 57), springs 1626 and 1628 center lever 1624 along the length of guide member 1620 and with respect to nut 1610 so that distal end 1694 of member 1686 is aligned with and at least partially disposed within the first cylindrical path 1611 (see again FIG. 56) and distal end 1696 of member 1688 is aligned with and at least partially disposed within the second cylindrical path 1613. In this relative juxtaposition, lever 1624 effectively locks nut 1610 within first guide member 1620 so that nut 1610 does not rotate when shaft 1608 is rotated and therefore nut 1610 and assembly 1600 generally move up or down when shaft 1608 is rotated. More specifically, referring to FIGS. 55-57, when shaft 1608 rotates clockwise, the radial flat (i.e., un-slanted) surface of one of the teeth 1672 contacts the adjacent flat un-slanted surface of member 1688 and nut 1610 is locked to guide member 1620 so that assembly 1600 moves downward. Similarly, when shaft 1608 rotates counter-clockwise, the radial flat and un-slanted surface of one of teeth 1670 contacts the adjacent flat un-slanted surface of member 1686 and nut 1610 is locked to guide member 1620 so that assembly 1600 moves upward.

Referring to FIGS. 56 and 58, when assembly 1600 reaches a lower end of movement allowed by cap member 1613 (i.e., a minimum preload force position), lever end 1684 contacts member 1613 which drives lever member 1624 upward against the force of spring 1626 and into a second lever position. When member 1624 moves upward with respect to guide member 1620, distal end 1696 of member 1688 moves upward and into the recessed space 1668 of nut 1610. When end 1696 moves into recessed space 1668, member 1688 no longer engages nut 1610. Referring to FIGS. 55 and 56, because member 1686 has a ramped surface 1699 that faces the oppositely ramped tooth surfaces of nut 1610 when nut 1610 is rotated to move assembly 1600 downward and because ends 1682 and 1684 tend to twist when sufficient force is applied to distal ends 1694 and 1696, upon further rotation of shaft 1608 clockwise to move assembly 1600 downward, ends 1682 and 1684 twist and member 1686 slips across the aligned teeth 1670 and hence nut 1610 is no longer "locked" with respect to assembly of 1600. Nut 1610 rotates with shaft 1608.

If, however, shaft 1608 is rotated counter-clockwise to move assembly 1600 upward, the unramped surface of member 1686 engages and "locks" onto the unramped surface of an adjacent one of teeth 1670 and nut 1610 is again locked to assembly 1600 so that assembly 1600 moves upward.

Referring to FIGS. 55, 56 and 59, when assembly 1600 reaches an upper end of movement allowed by the undersurface of housing 1604 (i.e., a maximum preload force position), lever end 1682 contacts the undersurface or bearing surface of housing 1604 which drives lever member 1624 downward against the force of spring 1628 and into a first lever position. When member 1624 moves downward with respect to shell 1620, distal end 1694 of member 1686 moves downward and into recessed space 1668 of nut 1610. When end 1694 moves into recesses space 1668, member 1686 no longer engages nut 1610. Referring to FIGS. 55 and 56, because member 1688 has a ramped surface at distal end 1696 that faces the oppositely ramped tooth surfaces of nut 1610 when nut is rotated to move assembly 1600 upward and because ends 1682 and 1684 tend to twist when sufficient force is applied to distal ends 1694 and 1696, upon further rotation of shaft 1608 counter-clockwise to move assembly 1600 upward, ends 1682 and 1684 twist and member 1688 slips across the aligned teeth 1672 and hence nut 1610 is no longer "locked" with respect to assembly 1600. Nut 1610 rotates with shaft 1608.

Figure 60:
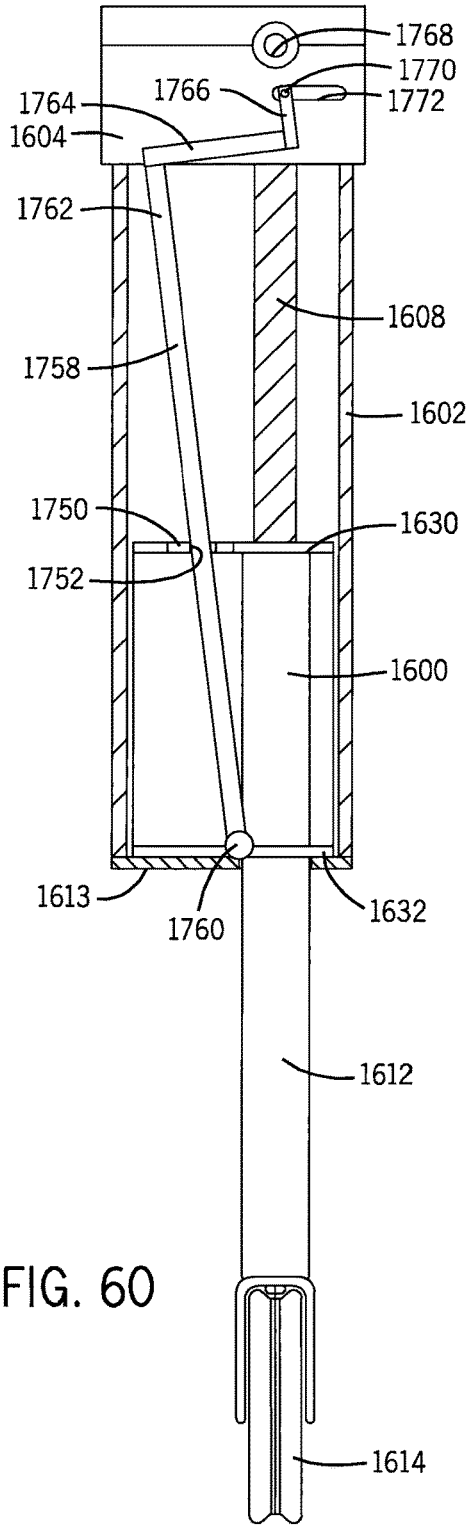
FIG. 60 is a schematic view showing another indicator embodiment that may be used with the slider assembly of FIG. 53.
Figure 61:
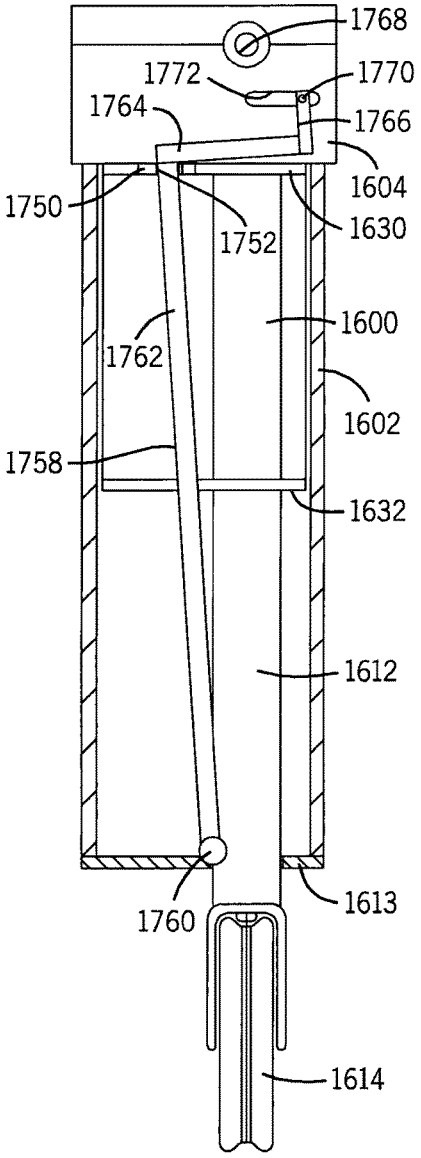
FIG. 61 is similar to FIG. 60, albeit showing the indicator assembly in a second relative juxtaposition.

Referring again to FIG. 53, in at least some embodiments cap 1630 will include an indicator extension 1750 that extends laterally from an edge and that forms an opening 1752 at a distal end 1754. Referring also to FIGS. 60 and 61, a pivoting indicator member 1758 akin to member 1506 shown in FIGS. 51 and 52 is illustrated where member 1758 is pivoted about a pivot point 1760 near the bottom end of second guide member 1602 and extends to a distal second end 1762. At distal end 1762 a lateral extension 1764 extends laterally and an upward extension member 1766 extends upward to a location just below a drive or adjustment tool engaging structure 1768 for connecting a tool to gear 1605 (see again FIG. 57). An indicator pin 1770 extends from a distal end of member 1766 and is visible (i.e., pin 1770 is a visible portion) through a slot 1772 (shown in phantom) akin to the slot 1522 shown in FIG. 52 above. Member 1758 extends through opening 1752 and includes an intermediate portion that contacts the surface or edge that forms opening 1752 and is forced by member 1750 to pivot about point 1760 as assembly 1600 moves within guide member 1602.

Referring to FIG. 60, when assembly 1600 is in the lowest position allowed by end cap 1613, member 1758 pivots to the position illustrated and pin 1770 is located at an end of slot 1772 marked "Low" to indicate that the pre-load force is relatively low. Similarly, referring to FIG. 61, when assembly 1600 is in the highest position allowed by the undersurface of housing 1604, member 1758 pivots to the position illustrated and pin 1770 is located at an end of slot 1772 marked "High" to indicate that the pre-load force is relatively high.

While the invention may be susceptible to various modifications and alternative forms, specific embodiments have been shown by way of example in the drawings and have been described in detail herein. However, it should be understood that the invention is not intended to be limited to the particular forms disclosed. For example, while various sub-assemblies have been described above including a locking assembly, a counterbalance assembly, roller assemblies, braking assemblies, etc., it should be appreciated that embodiments are contemplated that include only one of the aforementioned assemblies, all of the aforementioned assemblies or any subset of the aforementioned assemblies. In addition, while rectilinear columns have been described above, it should be appreciated that other column shapes are contemplated including columns that are round in cross-section, oval in cross-section, triangular in cross-section, octagonal in cross-section, etc. Moreover, while counterbalance assemblies are described above wherein a bottom or lower column forms a passageway for receiving a top or upper column that extends therefrom, other embodiments are contemplated where the top column forms a passageway in which the top end of a lower column is received. Furthermore, other counterbalance configurations are contemplated wherein the counterbalance spring and snail cam pulley are differently oriented. For instance, where the upper column forms the passageway that receives an upper end of the lower column, the counterbalance assembly 34 illustrated in FIG. 3 may be inverted and mounted within the internal passageway formed by the lower column with the first end (e.g., 71) of the strand (e.g., 69) extending downward to the lower end of the top column. Here, the counterbalance mechanism would work in a fashion similar to that described above.

In addition, other mechanical means for fastening the second end of spring 84 to the second end 73 of strand 69 are contemplated. Moreover, while the snail cam pulley 74 is optimally designed to result in a flat rope force at the first end 71 of strand 69, other force curves are contemplated that are at least substantially flat or, for example, where the counterbalance force may be greater or lesser than a constant flat force at the ends of the table stroke. For example, referring again to FIG. 8, when table top 14 prime approaches the lower position as illustrated, cam 74 may be designed to increase the upper counterbalance force to slow movement of the table downward.

In addition, while an exemplary roller and raceway configuration was described above with respect to FIGS. 12-15A, other configurations are contemplated and will be consistent with at least some aspects of the described invention. For instance, instead of providing columns that are rectilinear in cross-section, columns that are generally triangular in cross-section, may be provided where three roller assemblies, one at each one of the corners of the triangle, are provided and where the rollers are offset. Other roller configurations and column configurations are contemplated.

Moreover, while one locking configuration is described above, it is contemplated that other locking configurations may be employed with either the roller and raceway assembly described above or with the counterbalance assembly described above. Also, along these lines, locking assemblies that include only the primary locking member 430 and that do not include the other configuration components that lock when overload and underload conditions occur are contemplated.

Furthermore, while a brake sub-assembly has been described in the context of a locking assembly as illustrated in FIGS. 28-30, it is contemplated that the brake assembly could be employed separately and that other structures could be provided to provide a braking surface.

Moreover, other braking mechanisms are contemplated such as, for instance, a damping cylinder whose first and second ends are mounted to first and second telescoping columns to restrict velocity of telescoping activity. Other types of gear and cylinder mechanism are contemplated in at least some inventive embodiments.

In addition, while the invention is described above in the context of an assembly including one column that extends relative to another, the invention is applicable to configurations that include three or more telescoping columns to aid movement between each two adjacent column stages.

Furthermore, referring again to FIG. 14, while mounting surfaces 220, 222, 224 and 226 are shown as flat planar surfaces for mounting rollers (e.g., 192), it should be appreciated that other structure could be provided to mount the rollers in juxtapositions that achieve the same purpose. For instance, each roller in a roller pair (e.g., 198 and 196 in an associated pair—see FIG. 13) may be mounted to a different surface where the different surfaces are co-planar but separated by some other topographical structure (e.g., a rib or the like) therebetween. As another instance, the rollers in a pair could have different dimensions (e.g., widths, radii, etc.) but nevertheless be mounted to non-planar mounting surfaces akin to surface 220 that position the rollers to perform the same function as described above with respect to the races that receive the rollers.

In addition, while two types of clutches are is illustrated above for use in the preload adjustment mechanism, other types of clutches are contemplated. For instance, referring to FIG. 56, a different nut 1610 may not include recessed space 1668 and instead portions 1664 and 1666 may abut. Here, as member 1624 slides at the maximum and minimum preload force positions, member 1686 and 1688 may slide off the top and bottom ends of the teeth 1670 and 1672 instead of sliding into the recessed space 1668. Here, the tooth slants or ramps and corresponding ramped ends of members 1686 and 1688 would have to be reversed. In other embodiments, the nut teeth 1670 and 1672 may not be slanted/ramped or the engaging members 1686 and 1688 may not form ramped surfaces.

Moreover, while two types of preload force indicators are shown above, other indicators types are contemplated.

Thus, the invention is to cover all modifications, equivalents, and alternatives falling within the spirit and scope of the invention as defined by the following appended claims. To apprise the public of the scope of this invention, the following claims are made:

What is claimed is:

1. A table assembly comprising:

a telescoping leg assembly having upper and lower ends and forming an internal passageway and further including a plurality of leg members, at least a first leg member is adapted to slide telescopically with respect to at least a second of the leg members along a substantially vertical extension axis between an extended position and a retracted position;

the table assembly further including a spring that generates a variable spring force, the spring having first and second ends, the first end of the spring coupled to one of the first and second leg members, the spring aligned substantially parallel to the vertical extension axis and located within the internal passageway;

a rotatable cam member supported by the one of the first and second leg members that the spring is coupled to, the cam member operatively linked with to the second end of the spring, the cam member and spring applying a force tending to drive the leg assembly into the extended position, the cam member rotating around an axis as the first leg member moves between the extended and retracted positions, the rate of cam member rotation changing in a non-linear fashion as the first leg member moves toward the extended position;

a worksurface mounted to the upper end of the leg assembly for substantially vertical movement between an upper position and a lower position as the first leg member moves between the extended and retracted positions, respectively; and a lock adapted to prevent the plurality of members from sliding telescopically with respect to one another so that, when engaged, the first leg member is locked in a position incrementally between the extended and retracted positions.

2. The table assembly of claim 1 wherein each of the first and second leg members forms an internal passageway.

3. The table assembly of claim 1 wherein the cam member resides below the spring.

4. The table assembly of claim 3 wherein a strand links the second end of the spring with the cam member.

5. The table assembly of claim 4 wherein the spring compresses as the leg assembly contracts.

6. The table assembly of claim 4 wherein the cam member rotates about a horizontal axis as the first leg member moves between the extended and retracted positions.

7. The table assembly of claim 6 wherein a first end of the strand is linked to the spring, an intermediate portion of the strand engages the cam member and a second end of the strand is coupled to the other of the first and second leg members.

8. The table assembly of claim 7 wherein the worksurface is substantially rectangular having front and rear edges separated by first and second lateral edges, respectively, an upper end of the leg assembly linked to the worksurface centrally between the first and second lateral edges proximate the rear edge.

9. The table assembly of claim 8 wherein a lower end of the leg assembly is separated from a supporting ambient floor surface.

10. The table assembly of claim 9 wherein the lower end of the leg assembly is separated from the supporting ambient floor surface by a base member.

11. The table assembly of claim 8 wherein a lower one of the first and second leg members is supported by an ambient floor engaging subassembly including a substantially flat planar member.

12. The table assembly of claim 11 wherein the flat planar member is mounted at a lower end of the leg assembly and wherein an undersurface of the flat planar member contacts the ambient floor.

13. The table assembly of claim 11 further including a preloader supported by the leg assembly and operably linked to the spring, the preloader applying a preload force to the spring when the first leg member is in a fully extended position, the assembly further including an adjuster for adjusting the preload force applied by the preloader.

14. The table assembly of claim 13 further including rollers mounted to at least one of the first and second leg members to reduce friction between the first and second leg members during movement between the extended and retracted positions.

15. The table assembly of claim 3 wherein the worksurface is a primary tabletop for use in a work environment.

16. The table assembly of claim 1 wherein the worksurface is substantially rectangular having front and rear edges separated by first and second lateral edges, respectively, an upper end of the leg assembly linked to the worksurface centrally between the first and second lateral edges proximate the rear edge.

17. The table assembly of claim 16 wherein the worksurface has an undersurface, an upper end of the leg assembly secured to the undersurface.

18. The table assembly of claim 1 wherein the leg assembly is a single leg assembly.

19. The table assembly of claim 1 further includes a base at the lower end of the leg assembly adapted to abut a floor surface.

20. The table assembly of claim 1 wherein the lower end of the leg assembly is separated from an adjacent floor surface.

21. The table assembly of claim 1 wherein the leg assembly is the primary support for the worksurface.

22. The table assembly of claim 1 further including a preloader supported by the leg assembly and operably linked to the spring, the preloader applying a preload force to the spring when the first leg member is in a fully extended position, the assembly further including an adjuster for adjusting the preload force applied by the preloader.

23. The table assembly of claim 22 further including rollers mounted to at least one of the first and second leg members to reduce friction between the first and second leg members during movement between the extended and retracted positions.

24. The table assembly of claim 1 further including a lock activation lever supported below the worksurface, the lock located within the internal passageway and a cable coupled between the activation lever and the lock wherein at least a portion of the cable extends down through the internal passageway.

25. The table assembly of claim 1 wherein the force applied by the spring and cam member to the leg assembly is substantially constant irrespective of the relative positions of the first and second leg members.

26. The table assembly of claim 1 wherein the first end of the spring is coupled to the first leg member.

27. The table assembly of claim 26 wherein the second leg member is stationary as the first leg member moves to different positions with respect to the second leg member.

28. The table assembly of claim 1 further including a strand that links the cam member to the other of the first and second leg members.

29. The table assembly of claim 28 wherein a first end of the strand is linked to the spring, an intermediate portion of the strand engages the cam member and a second end of the strand is coupled to the other of the first and second leg members.

30. The table assembly of claim 13 wherein the lock includes a spring loaded lever member that is biased by the spring toward a locked position, the table assembly further including a lock activation cable that extends down at least an upper portion of the leg assembly and that links to the lever member and an activation lever that is operably coupled to the activation cable such that when the activation lever is activated, the cable causes the lever member to pivot to an unlocked position.

31. A table assembly comprising:

a telescoping leg assembly including a plurality of leg members and having upper and lower ends, at least a first upper leg member adapted to slide telescopically with respect to at least a second lower leg member along a substantially vertical extension axis between an extended position and a retracted position;

the table assembly further including a spring that generates a variable spring force, the spring having first and second ends and mounted to one of the first and second leg members;

a rotatable cam member supported by the one of the first and second leg members;

a strand linking the spring and the cam member;

a support member supported at the upper end of the upper leg member for substantially vertical movement between an upper and a lower position as the leg assembly moves between the extended and retracted positions, respectively; and a lock adapted to prevent the plurality of leg members from sliding telescopically with respect to one another so that, when engaged, the leg assembly is locked in a position incrementally between the extended and retracted positions; and wherein, the spring, cam member and strand are operatively linked together and to the leg assembly so that the cam member and spring applying a substantially constant force tending to drive the leg assembly into the extended position, the cam member rotating around an axis as the leg assembly moves between the extended and retracted positions, the rate of cam member rotation changing in a non-linear fashion as the leg assembly moves toward the extended position.

32. The table assembly of claim 31 further including a base supporting the lower leg member.

33. The table assembly of claim 32 wherein the base suspends a lower end of the leg assembly above a supporting ambient floor surface.

34. The table assembly of claim 33 wherein the base is located at the lower end of the leg assembly and extends from that lower end to the floor surface.

35. The table assembly of claim 31 further including a preloader supported by the leg assembly and operably linked to the spring, the preloader applying a preload force to the spring when the first leg member is in a fully extended position, the assembly further including an adjuster for adjusting the preload force applied by the preloader.

36. The table assembly of claim 35 wherein the preloader includes an elongated guide member, a slider structure and a threaded shaft, the guide member forms at least one linear channel, the slide structure including an external surface that engages the linear channel for sliding motion there along and forming a threaded through hole, the threaded shaft extending along and spaced apart from the channel and passing through and engaging the threaded opening, the slide structure operably connected to the spring so that as the shaft rotates, the slide structure slides along the channel and adjusts loading of the spring.

37. The table assembly of claim 36 wherein the preloader guide member is mounted to the same leg member that the spring is mounted to.

38. The table assembly of claim 31 wherein the spring is an elongated spring and is vertically oriented.

39. The table assembly of claim 31 wherein the spring contracts as the first leg member moves toward the retracted position.

40. The table assembly of claim 31 wherein the stationary leg member forms an internal cavity.

41. The table assembly of claim 31 wherein at least one of the leg members forms an internal cavity and wherein the spring and cam member are located within the internal cavity.

42. The table assembly of claim 31 wherein a first end of the strand is linked to the spring and a second end of the strand is linked to the stationary leg member.

43. A table assembly comprising:

a telescoping leg assembly including a plurality of leg members and having upper and lower ends, at least a first upper leg member adapted to slide telescopically with respect to at least a second lower leg member along a substantially vertical extension axis between an extended position and a retracted position;

the table assembly further including a spring that generates a variable spring force, the spring having first and second ends and mounted to one of the first and second leg members;

a rotatable cam member supported by the one of the first and second leg members at a height below a lower end of the spring;

a strand linking the spring and the cam member;

a support member supported at the upper end of the upper leg member for substantially vertical movement between an upper and a lower position as the leg assembly moves between the extended and retracted positions, respectively;

a lock adapted to prevent the plurality of leg members from sliding telescopically with respect to one another so that, when engaged, the leg assembly is locked in a position incrementally between the extended and retracted positions, the lock including a spring loaded lever member that is biased by the spring toward a locked position;

a lock activation cable that extends down at least an upper portion of the first leg member and that links to the lever member; and an activation lever mounted to an undersurface of the support member that is operably coupled to the activation cable such that when the activation lever is activated, the cable causes the lever member to pivot to an unlocked position; and wherein, the spring, cam member and strand are operatively linked together and to the leg assembly so that the cam member and spring applying a substantially constant force tending to drive the leg assembly into the extended position, the cam member rotating around an axis as the leg assembly moves between the extended and retracted positions, the rate of cam member rotation changing in a non-linear fashion as the leg assembly moves toward the extended position.

* * * * *